US011139550B2

(12) United States Patent
Yang

(10) Patent No.: US 11,139,550 B2
(45) Date of Patent: Oct. 5, 2021

(54) STACK ANTENNA STRUCTURES AND METHODS

(71) Applicant: TAOGLAS GROUP HOLDINGS LIMITED, Enniscorthy (IE)

(72) Inventor: Tsai Yi Yang, Tainan (TW)

(73) Assignee: TAOGLAS GROUP HOLDINGS LIMITED, Enniscorthy (IE)

( * ) Notice: Subject to any disclaimer, the term of this patent is extended or adjusted under 35 U.S.C. 154(b) by 0 days.

(21) Appl. No.: 16/263,379

(22) Filed: Jan. 31, 2019

(65) Prior Publication Data

US 2019/0267697 A1 Aug. 29, 2019

(30) Foreign Application Priority Data

Jan. 31, 2018 (TW) ..... 107103482
Jan. 31, 2018 (TW) ..... 107103490
Jan. 31, 2018 (TW) ..... 107103492
Jan. 31, 2018 (TW) ..... 107103494
Jan. 31, 2018 (TW) ..... 107103504
Jan. 31, 2018 (TW) ..... 107103505
(Continued)

(51) Int. Cl.

| | |
|---|---|
| ***H01Q 1/22*** | (2006.01) |
| ***H01Q 1/36*** | (2006.01) |
| ***H01Q 21/06*** | (2006.01) |
| ***H01Q 9/04*** | (2006.01) |
| ***H01Q 5/30*** | (2015.01) |

(Continued)

(52) U.S. Cl.

CPC ..... *H01Q 1/22* (2013.01); *H01Q 1/32* (2013.01); *H01Q 1/36* (2013.01); *H01Q 5/30* (2015.01); *H01Q 9/0414* (2013.01); *H01Q 21/061* (2013.01); *H01Q 21/30* (2013.01)

(58) Field of Classification Search

None

See application file for complete search history.

(56) References Cited

U.S. PATENT DOCUMENTS 5,043,738 A * 8/1991 Shapiro ..... H01Q 21/065 343/700 MS
5,898,403 A * 4/1999 Saitoh ..... H01Q 1/38 333/185

(Continued)

FOREIGN PATENT DOCUMENTS

CN 202695715 U 1/2013
CN 103259085 A 8/2013

(Continued)

OTHER PUBLICATIONS

Qisong et al., Combined antenna and handheld antenna device, 2013, Machine translation of CN103259085A in English (Year: 2013).*

*Primary Examiner* — Amy Cohen Johnson
*Assistant Examiner* — James H Cho
(74) *Attorney, Agent, or Firm* — Garson & Gutierrez, PC

(57) ABSTRACT

Three-stack antennas are disclosed which include a first antenna, a second antenna, a third antenna and a circuit board. After the first antenna, the second antenna and the third antennas are stacked on the circuit board orderly, feed-in components are electrically connected to the circuit board. The antenna structures can be surface mounted. The antenna structures can three-feed-in, four-feed-in or five-feed-in configurations, or four-hole or five-hole configurations.

19 Claims, 52 Drawing Sheets

(30) Foreign Application Priority Data

Jan. 31, 2018 (TW) ..... 107103506
Jan. 31, 2018 (TW) ..... 107103508

(51) Int. Cl.
*H01Q 1/32* (2006.01)
*H01Q 21/30* (2006.01)

(56) References Cited

U.S. PATENT DOCUMENTS

| | | | | |
|---|---|---|---|---|
| 6,545,641 | B2 * | 4/2003 | Ghosh | H01Q 1/243 343/700 MS |
| 2014/0240159 | A1 * | 8/2014 | Lawrence | H05K 9/0086 342/1 |
| 2018/0097288 | A1 * | 4/2018 | DiDomenico | H01Q 9/0407 |

FOREIGN PATENT DOCUMENTS

| | | | |
|---|---|---|---|
| CN | 103956584 | A | 7/2014 |
| CN | 203707332 | U | 7/2014 |
| CN | 104682016 | A | 6/2015 |
| CN | 105846051 | A | 8/2016 |
| CN | 110165385 | A | 8/2019 |
| CN | 110165386 | A | 8/2019 |
| CN | 110165387 | A | 8/2019 |
| CN | 110165388 | A | 8/2019 |
| CN | 110165389 | A | 8/2019 |
| CN | 110165390 | A | 8/2019 |
| CN | 110165391 | A | 8/2019 |
| EP | 0279050 | | 8/1988 |

* cited by examiner

STACK ANTENNA STRUCTURES AND METHODS

CROSS-REFERENCE

This application claims priority to Taiwan Patent Application 107103482, Taiwan Patent Application 107103508, Taiwan Patent Application 107103494, Taiwan Patent Application 107103492, Taiwan Patent Application 107103490, Taiwan Patent Application 107103506, Taiwan Patent Application 107103505, Taiwan Patent Application 107103504 all of which were filed Jan. 31, 2018, which applications are incorporated herein by reference in their entirety.

BACKGROUND

Field of the Invention

The present invention relates to an antenna, and especially relates to a surface mount type three-stack antenna which is applied to multiple bands.

The present invention also relates to an antenna, and especially relates to a patch antenna structure which is able to change a radiation pattern.

The present invention also relates to an antenna, and especially relates to a five-feed-in-and-three-stack antenna structures, four-feed-in-and-three-stack antenna structures, and three-feed-in-and-three-stack antenna structures which receive signals with different communication system frequencies.

The present invention also relates to an antenna, and especially relates to a four-hole-and-three-stack antenna structures, and five-hole-and-three-stack antenna structures which receive signals with different communication system frequencies.

The present invention also relates to an antenna, and especially relates to a feed-in-hole-insulation ceramic antenna structure that feed-in paths have coaxial cable characteristics.

Description of the Related Art

A receiving antenna structure for receiving GPS signals is built-in in a related art portable type GPS system. The receiving antenna structure of the GPS system is a pin type patch antenna structure. The pin type patch antenna structure comprises a base body made of a ceramic dielectric. A radiation metal layer is arranged on a surface of the base body. A grounded metal layer is arranged on a bottom surface of the base body. The base body defines a through hole. The through hole is through the radiation metal layer and the grounded metal layer. The through hole is provided for a needle signal feed-in body which is through the through hole. After the signal feed-in body is through the base body, the signal feed-in body is electrically connected to the radiation metal layer, but the signal feed-in body is not electrically connected to the grounded metal layer, so that a patch antenna structure which is able to be electrically and fixedly connected to a mainboard of an electronic item is formed.

The pin type patch antenna structure is only suitable for receiving signals of a single system. The base body of the pin type patch antenna structure is a cube so its volume is larger. Therefore, the pin type patch antenna structure cannot be arranged on the new generation electronic item which is light, thin and portable. When being soldered with the mainboard of the electronic item, the temperature curve may be not able to meet that the base body which has the larger volume and is made of the ceramic dielectric achieves the uniform temperature for being able to solder. This results in the difficulty of the soldering and processing. Moreover, when the pin type patch antenna structure is electrically and fixedly connected to the mainboard of the electronic item, the pin type patch antenna structure has to be soldered manually with tapes or glues, but the pin type patch antenna structure cannot be manufactured by machines.

It is known that currently a related art patch antenna used on the market comprises a base body made of ceramic materials. A radiation metal layer is arranged on a surface of the base body. A grounded metal layer is arranged on a back side of the base body. The base body comprises a signal feed-in side which is through the base body and is electrically connected to the radiation metal layer.

The related art patch antenna mentioned above mainly receives satellite signals right above the radiation pattern when the related art patch antenna mentioned above generates the radiation pattern. Correspondingly, the range for receiving signals from the terrestrial base station is smaller. In order to increase the effect of the related art patch antenna receiving the signals from the terrestrial base station, the related art patch antenna has to be redesigned. Thus, the manufacturing cost increases, and the manufacturing process becomes difficult.

Currently, the wireless communication systems used on the market at least comprise the global navigation satellite system (GNSS), the dedicated short range communication (DSRC), the satellite digital audio radio service (SDARS), the long term evolution (LTE), the wireless network systems (WLAN/BT), and so on. The global navigation satellite system comprises the global type, the regional type and the augmentation type, for examples, the global positioning system (GPS), the GLONASS (which is the abbreviation of the global navigation satellite system in Russian), the Galileo positioning system, the BeiDou navigation satellite system, and the related augmentation systems are, for examples, the wide area augmentation system (WAAS), the European geostationary navigation overlay service (EGNOS), the multi-functional satellite augmentation system (MSAS) and so on. In the wireless communication systems, each of the wireless communication systems is connected to a matched receiving antenna to receive signals.

In recent years, with the science and the technology unceasing progress, various wireless communication systems mentioned above are integrated into an electronic equipment (for example, an electronic control unit (ECU) of a vehicle), so that no matter where the electronic equipment is sold to in the world, the electronic equipment can be started to be used but the electronic equipment does not need the redesign. A plurality of antennas has to be arranged on the circuit board of the electronic equipment correspondingly to receive various wireless communication system signals because the electronic equipment integrates various wireless communication systems.

The antennas have to be integrated on the circuit board of the electronic equipment although the electronic equipment having such integration design is not limited by places or areas to be used. Each of the antennas has a specific size, and the locations for the antennas which are arranged dispersedly are not the same, and the antennas occupy the space. This results that the area of the circuit board becomes larger, and the housing that the circuit board is arranged in or the required space becomes larger correspondingly, so that the integration mentioned above becomes difficult.

Therefore, in order to solve the problems mentioned above, a plurality of the antennas are stacked and manufactured. After the antennas are stacked, the thickness of the overall antennas increase. The feed-in paths of the antenna signals are mismatch easily once the thickness of the overall antennas increase. The 50-Ohm impedance characteristics as a coaxial cable cannot be achieved, so that the efficiency of the antenna decreases.

SUMMARY

Therefore, an object of the present invention is to solve the problems mentioned above. The present invention provides a surface mount type three-stack patch antenna which comprises three stacked patch antennas and a circuit board, to receive signals of different systems. The surface mount type three-stack patch antenna is electrically connected to and arranged on a mainboard of an electronic apparatus by the surface mount way to significantly reduce the manpower for assembling to improve the efficiency and convenience for using.

In order to achieve the object mentioned above, the present invention provides a surface mount type three-stack antenna comprising a first antenna, a second antenna, a third antenna and a circuit board. The first antenna comprises a first base body, a first radiation metal layer, a grounded metal layer and two first feed-in components. The first radiation metal layer is arranged on a surface of the first base body. The grounded metal layer is arranged on a bottom surface of the first base body. The two first feed-in components are through the first base body. The two first feed-in components are electrically connected to the first radiation metal layer through the first base body. The two first feed-in components are through the bottom surface of the first base body, and neither of the two first feed-in components is electrically connected to the grounded metal layer. The second antenna comprises a second base body, a second radiation metal layer and two second feed-in components. The second base body is arranged on a surface of the first radiation metal layer on the first base body. The second radiation metal layer is arranged on a surface of the second base body. The two second feed-in components are through the second base body and the first base body, and are electrically connected to the second radiation metal layer. The two second feed-in components are configured to break through the bottom surface of the first base body to be outside the bottom surface of the first base body, and neither of the two second feed-in components is electrically connected to the grounded metal layer. The third antenna comprises a third base body, a third radiation metal layer and a third feed-in component. The third base body is arranged on a surface of the second radiation metal layer on the second base body. The third radiation metal layer is arranged on a surface of the third base body. The third feed-in component is through the third base body, the second base body and the first base body after the third feed-in component is electrically connected to the third radiation metal layer. The third feed-in component is configured to break through the bottom surface of the first base body to be outside the bottom surface of the first base body and is not electrically connected to the grounded metal layer. The circuit board is electrically connected to the third feed-in component, the two second feed-in components and the two first feed-in components which are through the third base body, the second base body and the first base body.

In an embodiment of the present invention, the first base body is configured to set up (namely, define) a first through hole, a second through hole, a third through hole, a fourth through hole and a fifth through hole. The first through hole, the second through hole, the third through hole, the fourth through hole and the fifth through hole are through the first base body, the first radiation metal layer and the grounded metal layer, and are defined to form a cross.

In an embodiment of the present invention, the two first feed-in components are configured to break through the first base body through the fourth through hole and the fifth through hole.

In an embodiment of the present invention, the second base body is configured to set up (namely, define) a sixth through hole, a seventh through hole and an eighth through hole. The sixth through hole, the seventh through hole and the eighth through hole are through the second base body and the second radiation metal layer. The sixth through hole, the seventh through hole and the eighth through hole are corresponding to the first through hole, the second through hole and the third through hole of the first base body respectively.

In an embodiment of the present invention, the two second feed-in components are through the seventh through hole and the eighth through hole respectively, and are electrically connected to the second radiation metal layer, and then are through the second through hole and the third through hole respectively to be extended outside the bottom surface of the first base body, and neither of the two second feed-in components is electrically connected to the grounded metal layer.

In an embodiment of the present invention, the third base body is configured to set up (namely, define) a ninth through hole. The ninth through hole is through the third base body and the third radiation metal layer. The ninth through hole is corresponding to the sixth through hole of the second base body and the first through hole of the first base body.

In an embodiment of the present invention, the third feed-in component is through the ninth through hole of the third base body, the sixth through hole of the second base body and the first through hole of the first base body to be outside the bottom surface of the first base body. The third feed-in component is electrically connected to the third radiation metal layer when the third feed-in component is through the ninth through hole. The third feed-in component is not electrically connected to the grounded metal layer when the third feed-in component is through the bottom surface of the first base body to be outside the bottom surface of the first base body.

In an embodiment of the present invention, the third feed-in component is in a T shape. The third feed-in component comprises a head and a shaft. The head is extended to the shaft.

In an embodiment of the present invention, the circuit board comprises a front side and a back side, and is configured to define a first punched hole, a second punched hole, a third punched hole, a fourth punched hole and a fifth punched hole. The first punched hole, the second punched hole, the third punched hole, the fourth punched hole and the fifth punched hole are corresponding to the first through hole, the second through hole, the third through hole, the fourth through hole and the fifth through hole respectively.

In an embodiment of the present invention, each of the first punched hole, the second punched hole, the third punched hole, the fourth punched hole and the fifth punched hole comprises an electrical connection point on the back side. Each of the electrical connection points is extended to an electrical fixing-connection point. The two first feed-in components, the two second feed-in components and the third feed-in component are through the bottom surface of the first base body of the first antenna to be outside the bottom surface of the first base body, and are electrically connected to the electrical connection points on the back side of the circuit board through the fourth punched hole, the fifth punched hole, the second punched hole, the third punched hole and the first punched hole orderly.

In an embodiment of the present invention, an area of the second base body is smaller than an area of the first radiation metal layer. The first radiation metal layer is exposed when the second base body is arranged on the surface of the first radiation metal layer.

In an embodiment of the present invention, an area of the third base body is smaller than an area of the second radiation metal layer. The second radiation metal layer is exposed when the third base body is arranged on the surface of the second radiation metal layer.

In an embodiment of the present invention, the first base body, the second base body and the third base body are flat plate-type bodies or block-shaped bodies made of ceramic dielectric materials.

Therefore, an object of the present invention is to solve the problems mentioned above. The present invention utilizes a simple design that the conducting component is in a suspending state to be arranged right above the patch antenna correspondingly. The conducting component is able to change the radiation pattern of the patch antenna when the patch antenna receives signals. The effect of the patch antenna receiving the signals of the satellite right above the patch antenna decreases slightly to increase the range for receiving the signals from the terrestrial base station dramatically. The overall receiving efficiency of the satellite antenna is improved.

In order to achieve the object mentioned above, the present invention provides a patch antenna structure changing a radiation pattern which comprises a support component, a conducting component and a patch antenna. The support component comprises a closed end and an open end. The closed end is arranged correspondingly to the open end. The conducting component appears as a sheet body and is arranged on a side of the closed end. The patch antenna is arranged on the open end, so that the conducting component is above the patch antenna correspondingly. Moreover, the conducting component is arranged correspondingly above the patch antenna, so that the conducting component is configured to change the radiation pattern of the patch antenna to improve a range for receiving signals from a terrestrial base station.

In an embodiment of the present invention, the support component is an insulating material.

In an embodiment of the present invention, the insulating material is a plastic or a rubber.

In an embodiment of the present invention, the support component is a hollowed-out cover.

In an embodiment of the present invention, the side of the closed end that the conducting component is arranged on is an inner side of the closed end.

In an embodiment of the present invention, the side of the closed end that the conducting component is arranged on is an outer side of the closed end.

In an embodiment of the present invention, the conducting component is a metal conducting material.

In an embodiment of the present invention, the patch antenna is a cube and is arranged on an inner wall of the open end of the support component. The patch antenna comprises a base body, a radiation metal layer, a grounded metal layer and a signal feed-in body. The base body is made of a ceramic dielectric. The radiation metal layer is arranged on a top surface of the base body and is corresponding to the conducting component. The grounded metal layer is arranged on a bottom surface of the base body. The signal feed-in body is in a T shape. The signal feed-in body comprises a head and a shaft. The signal feed-in body is through the base body. A terminal of the shaft of the signal feed-in body is configured to break through the bottom surface of the base body. The shaft is not electrically connected to the grounded metal layer. The head of the signal feed-in body is electrically connected to the radiation metal layer, so that the radiation metal layer is configured to form a signal receiving side.

In order to achieve the object mentioned above, the present invention provides another patch antenna structure changing a radiation pattern which comprises a support component, a conducting component and a patch antenna. The conducting component appears as a sheet body and is arranged on a top of the support component. The patch antenna is arranged with the support component, so that the conducting component is above the patch antenna correspondingly. Moreover, the conducting component is arranged correspondingly above the patch antenna, so that the conducting component is configured to change the radiation pattern of the patch antenna to improve a range for receiving signals from a terrestrial base station.

In an embodiment of the present invention, the support component is made of a material with a permittivity below 2.

In an embodiment of the present invention, the support component is a blocky object.

In an embodiment of the present invention, the support component is a Styrofoam or a foam.

In an embodiment of the present invention, the conducting component is a metal conducting material.

In an embodiment of the present invention, the patch antenna is a cube and is arranged on an inner wall of an open end of the support component. The patch antenna comprises a base body, a radiation metal layer, a grounded metal layer and a signal feed-in body. The base body is made of a ceramic dielectric. The radiation metal layer is arranged on a top surface of the base body and is arranged on a bottom of the support component. The grounded metal layer is arranged on a bottom surface of the base body. The signal feed-in body is in a T shape. The signal feed-in body comprises a head and a shaft. The signal feed-in body is through the base body. A terminal of the shaft of the signal feed-in body is configured to break through the bottom surface of the base body. The shaft is not electrically connected to the grounded metal layer. The head of the signal feed-in body is electrically connected to the radiation metal layer, so that the radiation metal layer is configured to form a signal receiving side.

In an embodiment of the present invention, the conducting component is arranged in parallel to the patch antenna.

In an embodiment of the present invention, a distance from the conducting component to the patch antenna is in a range of 0.4 cm to 0.5 cm.

In an embodiment of the present invention, the patch antenna supports frequency range of Satellite Digital Audio Radio Service ("SDARS").

In an embodiment of the present invention, an antenna system for a motor vehicle is provided to receive signals from a satellite. The antenna system includes a patch antenna structure, and the patch antenna structure includes: a conducting component appearing as a sheet body; and a patch antenna arranged below the conducting component; wherein the conducting component is arranged correspondingly above the patch antenna and is arranged horizontally with respect to the motor vehicle, so that the conducting component is configured to enhance the radiation pattern of the patch antenna in a horizontal direction.

In an embodiment of the present invention, the conducting component is removable to restore the radiation pattern of the patch antenna.

Therefore, an object of the present invention is to solve the problems mentioned above. The present invention provides a five-feed-in-and-three-stack antenna structure that three antennas are stacked together to receive various wireless communication system signals. The five-feed-in-and-three-stack antenna structure can be integrated with the electronic equipment easily, so that the integration design is easier and the area of the circuit board does not become larger.

In order to achieve the object mentioned above, the present invention provides the five-feed-in-and-three-stack antenna structure comprising a first antenna, a second antenna and a third antenna. The first antenna comprises a first-base body, a first-radiation-metal layer, a grounded-metal layer and two first-feed-in components. The first-radiation-metal layer is arranged on a surface of the first-base body. The grounded-metal layer is arranged on a bottom surface of the first-base body. The two first-feed-in components are through the first-base body. The two first-feed-in components are electrically connected to the first-radiation-metal layer through the first-base body. The two first-feed-in components are through the bottom surface of the first-base body, and neither of the two first-feed-in components is electrically connected to the grounded-metal layer. The second antenna comprises a second-base body, a second-radiation-metal layer and two second-feed-in components. The second-base body is arranged on a surface of the first-radiation-metal layer on the first-base body. The second-radiation-metal layer is arranged on a surface of the second-base body. The two second-feed-in components are through the second-base body and the first-base body, and are electrically connected to the second-radiation-metal layer. The two second-feed-in components are configured to break through the bottom surface of the first-base body to be outside the bottom surface of the first-base body, and neither of the two second-feed-in components is electrically connected to the grounded-metal layer. The third antenna comprises a third-base body, a third-radiation-metal layer and a third-feed-in component. The third-base body is arranged on a surface of the second-radiation-metal layer on the second-base body. The third-radiation-metal layer is arranged on a surface of the third-base body. The third-feed-in component is through the third-base body, the second-base body and the first-base body after the third-feed-in component is electrically connected to the third-radiation-metal layer. The third-feed-in component is configured to break through the bottom surface of the first-base body to be outside the bottom surface of the first-base body and is not electrically connected to the grounded-metal layer.

In an embodiment of the present invention, the first-base body is configured to set up (namely, define) a first-through hole, a second-through hole, a third-through hole, a fourth-through hole and a fifth-through hole. The first-through hole, the second-through hole, the third-through hole, the fourth-through hole and the fifth-through hole are through the first-base body, the first-radiation-metal layer and the grounded-metal layer.

In an embodiment of the present invention, the first-through hole, the second-through hole, the third-through hole, the fourth-through hole and the fifth-through hole are defined to form a cross.

In an embodiment of the present invention, the two first feed-in components are configured to break through the first-base body through the fourth-through hole and the fifth-through hole.

In an embodiment of the present invention, the second-base body is configured to set up (namely, define) a sixth-through hole, a seventh-through hole and an eighth-through hole. The sixth-through hole, the seventh-through hole and the eighth-through hole are through the second-base body and the second-radiation-metal layer. The sixth-through hole, the seventh-through hole and the eighth-through hole are corresponding to the first-through hole, the second-through hole and the third-through hole of the first-base body respectively.

In an embodiment of the present invention, the two second-feed-in components are through the seventh-through hole and the eighth-through hole respectively, and are electrically connected to the second-radiation-metal layer, and then are through the second-through hole and the third-through hole respectively to be extended outside the bottom surface of the first-base body, and neither of the two second-feed-in components is electrically connected to the grounded-metal layer.

In an embodiment of the present invention, the third-base body is configured to set up (namely, define) a ninth-through hole. The ninth-through hole is through the third-base body and the third-radiation-metal layer. The ninth-through hole is corresponding to the sixth-through hole of the second-base body and the first-through hole of the first-base body.

In an embodiment of the present invention, the third-feed-in component is through the ninth-through hole of the third-base body, the sixth-through hole of the second-base body and the first-through hole of the first-base body to be outside the bottom surface of the first-base body. The third-feed-in component is electrically connected to the third-radiation-metal layer when the third-feed-in component is through the ninth-through hole. The third-feed-in component is not electrically connected to the grounded-metal layer when the third-feed-in component is through the bottom surface of the first-base body to be outside the bottom surface of the first-base body.

In an embodiment of the present invention, the third-feed-in component is in a T shape. The third-feed-in component comprises a head and a shaft. The head is extended to the shaft.

In an embodiment of the present invention, an area of the second-base body is smaller than an area of the first-radiation-metal layer. The first-radiation-metal layer is exposed when the second-base body is arranged on the surface of the first-radiation-metal layer.

In an embodiment of the present invention, an area of the third-base body is smaller than an area of the second-radiation-metal layer. The second-radiation-metal layer is exposed when the third-base body is arranged on the surface of the second-radiation-metal layer.

In an embodiment of the present invention, the first-base body, the second-base body and the third-base body are flat plate-type bodies or block-shaped bodies made of ceramic dielectric materials.

Therefore, an object of the present invention is to solve the problems mentioned above. The present invention provides a four-feed-in-and-three-stack antenna structure that three antennas are stacked together to receive various wireless communication system signals. The four-feed-in-and-three-stack antenna structure can be integrated with the electronic equipment easily, so that the integration design is easier and the area of the circuit board does not become larger.

In order to achieve the object mentioned above, the present invention provides the four-feed-in-and-three-stack antenna structure comprising a first antenna, a second antenna and a third antenna. The first antenna comprises a first-base body, a first-radiation-metal layer, a grounded-metal layer and a first-feed-in component. The first-radiation-metal layer is arranged on a surface of the first-base body. The grounded-metal layer is arranged on a bottom surface of the first-base body. The first-feed-in component is through the first-base body. The first-feed-in component is electrically connected to the first-radiation-metal layer through the first-base body. The first-feed-in component is through the bottom surface of the first-base body, and the first-feed-in component is not electrically connected to the grounded-metal layer (namely, the first-feed-in component fails to electrically connect to the grounded-metal layer). The second antenna comprises a second-base body, a second-radiation-metal layer and two second-feed-in components. The second-base body is arranged on a surface of the first-radiation-metal layer on the first-base body. The second-radiation-metal layer is arranged on a surface of the second-base body. The two second-feed-in components are through the second-base body and the first-base body, and are electrically connected to the second-radiation-metal layer. The two second-feed-in components are configured to break through the bottom surface of the first-base body to be outside the bottom surface of the first-base body, and neither of the two second-feed-in components is electrically connected to the grounded-metal layer (namely, the two second-feed-in components fail to electrically connect to the grounded-metal layer). The third antenna comprises a third-base body, a third-radiation-metal layer and a third-feed-in component. The third-base body is arranged on a surface of the second-radiation-metal layer on the second-base body. The third-radiation-metal layer is arranged on a surface of the third-base body. The third-feed-in component is through the third-base body, the second-base body and the first-base body after the third-feed-in component is electrically connected to the third-radiation-metal layer. The third-feed-in component is configured to break through the bottom surface of the first-base body to be outside the bottom surface of the first-base body and is not electrically connected to the grounded-metal layer (namely, the third-feed-in component fails to electrically connect to the grounded-metal layer).

In an embodiment of the present invention, the first-base body is configured to set up (namely, define) a first-through hole, a second-through hole, a third-through hole and a fourth-through hole. The first-through hole, the second-through hole, the third-through hole and the fourth-through hole are through the first-base body, the first-radiation-metal layer and the grounded-metal layer.

In an embodiment of the present invention, the first feed-in component is configured to break through the first-base body through the first-through hole.

In an embodiment of the present invention, the second-base body is configured to set up (namely, define) a fifth-through hole, a sixth-through hole and a seventh-through hole. The fifth-through hole, the sixth-through hole and the seventh-through hole are through the second-base body and the second-radiation-metal layer. The fifth-through hole, the sixth-through hole and the seventh-through hole are corresponding to the second-through hole, the third-through hole and the fourth-through hole of the first-base body respectively.

In an embodiment of the present invention, the two second-feed-in components are through the fifth-through hole and the seventh-through hole respectively, and are electrically connected to the second-radiation-metal layer, and then are through the second-through hole and the fourth-through hole respectively to be extended outside the bottom surface of the first-base body, and neither of the two second-feed-in components is electrically connected to the grounded-metal layer.

In an embodiment of the present invention, the third-base body is configured to set up (namely, define) an eighth-through hole. The eighth-through hole is through the third-base body and the third-radiation-metal layer. The eighth-through hole is corresponding to the sixth-through hole of the second-base body and the third-through hole of the first-base body.

In an embodiment of the present invention, the third-feed-in component is through the eighth-through hole of the third-base body, the sixth-through hole of the second-base body and the third-through hole of the first-base body to be outside the bottom surface of the first-base body. The third-feed-in component is electrically connected to the third-radiation-metal layer when the third-feed-in component is through the eighth-through hole. The third-feed-in component is not electrically connected to the grounded-metal layer when the third-feed-in component is through the bottom surface of the first-base body to be outside the bottom surface of the first-base body.

In an embodiment of the present invention, the third-feed-in component is in a T shape. The third-feed-in component comprises a head and a shaft. The head is extended to the shaft.

In an embodiment of the present invention, an area of the second-base body is smaller than an area of the first-radiation-metal layer. The first-radiation-metal layer is exposed when the second-base body is arranged on the surface of the first-radiation-metal layer.

In an embodiment of the present invention, an area of the third-base body is smaller than an area of the second-radiation-metal layer. The second-radiation-metal layer is exposed when the third-base body is arranged on the surface of the second-radiation-metal layer.

In an embodiment of the present invention, the first-base body, the second-base body and the third-base body are flat plate-type bodies or block-shaped bodies made of ceramic dielectric materials.

Therefore, an object of the present invention is to solve the problems mentioned above. The present invention provides a three-feed-in-and-three-stack antenna structure that three antennas are stacked together to receive various wireless communication system signals. The three-feed-in-and-three-stack antenna structure can be integrated with the electronic equipment easily, so that the integration design is easier and the area of the circuit board does not become larger.

In order to achieve the object mentioned above, the present invention provides the three-feed-in-and-three-stack antenna structure comprising a first antenna, a second antenna and a third antenna. The first antenna comprises a first-base body, a first-radiation-metal layer, a grounded-metal layer and a first-feed-in component. The first-radiation-metal layer is arranged on a surface of the first-base body. The grounded-metal layer is arranged on a bottom surface of the first-base body. The first-feed-in component is through the first-base body. The first-feed-in component is electrically connected to the first-radiation-metal layer through the first-base body. The first-feed-in component is through the bottom surface of the first-base body and is not electrically connected to the grounded-metal layer. The second antenna comprises a second-base body, a second-radiation-metal layer and a second-feed-in component. The second-base body is arranged on a surface of the first-radiation-metal layer on the first-base body. The second-radiation-metal layer is arranged on a surface of the second-base body. The second-feed-in component is through the second-base body and the first-base body, and is electrically connected to the second-radiation-metal layer. The second-feed-in component is configured to break through the bottom surface of the first-base body to be outside the bottom surface of the first-base body and is not electrically connected to the grounded-metal layer. The third antenna comprises a third-base body, a third-radiation-metal layer and a third-feed-in component. The third-base body is arranged on a surface of the second-radiation-metal layer on the second-base body. The third-radiation-metal layer is arranged on a surface of the third-base body. The third-feed-in component is through the third-base body, the second-base body and the first-base body after the third-feed-in component is electrically connected to the third-radiation-metal layer. The third-feed-in component is configured to break through the bottom surface of the first-base body to be outside the bottom surface of the first-base body and is not electrically connected to the grounded-metal layer.

In an embodiment of the present invention, the first-base body is configured to set up (namely, define) a first-through hole, a second-through hole and a third-through hole. The first-through hole, the second-through hole and the third-through hole are through the first-base body, the first-radiation-metal layer and the grounded-metal layer.

In an embodiment of the present invention, the first-feed-in component is configured to break through the first-base body through the second-through hole.

In an embodiment of the present invention, the second-base body is configured to set up (namely, define) a fourth-through hole and a fifth-through hole. The fourth-through hole and the fifth-through hole are through the second-base body and the second-radiation-metal layer. The fourth-through hole and the fifth-through hole are corresponding to the first-through hole and the third-through hole of the first-base body respectively.

In an embodiment of the present invention, the second-feed-in component is through the fifth-through hole, and is electrically connected to the second-radiation-metal layer, and then is through the third-through hole to be extended outside the bottom surface of the first-base body, and is not electrically connected to the grounded-metal layer.

In an embodiment of the present invention, the third-base body is configured to set up (namely, define) a sixth-through hole. The sixth-through hole is through the third-base body and the third-radiation-metal layer. The sixth-through hole is corresponding to the fourth-through hole of the second-base body and the first-through hole of the first-base body.

In an embodiment of the present invention, the third-feed-in component is through the sixth-through hole of the third-base body, the fourth-through hole of the second-base body and the first-through hole of the first-base body to be outside the bottom surface of the first-base body. The third-feed-in component is electrically connected to the third-radiation-metal layer when the third-feed-in component is through the sixth-through hole. The third-feed-in component is not electrically connected to the grounded-metal layer when the third-feed-in component is through the bottom surface of the first-base body to be outside the bottom surface of the first-base body.

In an embodiment of the present invention, the third-feed-in component is in a T shape. The third-feed-in component comprises a head and a shaft. The head is extended to the shaft.

In an embodiment of the present invention, an area of the second-base body is smaller than an area of the first-radiation-metal layer. The first-radiation-metal layer is exposed when the second-base body is arranged on the surface of the first-radiation-metal layer.

In an embodiment of the present invention, an area of the third-base body is smaller than an area of the second-radiation-metal layer. The second-radiation-metal layer is exposed when the third-base body is arranged on the surface of the second-radiation-metal layer.

In an embodiment of the present invention, the first-base body, the second-base body and the third-base body are flat plate-type bodies or block-shaped bodies made of ceramic dielectric materials.

Therefore, an object of the present invention is to solve the problems mentioned above. The present invention provides a four-hole-and-three-stack antenna structure that three antennas are stacked together to receive various wireless communication system signals. The four-hole-and-three-stack antenna structure can be integrated with the electronic equipment easily, so that the integration design is easier and the area of the circuit board does not become larger.

In order to achieve the object mentioned above, the present invention provides a four-hole-and-three-stack antenna structure comprising a first antenna, a second antenna and a third antenna. The first antenna comprises a first-base body, a first-radiation-metal layer and a grounded-metal layer. The first-radiation-metal layer is arranged on a surface of the first-base body. The grounded-metal layer is arranged on a bottom surface of the first-base body. The first-base body is configured to set up (namely, define) a first-through hole, a second-through hole, a third-through hole and a fourth-through hole. The first-through hole, the second-through hole, the third-through hole and the fourth-through hole are through the first-base body, the first-radiation-metal layer and the grounded-metal layer. The second antenna comprises a second-base body and a second-radiation-metal layer. The second-base body is arranged on a surface of the first-radiation-metal layer on the first-base body. The second-radiation-metal layer is arranged on a surface of the second-base body. The second-base body is configured to set up (namely, define) a fifth-through hole, a sixth-through hole and a seventh-through hole. The fifth-through hole, the sixth-through hole and the seventh-through hole are through the second-base body and the second-radiation-metal layer. The fifth-through hole, the sixth-through hole and the seventh-through hole are corresponding to the second-through hole, the third-through hole and the fourth-through hole of the first-base body respectively. The third antenna comprises a third-base body, a third-radiation-metal layer and a first-feed-in component. The third-base body is arranged on a surface of the second-radiation-metal layer on the second-base body. The third-radiation-metal layer is arranged on a surface of the third-base body. The third-base body is configured to set up (namely, define) an eighth-through hole. The eighth-through hole is through the third-base body and the third-radiation-metal layer. The eighth-through hole is corresponding to the sixth-through hole of the second-base body and the third-through hole of the first-base body. The first-feed-in component is through the eighth-through hole of the third-base body, the sixth-through hole of the second-base body and the third-through hole of the first-base body to be outside the bottom surface of the first-base body. Moreover, the first-feed-in component is electrically connected to the third-radiation-metal layer when the first-feed-in component is through the eighth-through hole. The first-feed-in component is coupled to and connected to the second-radiation-metal layer when the first-feed-in component is through the second-base body. The first-feed-in component is coupled to and connected to the first-radiation-metal layer on the first-base body when the first-feed-in component is through the third-through hole. The first-feed-in component is not electrically connected to the grounded-metal layer (namely, the first-feed-in component fails to electrically connect to the grounded-metal layer) when the first-feed-in component is through the bottom surface of the first-base body to be outside the bottom surface of the first-base body. The four-hole-and-three-stack antenna structure with a single feed-in is formed.

In order to achieve the object mentioned above, the present invention provides another four-hole-and-three-stack antenna structure comprising a first antenna, a second antenna and a third antenna. The first antenna comprises a first-base body, a first-radiation-metal layer and a grounded-metal layer. The first-radiation-metal layer is arranged on a surface of the first-base body. The grounded-metal layer is arranged on a bottom surface of the first-base body. The first-base body is configured to set up (namely, define) a first-through hole, a second-through hole, a third-through hole and a fourth-through hole. The first-through hole, the second-through hole, the third-through hole and the fourth-through hole are through the first-base body, the first-radiation-metal layer and the grounded-metal layer. The second antenna comprises a second-base body, a second-radiation-metal layer and a second-feed-in component. The second-base body is arranged on a surface of the first-radiation-metal layer on the first-base body. The second-radiation-metal layer is arranged on a surface of the second-base body. The second-base body is configured to set up (namely, define) a fifth-through hole, a sixth-through hole and a seventh-through hole. The fifth-through hole, the sixth-through hole and the seventh-through hole are through the second-base body and the second-radiation-metal layer. The fifth-through hole, the sixth-through hole and the seventh-through hole are corresponding to the second-through hole, the third-through hole and the fourth-through hole of the first-base body respectively. The second-feed-in component is through the fifth-through hole and is electrically connected to the second-radiation-metal layer, and then is through the second-through hole of the first-base body. The third antenna comprises a third-base body, a third-radiation-metal layer and a first-feed-in component. The third-base body is arranged on a surface of the second-radiation-metal layer on the second-base body. The third-radiation-metal layer is arranged on a surface of the third-base body. The third-base body is configured to set up (namely, define) an eighth-through hole. The eighth-through hole is through the third-base body and the third-radiation-metal layer. The eighth-through hole is corresponding to the sixth-through hole of the second-base body and the third-through hole of the first-base body. The first-feed-in component is through the eighth-through hole of the third-base body, the sixth-through hole of the second-base body and the third-through hole of the first-base body to be outside the bottom surface of the first-base body. Moreover, the second-feed-in component is through the fifth-through hole of the second-base body and electrically connected to the second-radiation-metal layer, and then is through the second-through hole of the first-base body and coupled to and connected to the first-radiation-metal layer. The first-feed-in component is electrically connected to the third-radiation-metal layer when the first-feed-in component is through the eighth-through hole. The first-feed-in component is coupled to and connected to the second-radiation-metal layer when the first-feed-in component is through the second-base body. The first-feed-in component is coupled to and connected to the first-radiation-metal layer on the first-base body when the first-feed-in component is through the third-through hole. Neither the second-feed-in component nor the first-feed-in component is electrically connected to the grounded-metal layer (namely, the second-feed-in component and the first-feed-in component fail to electrically connect to the grounded-metal layer) when the second-feed-in component and the first-feed-in component are through the bottom surface of the first-base body to be outside the bottom surface of the first-base body. The four-hole-and-three-stack antenna structure with two feed-ins is formed.

In order to achieve the object mentioned above, the present invention provides another four-hole-and-three-stack antenna structure comprising a first antenna, a second antenna and a third antenna. The first antenna comprises a first-base body, a first-radiation-metal layer, a grounded-metal layer and a third-feed-in component. The first-radiation-metal layer is arranged on a surface of the first-base body. The grounded-metal layer is arranged on a bottom surface of the first-base body. The first-base body is configured to set up (namely, define) a first-through hole, a second-through hole, a third-through hole and a fourth-through hole. The first-through hole, the second-through hole, the third-through hole and the fourth-through hole are through the first-base body, the first-radiation-metal layer and the grounded-metal layer. The third-feed-in component is through the fourth-through hole and is electrically connected to the first-radiation-metal layer. The second antenna comprises a second-base body, a second-radiation-metal layer and a second-feed-in component. The second-base body is arranged on a surface of the first-radiation-metal layer on the first-base body. The second-radiation-metal layer is arranged on a surface of the second-base body. The second-base body is configured to set up (namely, define) a fifth-through hole, a sixth-through hole and a seventh-through hole. The fifth-through hole, the sixth-through hole and the seventh-through hole are through the second-base body and the second-radiation-metal layer. The fifth-through hole, the sixth-through hole and the seventh-through hole are corresponding to the second-through hole, the third-through hole and the fourth-through hole of the first-base body respectively. The second-feed-in component is through the fifth-through hole and is electrically connected to the second-radiation-metal layer, and then is through the second-through hole of the first-base body. The third antenna comprises a third-base body, a third-radiation-metal layer and a first-feed-in component. The third-base body is arranged on a surface of the second-radiation-metal layer on the second-base body. The third-radiation-metal layer is arranged on a surface of the third-base body. The third-base body is configured to set up (namely, define) an eighth-through hole. The eighth-through hole is through the third-base body and the third-radiation-metal layer. The eighth-through hole is corresponding to the sixth-through hole of the second-base body and the third-through hole of the first-base body. The first-feed-in component is through the eighth-through hole of the third-base body, the sixth-through hole of the second-base body and the third-through hole of the first-base body to be outside the bottom surface of the first-base body. Moreover, the third-feed-in component is through the fourth-through hole of the first-base body and electrically connected to the first-radiation-metal layer. The second-feed-in component is through the fifth-through hole of the second-base body and electrically connected to the second-radiation-metal layer, and then is through the second-through hole of the first-base body and coupled to and connected to the first-radiation-metal layer. The first-feed-in component is electrically connected to the third-radiation-metal layer when the first-feed-in component is through the eighth-through hole. The first-feed-in component is coupled to and connected to the second-radiation-metal layer when the first-feed-in component is through the second-base body. The first-feed-in component is coupled to and connected to the first-radiation-metal layer on the first-base body when the first-feed-in component is through the third-through hole. None of the third-feed-in component, the second-feed-in component or the first-feed-in component is electrically connected to the grounded-metal layer (namely, the third-feed-in component, the second-feed-in component and the first-feed-in component fail to electrically connect to the grounded-metal layer) when the third-feed-in component, the second-feed-in component and the first-feed-in component are through the bottom surface of the first-base body to be outside the bottom surface of the first-base body. The four-hole-and-three-stack antenna structure with three feed-ins is formed.

In order to achieve the object mentioned above, the present invention provides another four-hole-and-three-stack antenna structure comprising a first antenna, a second antenna and a third antenna. The first antenna comprises a first-base body, a first-radiation-metal layer, a grounded-metal layer and two third-feed-in components. The first-radiation-metal layer is arranged on a surface of the first-base body. The grounded-metal layer is arranged on a bottom surface of the first-base body. The first-base body is configured to set up (namely, define) a first-through hole, a second-through hole, a third-through hole and a fourth-through hole. The first-through hole, the second-through hole, the third-through hole and the fourth-through hole are through the first-base body, the first-radiation-metal layer and the grounded-metal layer. The two third-feed-in components are through the fourth-through hole and the first-through hole respectively, and are electrically connected to the first-radiation-metal layer. The second antenna comprises a second-base body, a second-radiation-metal layer and a second-feed-in component. The second-base body is arranged on a surface of the first-radiation-metal layer on the first-base body. The second-radiation-metal layer is arranged on a surface of the second-base body. The second-base body is configured to set up (namely, define) a fifth-through hole, a sixth-through hole and a seventh-through hole. The fifth-through hole, the sixth-through hole and the seventh-through hole are through the second-base body and the second-radiation-metal layer. The fifth-through hole, the sixth-through hole and the seventh-through hole are corresponding to the second-through hole, the third-through hole and the fourth-through hole of the first-base body respectively. The second-feed-in component is through the fifth-through hole and is electrically connected to the second-radiation-metal layer, and then is through the second-through hole of the first-base body. The third antenna comprises a third-base body, a third-radiation-metal layer and a first-feed-in component. The third-base body is arranged on a surface of the second-radiation-metal layer on the second-base body. The third-radiation-metal layer is arranged on a surface of the third-base body. The third-base body is configured to set up (namely, define) an eighth-through hole. The eighth-through hole is through the third-base body and the third-radiation-metal layer. The eighth-through hole is corresponding to the sixth-through hole of the second-base body and the third-through hole of the first-base body. The first-feed-in component is through the eighth-through hole of the third-base body, the sixth-through hole of the second-base body and the third-through hole of the first-base body to be outside the bottom surface of the first-base body. Moreover, the two third-feed-in components are through the fourth-through hole and the first-through hole of the first-base body respectively, and are electrically connected to the first-radiation-metal layer. The second-feed-in component is through the fifth-through hole of the second-base body and electrically connected to the second-radiation-metal layer, and then is through the second-through hole of the first-base body and coupled to and connected to the first-radiation-metal layer. The first-feed-in component is electrically connected to the third-radiation-metal layer when the first-feed-in component is through the eighth-through hole. The first-feed-in component is coupled to and connected to the second-radiation-metal layer when the first-feed-in component is through the second-base body. The first-feed-in component is coupled to and connected to the first-radiation-metal layer on the first-base body when the first-feed-in component is through the third-through hole. None of the two third-feed-in components, the second-feed-in component or the first-feed-in component is electrically connected to the grounded-metal layer (namely, the two third-feed-in components, the second-feed-in component and the first-feed-in component fail to electrically connect to the grounded-metal layer) when the two third-feed-in components, the second-feed-in component and the first-feed-in component are through the bottom surface of the first-base body to be outside the bottom surface of the first-base body. The four-hole-and-three-stack antenna structure with four feed-ins is formed.

In an embodiment of the present invention, the first-feed-in component is in a T shape. The first-feed-in component comprises a head and a shaft. The head is extended to the shaft.

In an embodiment of the present invention, an area of the second-base body is smaller than an area of the first-radiation-metal layer. The first-radiation-metal layer is exposed when the second-base body is arranged on the surface of the first-radiation-metal layer.

In an embodiment of the present invention, an area of the third-base body is smaller than an area of the second-radiation-metal layer. The second-radiation-metal layer is exposed when the third-base body is arranged on the surface of the second-radiation-metal layer.

In an embodiment of the present invention, the first-base body, the second-base body and the third-base body are flat plate-type bodies or block-shaped bodies made of ceramic dielectric materials.

Therefore, an object of the present invention is to solve the problems mentioned above. The present invention provides a five-hole-and-three-stack antenna structure that three antennas are stacked together to receive various wireless communication system signals. The five-hole-and-three-stack antenna structure can be integrated with the electronic equipment easily, so that the integration design is easier and the area of the circuit board does not become larger.

In order to achieve the object mentioned above, the present invention provides a five-hole-and-three-stack antenna structure comprising a first antenna, a second antenna and a third antenna. The first antenna comprises a first-base body, a first-radiation-metal layer and a grounded-metal layer. The first-radiation-metal layer is arranged on a surface of the first-base body. The grounded-metal layer is arranged on a bottom surface of the first-base body. The first-base body is configured to set up (namely, define) a first-through hole, a second-through hole, a third-through hole, a fourth-through hole and a fifth-through hole. The first-through hole, the second-through hole, the third-through hole, the fourth-through hole and the fifth-through hole are through the first-base body, the first-radiation-metal layer and the grounded-metal layer. The second antenna comprises a second-base body and a second-radiation-metal layer. The second-base body is arranged on a surface of the first-radiation-metal layer on the first-base body. The second-radiation-metal layer is arranged on a surface of the second-base body. The second-base body is configured to set up (namely, define) a sixth-through hole, a seventh-through hole and an eighth-through hole. The sixth-through hole, the seventh-through hole and the eighth-through hole are through the second-base body and the second-radiation-metal layer. The sixth-through hole, the seventh-through hole and the eighth-through hole are corresponding to the first-through hole, the second-through hole and the third-through hole of the first-base body respectively. The third antenna comprises a third-base body, a third-radiation-metal layer and a first-feed-in component. The third-base body is arranged on a surface of the second-radiation-metal layer on the second-base body. The third-radiation-metal layer is arranged on a surface of the third-base body. The third-base body is configured to set up (namely, define) a ninth-through hole. The ninth-through hole is through the third-base body and the third-radiation-metal layer. The ninth-through hole is corresponding to the eighth-through hole of the second-base body and the third-through hole of the first-base body. The first-feed-in component is through the ninth-through hole of the third-base body, the eighth-through hole of the second-base body and the third-through hole of the first-base body to be outside the bottom surface of the first-base body. Moreover, the first-feed-in component is electrically connected to the third-radiation-metal layer when the first-feed-in component is through the ninth-through hole. The first-feed-in component is coupled to and connected to the second-radiation-metal layer when the first-feed-in component is through the eighth-through hole of the second-base body. The first-feed-in component is coupled to and connected to the first-radiation-metal layer on the first-base body when the first-feed-in component is through the third-through hole. The first-feed-in component is not electrically connected to the grounded-metal layer (namely, the first-feed-in component fails to electrically connect to the grounded-metal layer) when the first-feed-in component is through the bottom surface of the first-base body to be outside the bottom surface of the first-base body. The five-hole-and-three-stack antenna structure with a single feed-in is formed.

In order to achieve the object mentioned above, the present invention provides another five-hole-and-three-stack antenna structure comprising a first antenna, a second antenna and a third antenna. The first antenna comprises a first-base body, a first-radiation-metal layer and a grounded-metal layer. The first-radiation-metal layer is arranged on a surface of the first-base body. The grounded-metal layer is arranged on a bottom surface of the first-base body. The first-base body is configured to set up (namely, define) a first-through hole, a second-through hole, a third-through hole, a fourth-through hole and a fifth-through hole. The first-through hole, the second-through hole, the third-through hole, the fourth-through hole and the fifth-through hole are through the first-base body, the first-radiation-metal layer and the grounded-metal layer. The second antenna comprises a second-base body, a second-radiation-metal layer and a second-feed-in component. The second-base body is arranged on a surface of the first-radiation-metal layer on the first-base body. The second-radiation-metal layer is arranged on a surface of the second-base body. The second-base body is configured to set up (namely, define) a sixth-through hole, a seventh-through hole and an eighth-through hole. The sixth-through hole, the seventh-through hole and the eighth-through hole are through the second-base body and the second-radiation-metal layer. The sixth-through hole, the seventh-through hole and the eighth-through hole are corresponding to the first-through hole, the second-through hole and the third-through hole of the first-base body respectively. The second-feed-in component is through the seventh-through hole and is electrically connected to the second-radiation-metal layer, and then is through the second-through hole of the first-base body. The third antenna comprises a third-base body, a third-radiation-metal layer and a first-feed-in component. The third-base body is arranged on a surface of the second-radiation-metal layer on the second-base body. The third-radiation-metal layer is arranged on a surface of the third-base body. The third-base body is configured to set up (namely, define) a ninth-through hole. The ninth-through hole is through the third-base body and the third-radiation-metal layer. The ninth-through hole is corresponding to the eighth-through hole of the second-base body and the third-through hole of the first-base body. The first-feed-in component is through the ninth-through hole of the third-base body, the eighth-through hole of the second-base body and the third-through hole of the first-base body to be outside the bottom surface of the first-base body. Moreover, the second-feed-in component is through the seventh-through hole of the second-base body and is electrically connected to the second-radiation-metal layer, and then is through the second-through hole of the first-base body and is coupled to and connected to the first-radiation-metal layer. The first-feed-in component is electrically connected to the third-radiation-metal layer when the first-feed-in component is through the ninth-through hole. The first-feed-in component is coupled to and connected to the second-radiation-metal layer when the first-feed-in component is through the second-base body. The first-feed-in component is coupled to and connected to the first-radiation-metal layer on the first-base body when the first-feed-in component is through the third-through hole. Neither the second-feed-in component nor the first-feed-in component is electrically connected to the grounded-metal layer (namely, the second-feed-in component and the first-feed-in component fail to electrically connect to the grounded-metal layer) when the second-feed-in component and the first-feed-in component are through the bottom surface of the first-base body to be outside the bottom surface of the first-base body. The five-hole-and-three-stack antenna structure with two feed-ins is formed.

In order to achieve the object mentioned above, the present invention provides another five-hole-and-three-stack antenna structure comprising a first antenna, a second antenna and a third antenna. The first antenna comprises a first-base body, a first-radiation-metal layer and a grounded-metal layer. The first-radiation-metal layer is arranged on a surface of the first-base body. The grounded-metal layer is arranged on a bottom surface of the first-base body. The first-base body is configured to set up (namely, define) a first-through hole, a second-through hole, a third-through hole, a fourth-through hole and a fifth-through hole. The first-through hole, the second-through hole, the third-through hole, the fourth-through hole and the fifth-through hole are through the first-base body, the first-radiation-metal layer and the grounded-metal layer. The second antenna comprises a second-base body, a second-radiation-metal layer and two second-feed-in components. The second-base body is arranged on a surface of the first-radiation-metal layer on the first-base body. The second-radiation-metal layer is arranged on a surface of the second-base body. The second-base body is configured to set up (namely, define) a sixth-through hole, a seventh-through hole and an eighth-through hole. The sixth-through hole, the seventh-through hole and the eighth-through hole are through the second-base body and the second-radiation-metal layer. The sixth-through hole, the seventh-through hole and the eighth-through hole are corresponding to the first-through hole, the second-through hole and the third-through hole of the first-base body respectively. The two second-feed-in components are through the seventh-through hole and the sixth-through hole respectively, and are electrically connected to the second-radiation-metal layer. The third antenna comprises a third-base body, a third-radiation-metal layer and a first-feed-in component. The third-base body is arranged on a surface of the second-radiation-metal layer on the second-base body. The third-radiation-metal layer is arranged on a surface of the third-base body. The third-base body is configured to set up (namely, define) a ninth-through hole. The ninth-through hole is through the third-base body and the third-radiation-metal layer. The ninth-through hole is corresponding to the eighth-through hole of the second-base body and the third-through hole of the first-base body. The first-feed-in component is through the ninth-through hole of the third-base body, the eighth-through hole of the second-base body and the third-through hole of the first-base body to be outside the bottom surface of the first-base body. Moreover, the two second-feed-in components are through the seventh-through hole and the sixth-through hole of the second-base body respectively, and are electrically connected to the second-radiation-metal layer, and then are through the second-through hole and the first-through hole of the first-base body and are coupled to and connected to the first-radiation-metal layer. The first-feed-in component is electrically connected to the third-radiation-metal layer when the first-feed-in component is through the ninth-through hole. The first-feed-in component is coupled to and connected to the second-radiation-metal layer when the first-feed-in component is through the second-base body. The first-feed-in component is coupled to and connected to the first-radiation-metal layer on the first-base body when the first-feed-in component is through the third-through hole. None of the two second-feed-in components or the first-feed-in component is electrically connected to the grounded-metal layer (namely, the two second-feed-in components and the first-feed-in component fail to electrically connect to the grounded-metal layer) when the two second-feed-in components and the first-feed-in component are through the bottom surface of the first-base body to be outside the bottom surface of the first-base body. The five-hole-and-three-stack antenna structure with three feed-ins is formed.

In order to achieve the object mentioned above, the present invention provides another five-hole-and-three-stack antenna structure comprising a first antenna, a second antenna and a third antenna. The first antenna comprises a first-base body, a first-radiation-metal layer, a grounded-metal layer and a third-feed-in component. The first-radiation-metal layer is arranged on a surface of the first-base body. The grounded-metal layer is arranged on a bottom surface of the first-base body. The first-base body is configured to set up (namely, define) a first-through hole, a second-through hole, a third-through hole, a fourth-through hole and a fifth-through hole. The first-through hole, the second-through hole, the third-through hole, the fourth-through hole and the fifth-through hole are through the first-base body, the first-radiation-metal layer and the grounded-metal layer. The third-feed-in component is through the fifth-through hole and is electrically connected to the first-radiation-metal layer. The second antenna comprises a second-base body, a second-radiation-metal layer and two second-feed-in components. The second-base body is arranged on a surface of the first-radiation-metal layer on the first-base body. The second-radiation-metal layer is arranged on a surface of the second-base body. The second-base body is configured to set up (namely, define) a sixth-through hole, a seventh-through hole and an eighth-through hole. The sixth-through hole, the seventh-through hole and the eighth-through hole are through the second-base body and the second-radiation-metal layer. The sixth-through hole, the seventh-through hole and the eighth-through hole are corresponding to the first-through hole, the second-through hole and the third-through hole of the first-base body respectively. The two second-feed-in components are through the seventh-through hole and the sixth-through hole respectively, and are electrically connected to the second-radiation-metal layer. The third antenna comprises a third-base body, a third-radiation-metal layer and a first-feed-in component. The third-base body is arranged on a surface of the second-radiation-metal layer on the second-base body. The third-radiation-metal layer is arranged on a surface of the third-base body. The third-base body is configured to set up (namely, define) a ninth-through hole. The ninth-through hole is through the third-base body and the third-radiation-metal layer. The ninth-through hole is corresponding to the eighth-through hole of the second-base body and the third-through hole of the first-base body. The first-feed-in component is through the ninth-through hole of the third-base body, the eighth-through hole of the second-base body and the third-through hole of the first-base body to be outside the bottom surface of the first-base body. Moreover, the third-feed-in component is through the fifth-through hole of the first-base body and is electrically connected to the first-radiation-metal layer. The two second-feed-in components are through the seventh-through hole and the sixth-through hole of the second-base body, and are electrically connected to the second-radiation-metal layer, and then are through the second-through hole and the first-through hole of the first-base body and are coupled to and connected to the first-radiation-metal layer. The first-feed-in component is electrically connected to the third-radiation-metal layer when the first-feed-in component is through the ninth-through hole. The first-feed-in component is coupled to and connected to the second-radiation-metal layer when the first-feed-in component is through the second-base body. The first-feed-in component is coupled to and connected to the first-radiation-metal layer on the first-base body when the first-feed-in component is through the third-through hole. None of the third-feed-in component, the two second-feed-in components or the first-feed-in component is electrically connected to the grounded-metal layer (namely, the third-feed-in component, the two second-feed-in components and the first-feed-in component fail to electrically connect to the grounded-metal layer) when the third-feed-in component, the two second-feed-in components and the first-feed-in component are through the bottom surface of the first-base body to be outside the bottom surface of the first-base body. The five-hole-and-three-stack antenna structure with four feed-ins is formed.

In order to achieve the object mentioned above, the present invention provides another five-hole-and-three-stack antenna structure comprising a first antenna, a second antenna and a third antenna. The first antenna comprises a first-base body, a first-radiation-metal layer, a grounded-metal layer and two third-feed-in components. The first-radiation-metal layer is arranged on a surface of the first-base body. The grounded-metal layer is arranged on a bottom surface of the first-base body. The first-base body is configured to set up (namely, define) a first-through hole, a second-through hole, a third-through hole, a fourth-through hole and a fifth-through hole. The first-through hole, the second-through hole, the third-through hole, the fourth-through hole and the fifth-through hole are through the first-base body, the first-radiation-metal layer and the grounded-metal layer. The two third-feed-in components are through the fifth-through hole and the fourth-through hole respectively, and are electrically connected to the first-radiation-metal layer. The second antenna comprises a second-base body, a second-radiation-metal layer and two second-feed-in components. The second-base body is arranged on a surface of the first-radiation-metal layer on the first-base body. The second-radiation-metal layer is arranged on a surface of the second-base body. The second-base body is configured to set up (namely, define) a sixth-through hole, a seventh-through hole and an eighth-through hole. The sixth-through hole, the seventh-through hole and the eighth-through hole are through the second-base body and the second-radiation-metal layer. The sixth-through hole, the seventh-through hole and the eighth-through hole are corresponding to the first-through hole, the second-through hole and the third-through hole of the first-base body respectively. The two second-feed-in components are through the seventh-through hole and the sixth-through hole respectively, and are electrically connected to the second-radiation-metal layer. The third antenna comprises a third-base body, a third-radiation-metal layer and a first-feed-in component. The third-base body is arranged on a surface of the second-radiation-metal layer on the second-base body. The third-radiation-metal layer is arranged on a surface of the third-base body. The third-base body is configured to set up (namely, define) a ninth-through hole. The ninth-through hole is through the third-base body and the third-radiation-metal layer. The ninth-through hole is corresponding to the eighth-through hole of the second-base body and the third-through hole of the first-base body. The first-feed-in component is through the ninth-through hole of the third-base body, the eighth-through hole of the second-base body and the third-through hole of the first-base body to be outside the bottom surface of the first-base body. Moreover, the two third-feed-in components are through the fifth-through hole and the fourth-through hole of the first-base body respectively, and are electrically connected to the first-radiation-metal layer. The two second-feed-in components are through the seventh-through hole and the sixth-through hole of the second-base body, and are electrically connected to the second-radiation-metal layer, and then are through the second-through hole and the first-through hole of the first-base body and are coupled to and connected to the first-radiation-metal layer. The first-feed-in component is electrically connected to the third-radiation-metal layer when the first-feed-in component is through the ninth-through hole. The first-feed-in component is coupled to and connected to the second-radiation-metal layer when the first-feed-in component is through the second-base body. The first-feed-in component is coupled to and connected to the first-radiation-metal layer on the first-base body when the first-feed-in component is through the third-through hole. None of the two third-feed-in components, the two second-feed-in components or the first-feed-in component is electrically connected to the grounded-metal layer (namely, the two third-feed-in components, the two second-feed-in components and the first-feed-in component fail to electrically connect to the grounded-metal layer) when the two third-feed-in components, the two second-feed-in components and the first-feed-in component are through the bottom surface of the first-base body to be outside the bottom surface of the first-base body. The five-hole-and-three-stack antenna structure with five feed-ins is formed.

In an embodiment of the present invention, the first-feed-in component is in a T shape. The first-feed-in component comprises a head and a shaft. The head is extended to the shaft.

In an embodiment of the present invention, an area of the second-base body is smaller than an area of the first-radiation-metal layer. The first-radiation-metal layer is exposed when the second-base body is arranged on the surface of the first-radiation-metal layer.

In an embodiment of the present invention, an area of the third-base body is smaller than an area of the second-radiation-metal layer. The second-radiation-metal layer is exposed when the third-base body is arranged on the surface of the second-radiation-metal layer.

In an embodiment of the present invention, the first-base body, the second-base body and the third-base body are flat plate-type bodies or block-shaped bodies made of ceramic dielectric materials.

Therefore, an object of the present invention is to solve the problems mentioned above. The present invention provides a feed-in-hole-insulation ceramic antenna structure which comprises three patch antennas which are stacked together. A conductive-layer group and a dielectric-layer group are arranged on feed-in paths of the feed-in-hole-insulation ceramic antenna structure, so that the feed-in paths achieve the 50-Ohm impedance characteristics as a coaxial cable. The feed-in-hole-insulation ceramic antenna structure is not mismatch, and the feed-in-hole-insulation ceramic antenna structure does not decrease the receiving efficiency.

In order to achieve the object mentioned above, the present invention provides a feed-in-hole-insulation ceramic antenna structure comprising a first antenna, a second antenna, a third antenna, a conductive-layer group and a dielectric-layer group. The first antenna comprises a first-base body, a first-radiation-metal layer, a grounded-metal layer and a first-feed-in component. The first-radiation-metal layer is arranged on a surface of the first-base body. The grounded-metal layer is arranged on a bottom surface of the first-base body. The first-base body is configured to set up (namely, define) a first-through hole, a second-through hole and a third-through hole. The first-through hole, the second-through hole and the third-through hole are through the first-base body, the first-radiation-metal layer and the grounded-metal layer. After the first-feed-in component is electrically connected to the first-radiation-metal layer, the first-feed-in component is through the third-through hole of the first-base body, and the first-feed-in component is not electrically connected to the grounded-metal layer (namely, the first-feed-in component fails to electrically connect to the grounded-metal layer) when the first-feed-in component is through the bottom surface of the first-base body. The second antenna comprises a second-base body, a second-radiation-metal layer and a second-feed-in component. The second-base body is arranged on a surface of the first-radiation-metal layer on the first-base body. The second-radiation-metal layer is arranged on a surface of the second-base body. The second-base body is configured to set up (namely, define) a fourth-through hole and a fifth-through hole. The fourth-through hole and the fifth-through hole are through the second-base body and the second-radiation-metal layer. The fourth-through hole and the fifth-through hole are corresponding to the first-through hole and the second-through hole of the first-base body. After the second-feed-in component is electrically connected to the second-radiation-metal layer, the second-feed-in component is through the fifth-through hole of the second-base body and the second-through hole of the first-base body. The second-feed-in component is not electrically connected to the grounded-metal layer (namely, the second-feed-in component fails to electrically connect to the grounded-metal layer) when the second-feed-in component is through the bottom surface of the first-base body to be outside the bottom surface of the first-base body. The third antenna comprises a third-base body, a third-radiation-metal layer and a third-feed-in component. The third-base body is arranged on a surface of the second-radiation-metal layer on the second-base body. The third-radiation-metal layer is arranged on a surface of the third-base body. The third-base body is configured to set up (namely, define) a sixth-through hole. The sixth-through hole is through the third-base body and the third-radiation-metal layer. The sixth-through hole is corresponding to the fourth-through hole of the second-base body and the first-through hole of the first-base body. After the third-feed-in component is electrically connected to the third-radiation-metal layer, the third-feed-in component is through the sixth-through hole of the third-base body, the fourth-through hole of the second-base body and the first-through hole of the first-base body. The third-feed-in component is not electrically connected to the grounded-metal layer (namely, the third-feed-in component fails to electrically connect to the grounded-metal layer) when the third-feed-in component is through the bottom surface of the first-base body to be outside the bottom surface of the first-base body. The conductive-layer group comprises a first-conductive layer, a second-conductive layer and a third-conductive layer. The first-conductive layer is arranged on a hole wall of the first-through hole of the first-base body and on a hole wall of the fourth-through hole of the second-base body. The first-conductive layer is electrically connected to the grounded-metal layer. The second-conductive layer is arranged on a hole wall of the second-through hole of the first-base body and is electrically connected to the grounded-metal layer. The third-conductive layer is arranged on a hole wall of the third-through hole of the first-base body and is electrically connected to the grounded-metal layer. The dielectric-layer group comprises a first-dielectric layer, a second-dielectric layer and a third-dielectric layer. The first-dielectric layer is arranged in the first-conductive layer. The first-dielectric layer is configured to define a first-punched hole. The third-feed-in component is through the first-punched hole. The second-dielectric layer is arranged in the second-conductive layer. The second-dielectric layer is configured to define a second-punched hole. The second-feed-in component is through the second-punched hole. The third-dielectric layer is arranged in the third-conductive layer. The third-dielectric layer is configured to define a third-punched hole. The first-feed-in component is through the third-punched hole. Moreover, the dielectric-layer group is arranged between the conductive-layer group and the first-feed-in component, the second-feed-in component and the third-feed-in component, to form to comprise characteristics of a coaxial cable.

In an embodiment of the present invention, the third-feed-in component is in a T shape. The third-feed-in component comprises a head and a shaft. The head is extended to the shaft.

In an embodiment of the present invention, an area of the second-base body is smaller than an area of the first-radiation-metal layer. The first-radiation-metal layer is exposed when the second-base body is arranged on the surface of the first-radiation-metal layer.

In an embodiment of the present invention, an area of the third-base body is smaller than an area of the second-radiation-metal layer. The second-radiation-metal layer is exposed when the third-base body is arranged on the surface of the second-radiation-metal layer.

In an embodiment of the present invention, the first-base body, the second-base body and the third-base body are flat plate-type bodies or block-shaped bodies made of ceramic dielectric materials.

In an embodiment of the present invention, the first-conductive layer, the second-conductive layer and the third-conductive layer are copper rings.

In an embodiment of the present invention, the first-dielectric layer, the second-dielectric layer and the third-dielectric layer are teflons.

In an embodiment of the present invention, an electronic apparatus includes: a circuit board, and a stack antenna electrically connected to a circuit board, the stack antenna including: a first antenna including a first base body and a first radiation metal layer arranged on a surface of the first base body; a second antenna including a second base body arranged on a surface of the first radiation metal layer on the first base body and a second radiation metal layer arranged on a surface of the second base body, wherein an area of the second base body is smaller than an area of the first radiation metal layer; and a third antenna including a third base body arranged on a surface of the second radiation metal layer on the second base body and a third radiation metal layer arranged on a surface of the third base body, wherein an area of the third base body is smaller than an area of the second radiation metal layer, wherein at least one of the first base body, the second base body, and the third-base body is configured to define at least one through hole to allow passage of a feed-in component; and wherein the through hole comprises a conductive layer disposed on a hole wall of the through hole and a dielectric layer disposed on top of the conductive layer.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1:
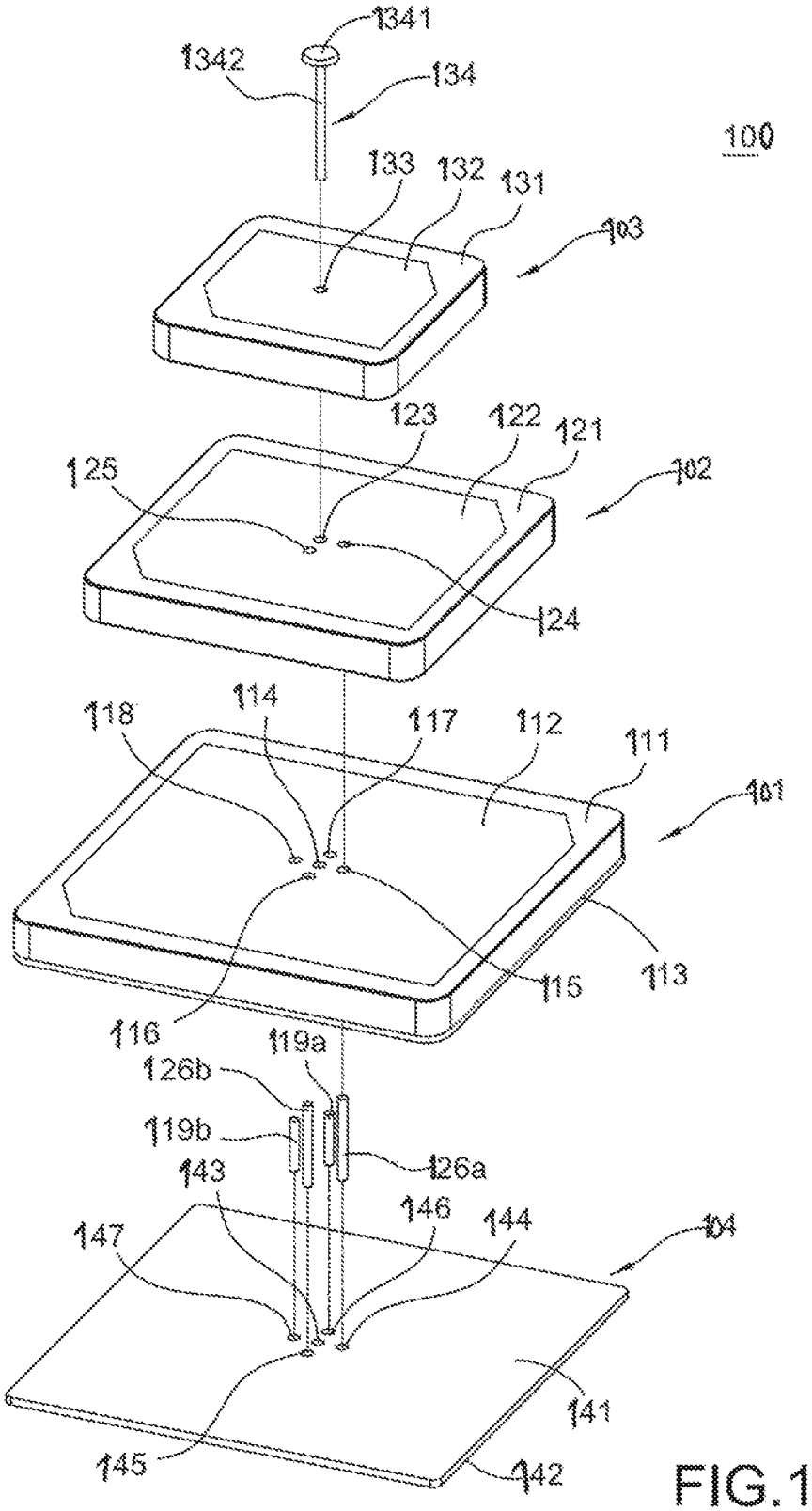
FIG. 1 shows an exploded view of the surface mount type three-stack antenna of the present invention.
Figure 2:
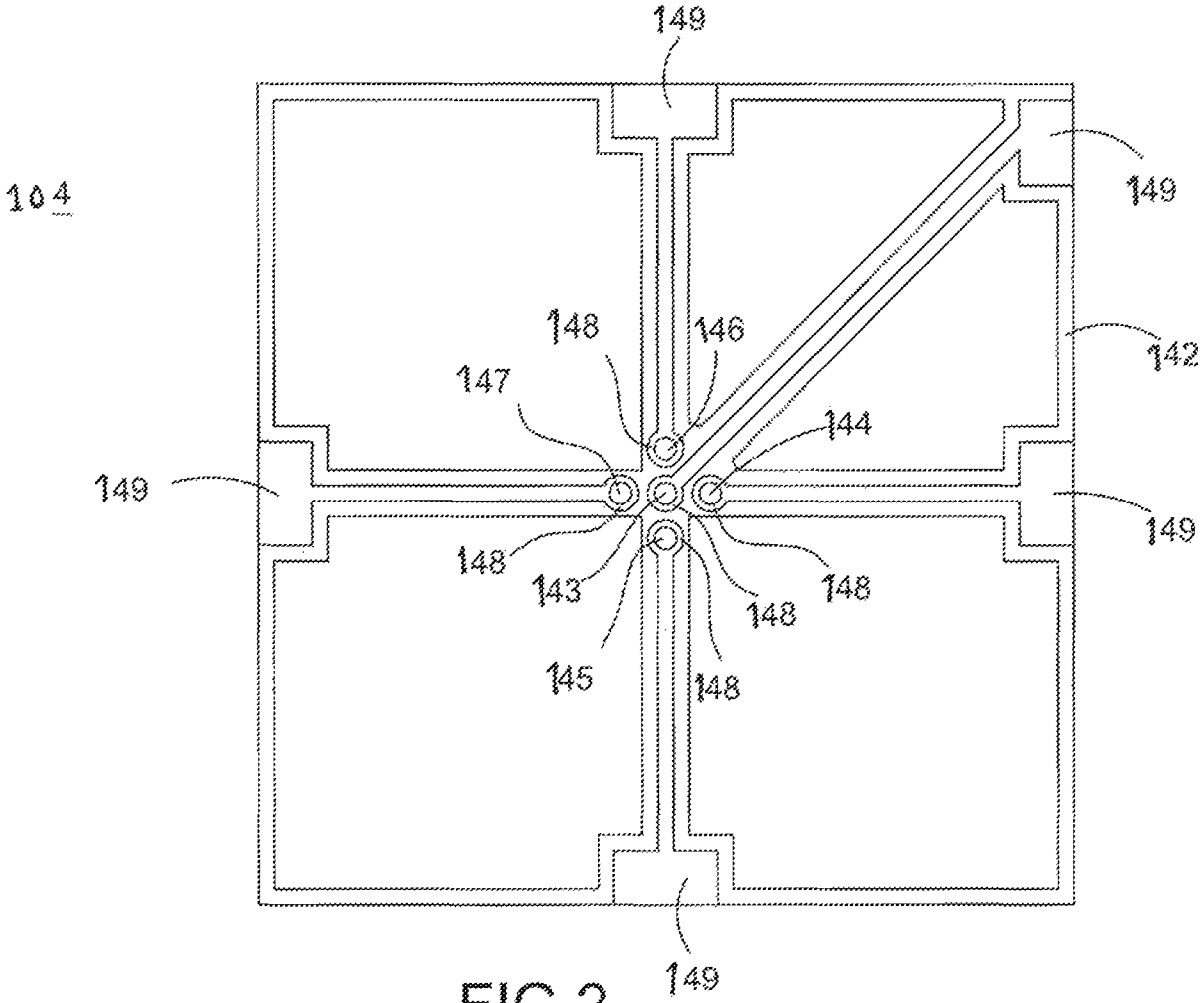
FIG. 2 shows the back side of the circuit board of the present invention.
Figure 3:
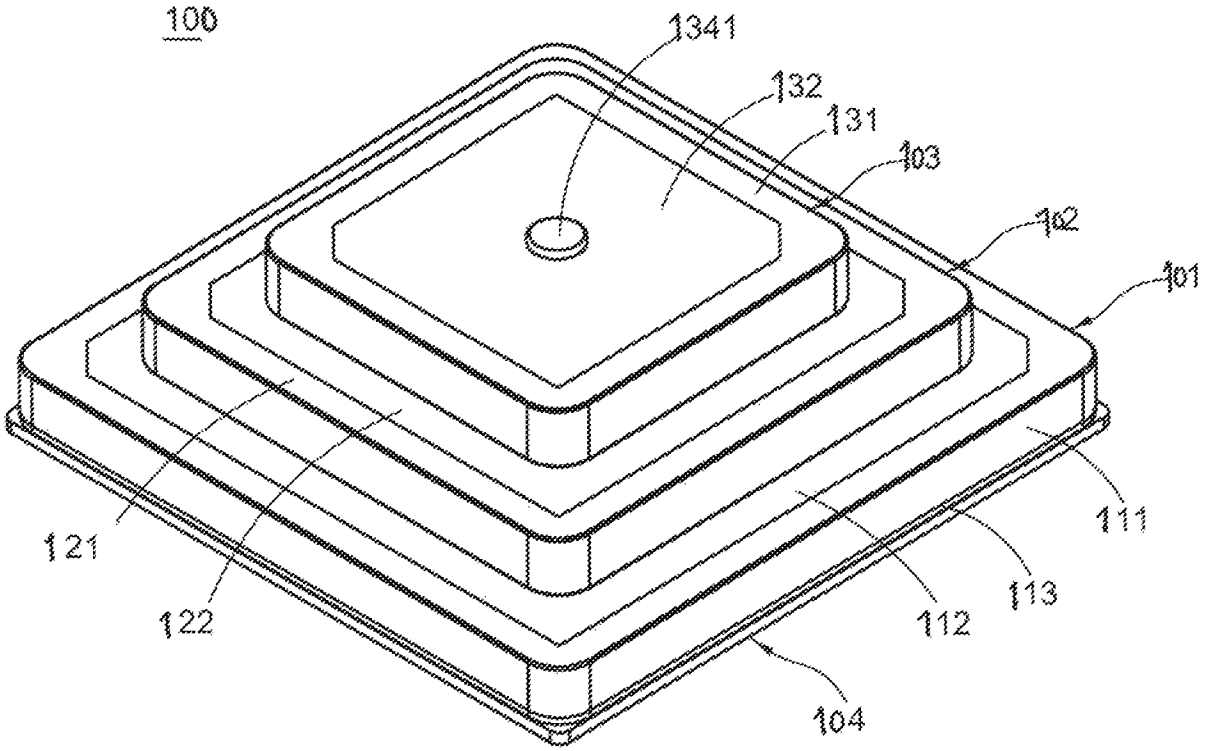
FIG. 3 shows an assembly drawing of the surface mount type three-stack antenna of the present invention.
Figure 4:
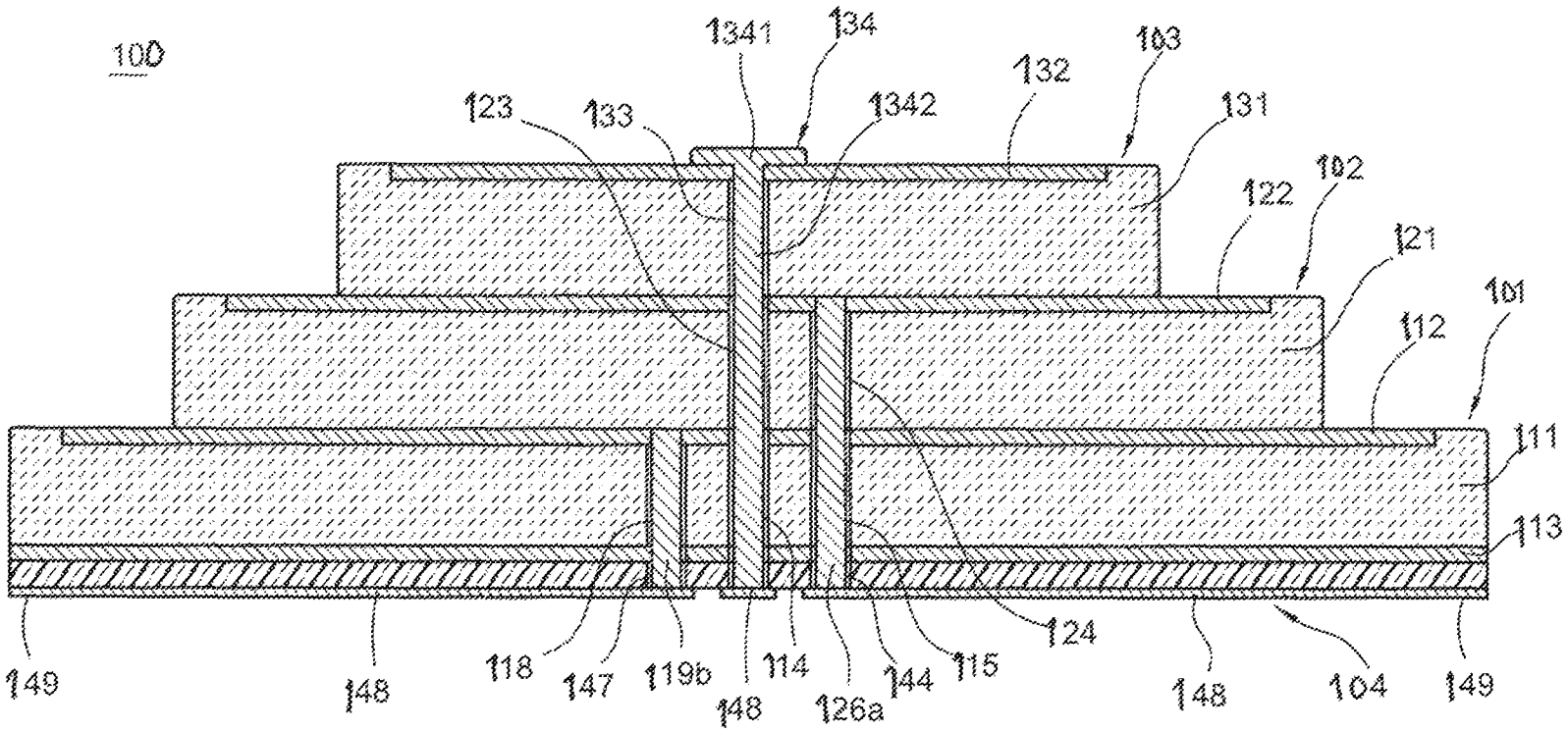
FIG. 4 shows a side-sectional view of the surface mount type three-stack antenna of the present invention.

FIG. 1 shows an exploded view of the surface mount type three-stack antenna of the present invention. FIG. 2 shows the back side of the circuit board of the present invention. FIG. 3 shows an assembly drawing of the surface mount type three-stack antenna of the present invention. FIG. 4 shows a side-sectional view of the surface mount type three-stack antenna of the present invention. As shown in FIGS. 1-4, a surface mount type three-stack antenna 100 of the present invention comprises a first antenna 101, a second antenna 102, a third antenna 103 and a circuit board 104. Moreover, the first antenna 101, the second antenna 102 and the third antenna 103 are stacked as the surface mount type three-stack antenna 100 which is nearly cone-shaped, and then the first antenna 101, the second antenna 102 and the third antenna 103 which are stacked are electrically and fixedly connected to the circuit board 104, to form the surface mount type three-stack antenna 100 which is able to be surface-mounted on a mainboard (not shown in FIGS. 1-4) of an electronic equipment (not shown in FIGS. 1-4).

The first antenna 101 comprises a first base body 111, a first radiation metal layer 112, a grounded metal layer 113 and two first feed-in components 119*a*, 119*b*. The first radiation metal layer 112 is arranged on a surface of the first base body 111. The grounded metal layer 113 is arranged on a bottom surface of the first base body 111. The first base body 111 is configured to set up (namely, define) a first through hole 114, a second through hole 115, a third through hole 116, a fourth through hole 117 and a fifth through hole 118. The first through hole 114, the second through hole 115, the third through hole 116, the fourth through hole 117 and the fifth through hole 118 are through the first base body 111, the first radiation metal layer 112 and the grounded metal layer 113, and are defined to form a cross. The two first feed-in components 119*a*, 119*b* are configured to break through the first base body 111 through the fourth through hole 117 and the fifth through hole 118. The two first feed-in components 119*a*, 119*b* are electrically connected to the first radiation metal layer 112. The two first feed-in components 119*a*, 119*b* are through the bottom surface of the first base body 111 to be outside the bottom surface of the first base body 111, and neither of the two first feed-in components 119*a*, 119*b* is electrically connected to the grounded metal layer 113. In FIGS. 1-4, the first base body 111 is a flat plate-type body or a block-shaped body made of ceramic dielectric materials.

The second antenna 102 comprises a second base body 121, a second radiation metal layer 122 and two second feed-in components 126*a*, 126*b*. The second base body 121 is arranged on a surface of the first radiation metal layer 112 on the first base body 111. An area of the second base body 121 is smaller than an area of the first radiation metal layer 112. The first radiation metal layer 112 is exposed when the second base body 121 is arranged on the surface of the first radiation metal layer 112. Moreover, the second radiation metal layer 122 is arranged on a surface of the second base body 121. The second base body 121 is configured to set up (namely, define a set of holes or apertures) a sixth through hole 123, a seventh through hole 124 and an eighth through hole 125. The sixth through hole 123, the seventh through hole 124 and the eighth through hole 125 are through the second base body 121 and the second radiation metal layer 122. The sixth through hole 123, the seventh through hole 124 and the eighth through hole 125 are corresponding to the first through hole 114, the second through hole 115 and the third through hole 116 of the first base body 111 respectively. The two second feed-in components 126*a*, 126*b* are through the seventh through hole 124 and the eighth through hole 125 respectively, and are electrically connected to the second radiation metal layer 122, and then are through the second through hole 115 and the third through hole 116 respectively to be extended outside the bottom surface of the first base body 111, and neither of the two second feed-in components 126*a*, 126*b* is electrically connected to the grounded metal layer 113. In FIGS. 1-4, the second base body 121 is a flat plate-type body or a block-shaped body made of ceramic dielectric materials.

The third antenna 103 comprises a third base body 131, a third radiation metal layer 132 and a third feed-in component 134. The third base body 131 is arranged on a surface of the second radiation metal layer 122 on the second base body 121. An area of the third base body 131 is smaller than an area of the second radiation metal layer 122. The second radiation metal layer 122 is exposed when the third base body 131 is arranged on the surface of the second radiation metal layer 122. Moreover, the third radiation metal layer 132 is arranged on a surface of the third base body 131. The third base body 131 is configured to set up (namely, define) a ninth through hole 133. The ninth through hole 133 is through the third base body 131 and the third radiation metal layer 132. The ninth through hole 133 is corresponding to the sixth through hole 123 of the second base body 121 and the first through hole 114 of the first base body 111. The third feed-in component 134 is in a T shape. The third feed-in component 134 comprises a head 1341 and a shaft 1342. The head 1341 is extended to the shaft 1342. The shaft 1342 is through the ninth through hole 133 of the third base body 131, the sixth through hole 123 of the second base body 121 and the first through hole 114 of the first base body 111 to be outside the bottom surface of the first base body 111. The third feed-in component 134 is electrically connected to the third radiation metal layer 132 when the third feed-in component 134 is through the ninth through hole 133. The third feed-in component 134 is not electrically connected to the grounded metal layer 113 when the third feed-in component 134 is through the bottom surface of the first base body 111 to be outside the bottom surface of the first base body 111. In FIGS. 1-4, the third base body 131 is a flat plate-type body or a block-shaped body made of ceramic dielectric materials.

The circuit board 104 comprises a front side 141 and a back side 142. The front side 141 is an adhesive area. Any one of glues or double-side adhesive tapes (and so on) can be arranged on the adhesive area. The circuit board 104 is configured to define a first punched hole 143, a second punched hole 144, a third punched hole 145, a fourth punched hole 146 and a fifth punched hole 147. The first punched hole 143, the second punched hole 144, the third punched hole 145, the fourth punched hole 146 and the fifth punched hole 147 are corresponding to the first through hole 114, the second through hole 115, the third through hole 116, the fourth through hole 117 and the fifth through hole 118 respectively. Each of the first punched hole 143, the second punched hole 144, the third punched hole 145, the fourth punched hole 146 and the fifth punched hole 147 comprises an electrical connection point 148 on the back side 42. Namely, the circuit board 104 further comprises five electrical connection points 148 which are on the back side 142 and are connected to/at each of the first punched hole 143, the second punched hole 144, the third punched hole 145, the fourth punched hole 146 and the fifth punched hole 147 respectively. Each of the electrical connection points 148 is extended to an electrical fixing-connection point 149, wherein the circuit board 104 further comprises five electrical fixing-connection points 149. The two first feed-in components 119*a*, 119*b*, the two second feed-in components 126*a*, 126*b* and the third feed-in component 134 are through the bottom surface of the first base body 111 of the first antenna 101 to be outside the bottom surface of the first base body 111, and are electrically connected to the electrical connection points 148 on the back side 42 of the circuit board 104 through the fourth punched hole 146, the fifth punched hole 147, the second punched hole 144, the third punched hole 145 and the first punched hole 143 orderly. Then, the electrical fixing-connection points 149 of the circuit board 104 are electrically and fixedly connected to the mainboard (not shown in FIGS. 1-4) of the electronic item (not shown in FIGS. 1-4.

FIG. 4 shows a side-sectional view of the surface mount type three-stack antenna of the present invention. As shown in FIG. 4, after the first base body 111, the second base body 121 and the third base body 131 of the present invention are stacked orderly, the two first feed-in components 119*a*, 119*b*, the two second feed-in components 126*a*, 126*b* and the third feed-in component 134 are electrically connected to the electrical connection points 148 of the circuit board 104 through the fourth punched hole 146, the fifth punched hole 147, the second punched hole 144, the third punched hole 145 and the first punched hole 143 respectively, to form the surface mount type three-stack antenna 100 which comprises the first antenna 101, the second antenna 102 and the third antenna 103 together.

After the first antenna 101, the second antenna 102 and the third antenna 103 are stacked, the first antenna 101 forms to be able to receive GPS L5/L2 signals with frequencies 1100 MHz~1250 MHz. The second antenna 102 forms to be able to receive GPS/GNSS/BeiDou signals with frequencies 1500 MHz~1650 MHz. The third antenna 103 forms to be able to receive SDARS/WLAN signals with frequencies 2300 MHz~2500 MHz.

Figure 5:
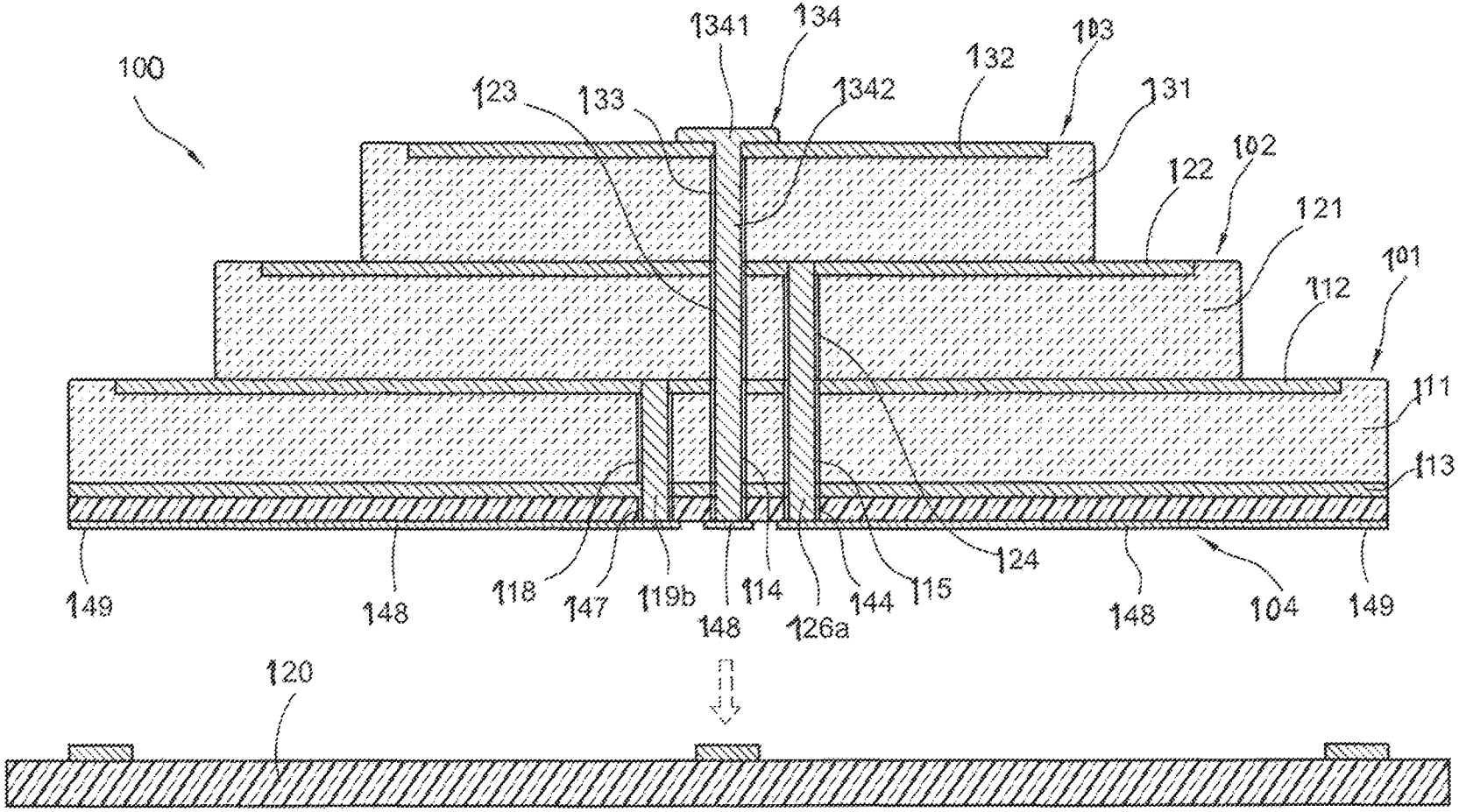
FIG. 5 shows that the surface mount type three-stack antenna of the present invention is ready to be electrically and fixedly connected to a mainboard of an electronic item.
Figure 6:
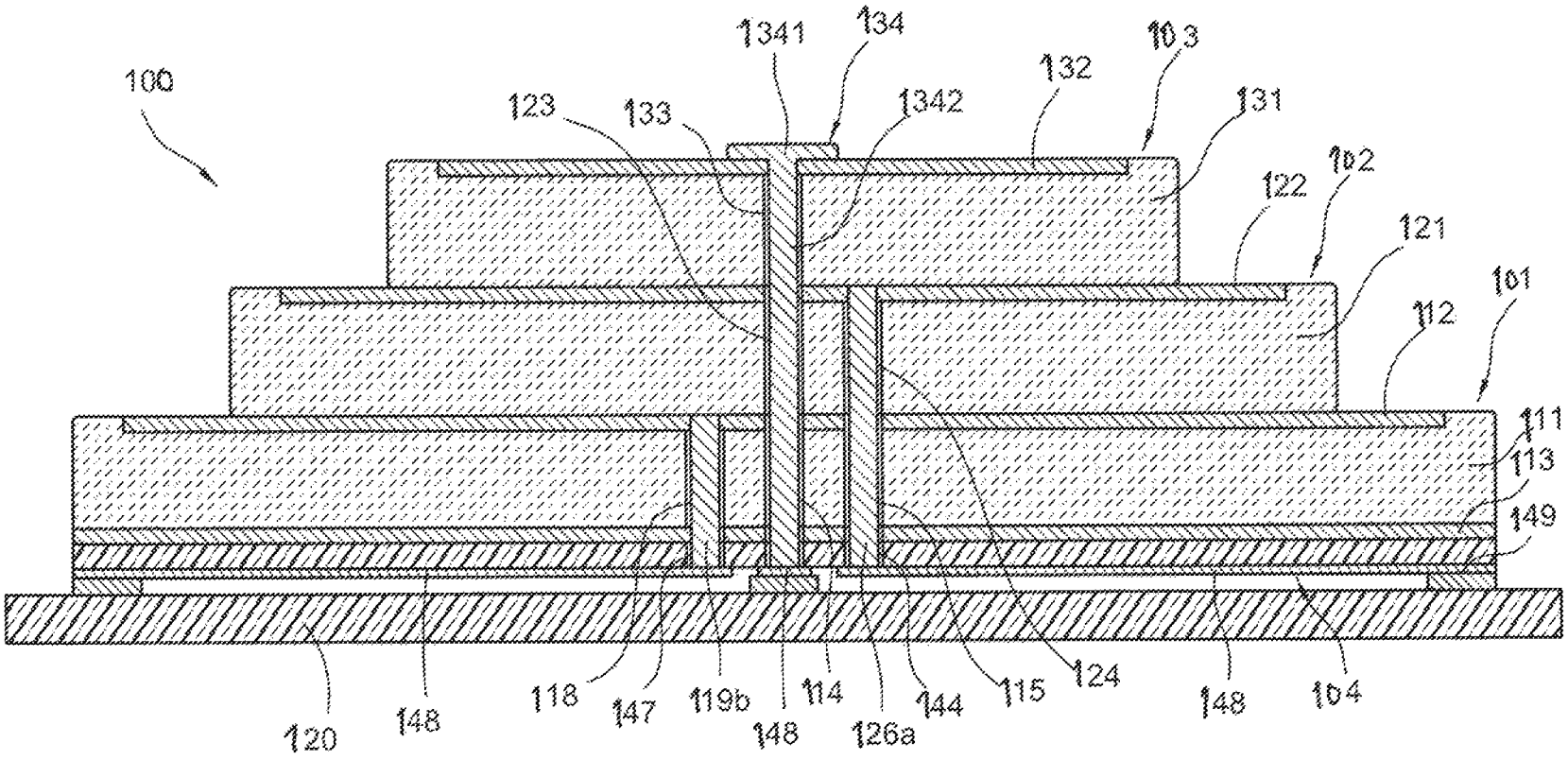
FIG. 6 shows that the surface mount type three-stack antenna of the present invention has been electrically and fixedly connected to the mainboard of the electronic item.

FIG. 5 shows that the surface mount type three-stack antenna of the present invention is ready to be electrically and fixedly connected to a mainboard of an electronic item. FIG. 6 shows that the surface mount type three-stack antenna of the present invention has been electrically and fixedly connected to the mainboard of the electronic item. As shown in FIGS. 5-6, after the first antenna 101, the second antenna 102, the third antenna 103 and the circuit board 104 of the present invention are combined into the surface mount type three-stack antenna 100, the electrical fixing-connection points 149 on the back side 142 of the circuit board 104 are electrically connected to a mainboard 120 of the electronic item (not shown in FIGS. 5-6), and signals received by the two first feed-in components 119*a*, 119*b*, the two second feed-in components 126*a*, 126*b* and the third feed-in component 134 are sent to the mainboard 120 which processes the signals.

Figure 7:
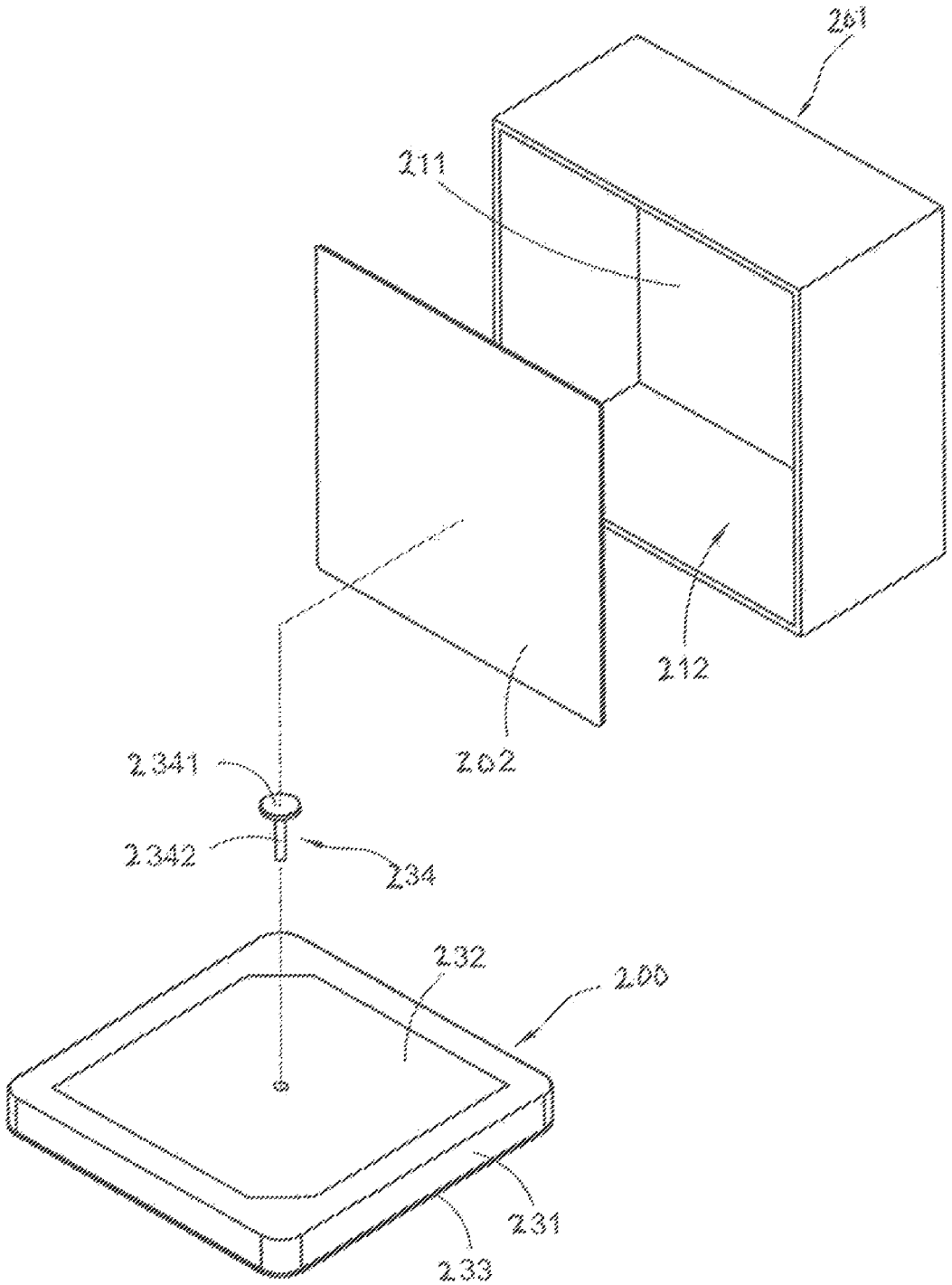
FIG. 7 shows an exploded view of the first embodiment of the patch antenna structure of the present invention.
Figure 8:
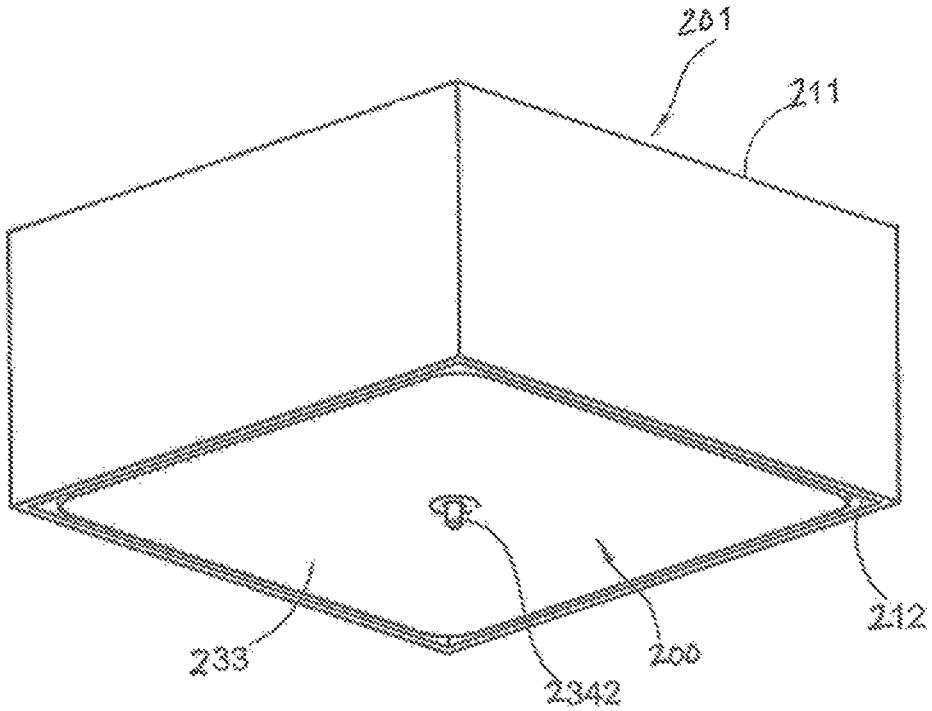
FIG. 8 shows an assembly drawing of the first embodiment of the patch antenna structure of the present invention.
Figure 9:
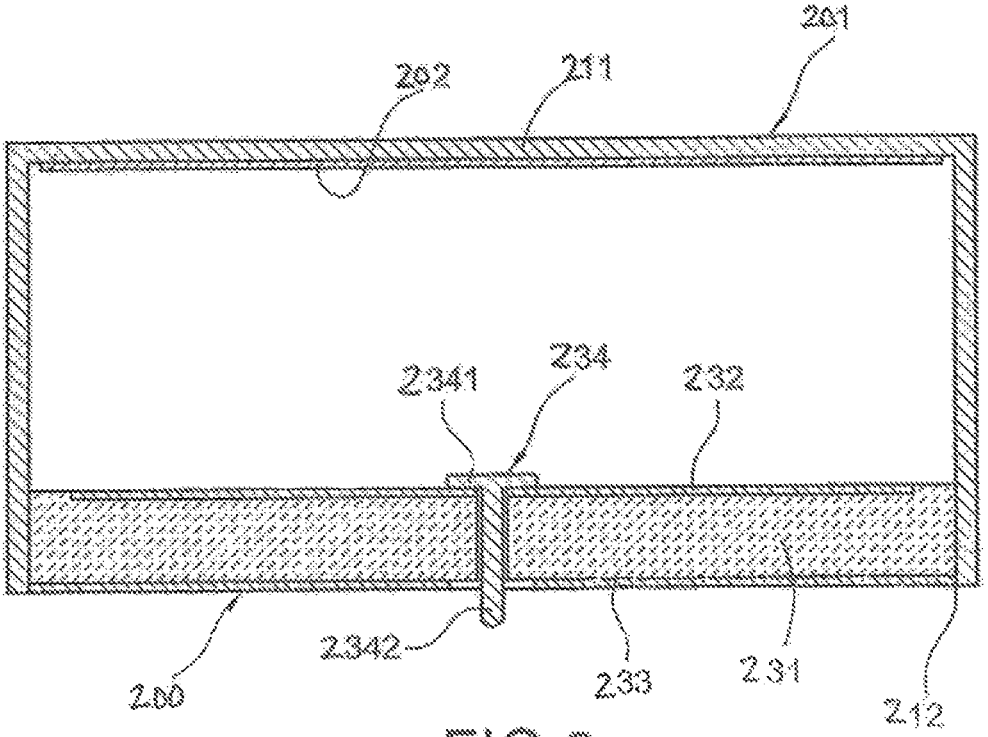
FIG. 9 shows a side-sectional view of the first embodiment of the patch antenna structure of the present invention.

The manpower for assembling can be significantly reduced to improve the efficiency and convenience for using because the surface mount type three-stack antenna 100 is electrically connected to and arranged on the mainboard 120 of the electronic item by the surface mount way FIG. 7 shows an exploded view of the first embodiment of the patch antenna structure of the present invention. FIG. 8 shows an assembly drawing of the first embodiment of the patch antenna structure of the present invention. FIG. 9 shows a side-sectional view of the first embodiment of the patch antenna structure of the present invention. As shown in FIGS. 7-9, a patch antenna structure changing a radiation pattern of the present invention comprises a support component 201, a conducting component 202 and a patch antenna 200.

The support component 201 comprises a closed end 211 and an open end 212. The closed end 211 is arranged correspondingly to the open end 212. In FIGS. 7-9, the support component 201 is a hollowed-out cover made of an insulating material. The insulating material is, for example, a plastic or a rubber.

The conducting component 202 appears as a sheet body and is arranged on an inner side of the closed end 211. In FIGS. 7-9, the conducting component 202 is a metal conducting material.

The patch antenna 200 is a cube. The patch antenna 200 is arranged on the open end 212 of the support component 201. The patch antenna comprises a base body 231, a radiation metal layer 232, a grounded metal layer 233 and a signal feed-in body 234. The base body 231 is made of a ceramic dielectric. The radiation metal layer 232 is arranged on a top surface of the base body 231. The grounded metal layer 233 is arranged on a bottom surface of the base body 231. The signal feed-in body 234 is in a T shape. The signal feed-in body 234 comprises a head 2341 and a shaft 2342. A terminal of the shaft 2342 of the signal feed-in body 234 is (namely, breaks) through the bottom surface of the base body 231 when the signal feed-in body 234 is through the base body 231. The shaft 2342 is not electrically connected to the grounded metal layer 233. At the same time, the head 2341 of the signal feed-in body 234 is electrically connected to the radiation metal layer 232, so that the radiation metal layer 232 forms a signal receiving side.

With the conducting component 202 which is supported by the support component 201 and is arranged above the patch antenna 200 in a suspending state, the radiation pattern of the patch antenna 200 is changed to increase a range for receiving signals from a terrestrial base station.

Figure 10A:
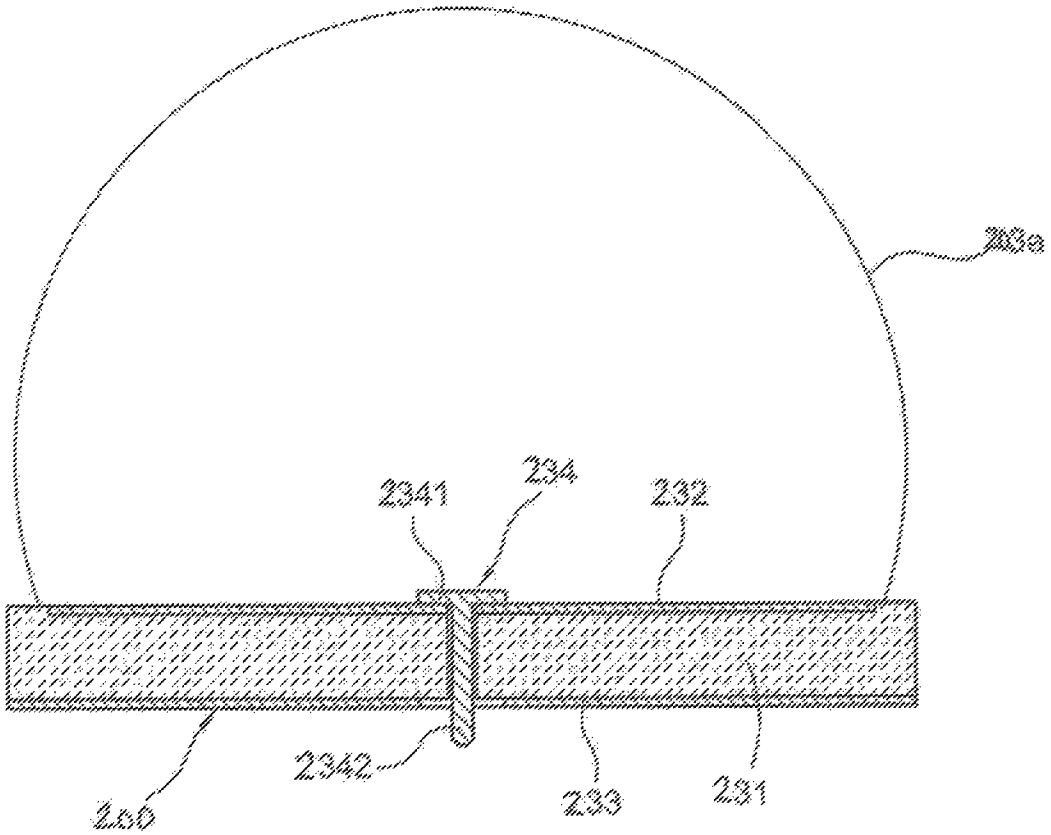
FIG. 10A shows a radiation pattern generated by the first embodiment of the patch antenna without the conducting component of the present invention.
Figure 10B:
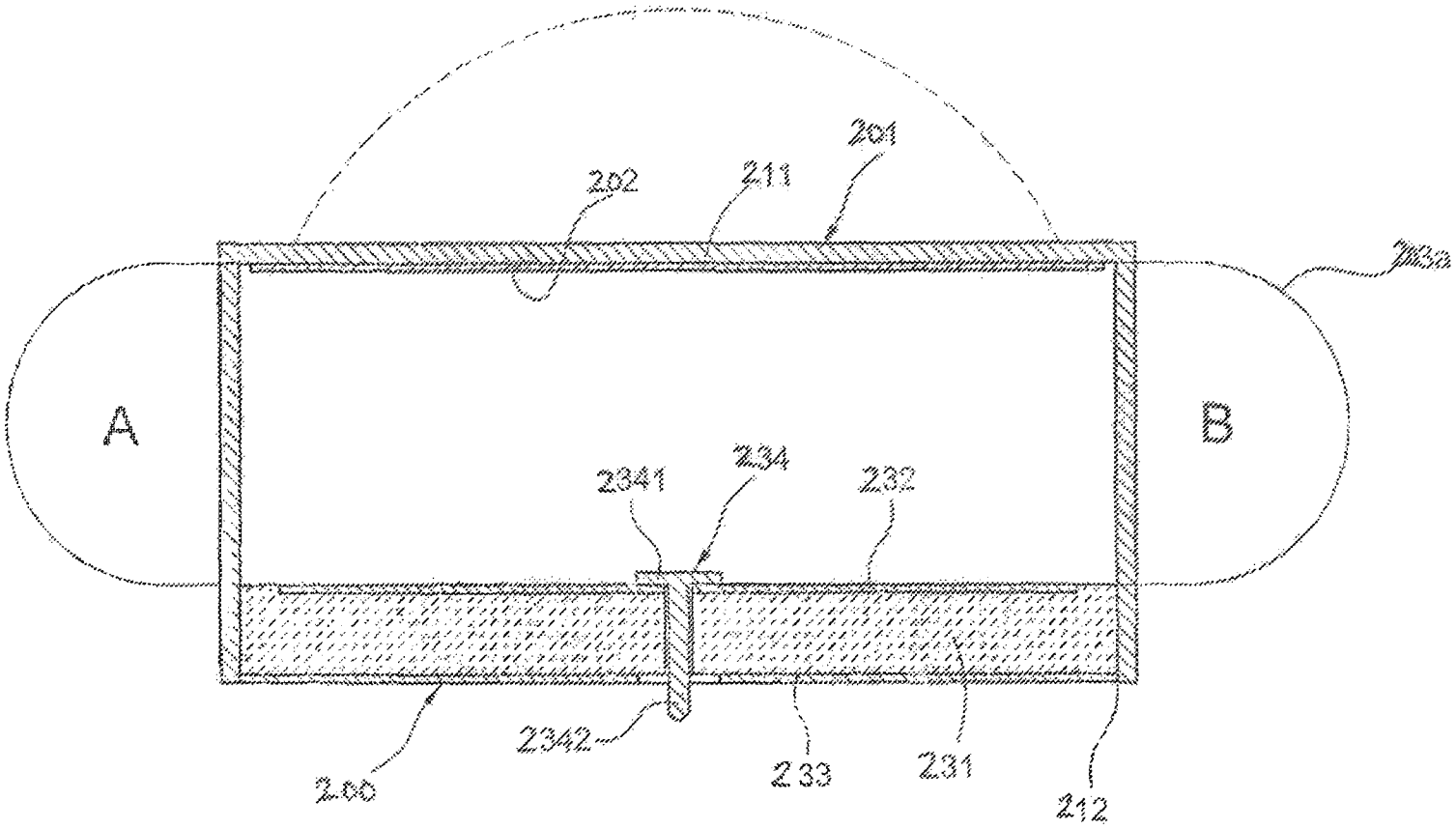
FIG. 10B shows the change of a radiation pattern generated by the first embodiment of the patch antenna with the conducting component of the present invention.
Figure 10C:
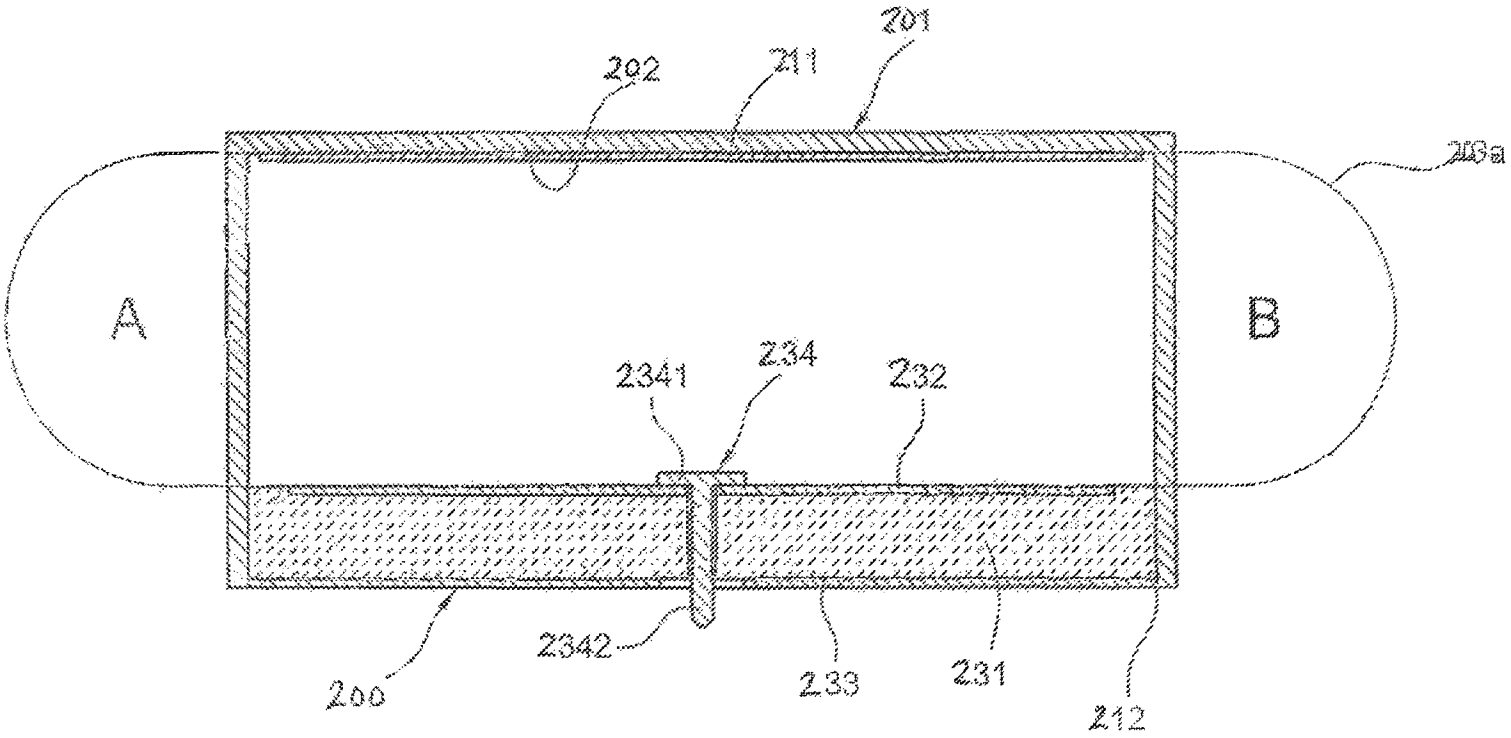
FIG. 10C shows the change of a radiation pattern generated by the first embodiment of the patch antenna with the conducting component of the present invention.

FIG. 10A shows a radiation pattern generated by the first embodiment of the patch antenna without the conducting component of the present invention. FIG. 10B shows the change of a radiation pattern generated by the first embodiment of the patch antenna with the conducting component of the present invention. FIG. 10C shows the change of a radiation pattern generated by the first embodiment of the patch antenna with the conducting component of the present invention. As shown in FIGS. 10A-10C, when the patch antenna 200 of the present invention is without the conducting component 202 and receives satellite signals, the patch antenna 200 generates a radiation pattern 203*a* which is shaped like a ball as shown in FIG. 10A, so that the patch antenna 200 (the satellite antenna) mainly receives the satellite signals right above the radiation pattern 203*a*. Correspondingly, the range for receiving the signals from the terrestrial base station is smaller. In order to increase the effect of the patch antenna 200 receiving the signals from the terrestrial base station, the support component 201 is designed to be with the conducting component 202. The original receiving range of the patch antenna 200 is changed after the patch antenna 200 is covered by the support component 201. A right above part of the radiation pattern is suppressed as the dotted line part shown in FIG. 10B, so that the radiation pattern is changed (namely, extended) to two sides which are an A part and a B part shown in FIG. 10B. The effect of the patch antenna 200 receiving the signals of the satellite right above the patch antenna 200 decreases slightly, but the receiving range of the A part and the B part shown in FIG. 10C increase. Therefore, the range for receiving signals from the terrestrial base station is improved dramatically and the overall receiving efficiency of the satellite antenna is improved after the conducting component 202 is arranged correspondingly above the patch antenna 200.

Figure 11:
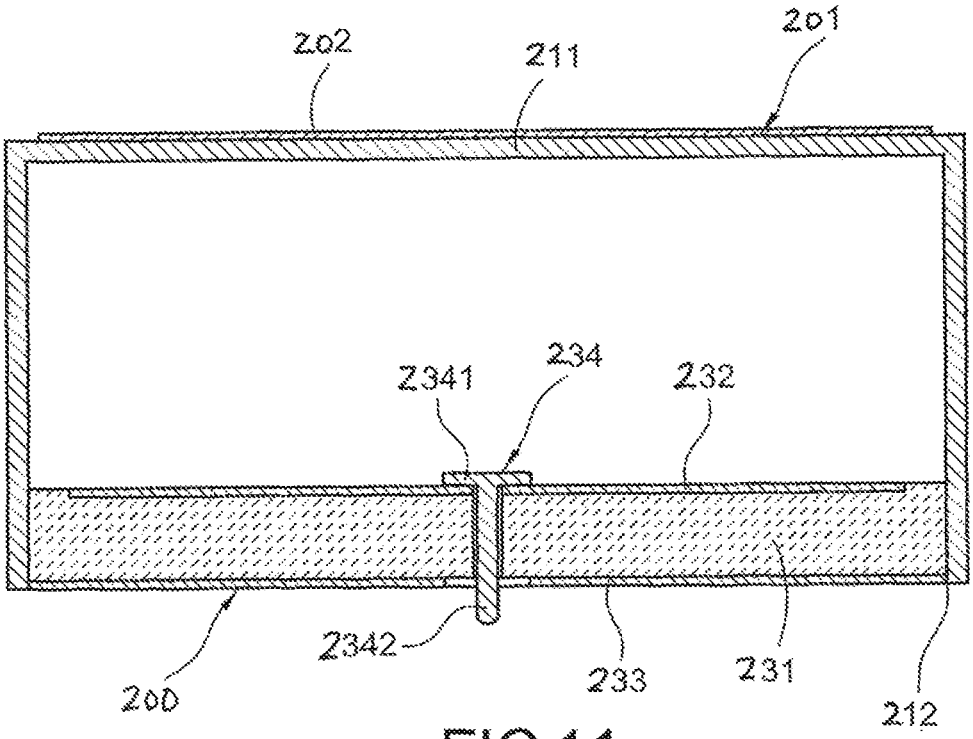
FIG. 11 shows a side-sectional view of the second embodiment of the patch antenna structure of the present invention.

FIG. 11 shows a side-sectional view of the second embodiment of the patch antenna structure of the present invention. As shown in FIG. 11, the second embodiment of the present invention is roughly the same as the first embodiment. The difference is that the conducting component 202 is arranged on an outer side of the closed end 211 and is arranged correspondingly to the radiation metal layer 232 of the patch antenna 200. Similarly, the conducting component 202 supported by the support component 201 changes the radiation pattern of the patch antenna 200 when the radiation metal layer 232 of the patch antenna 200 generates the radiation pattern. The range for receiving signals from the terrestrial base station is improved and the overall receiving efficiency of the satellite antenna is improved.

Figure 12:
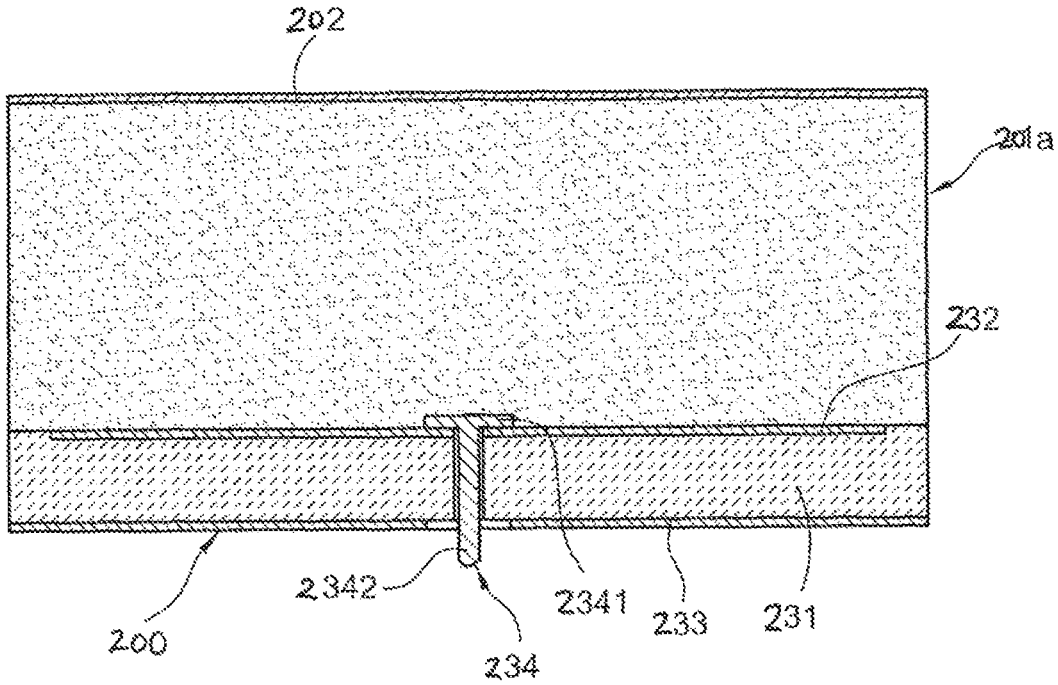
FIG. 12 shows a diagram of the third embodiment of the patch antenna structure of the present invention.

FIG. 12 shows a diagram of the third embodiment of the patch antenna structure of the present invention. As shown in FIG. 12, the third embodiment of the present invention is roughly the same as the first embodiment. The difference is that a support component 201*a* is different from the support component 201 of the first embodiment. The support component 201*a* of the third embodiment is made of a material with a permittivity below 2, such as a Styrofoam or a foam.

The support component 201*a* is a blocky object made of the Styrofoam or the foam. The radiation metal layer 232 of the patch antenna 200 is arranged on a bottom of the support component 201*a*. The conducting component 202 is arranged on a top of the support component 201*a*. Therefore, the conducting component 202 is arranged correspondingly to the radiation metal layer 232 of the patch antenna 200.

The conducting component 202 arranged on the top of the support component 201*a* changes the radiation pattern of the patch antenna 200 when the radiation metal layer 232 of the patch antenna 200 generates the radiation pattern. Therefore, the range for receiving signals from the terrestrial base station is improved and the overall receiving efficiency of the satellite antenna is improved.

Figure 13:
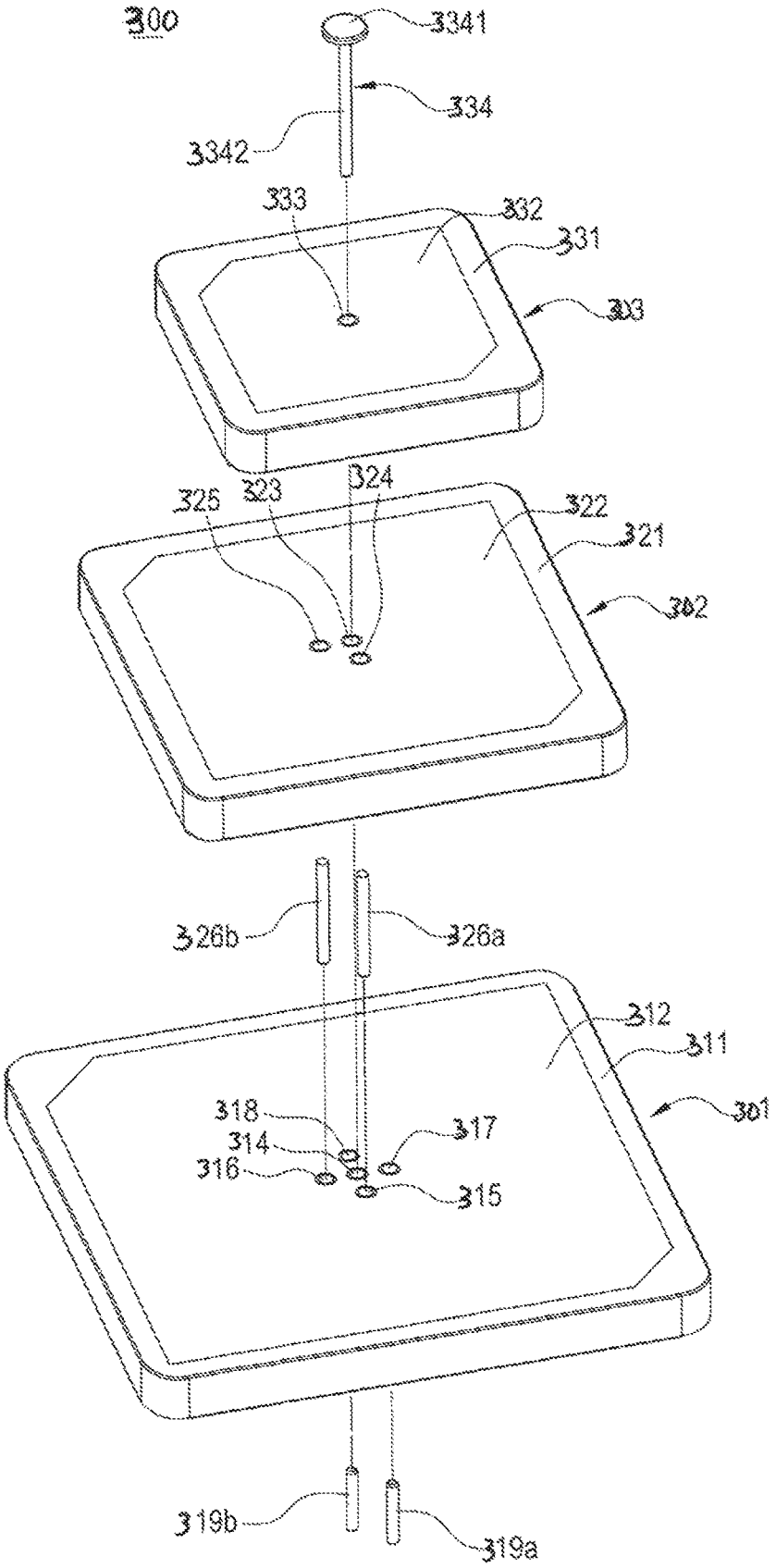
FIG. 13 shows an exploded view of the five-feed-in-and-three-stack antenna structure of the present invention.
Figure 14:
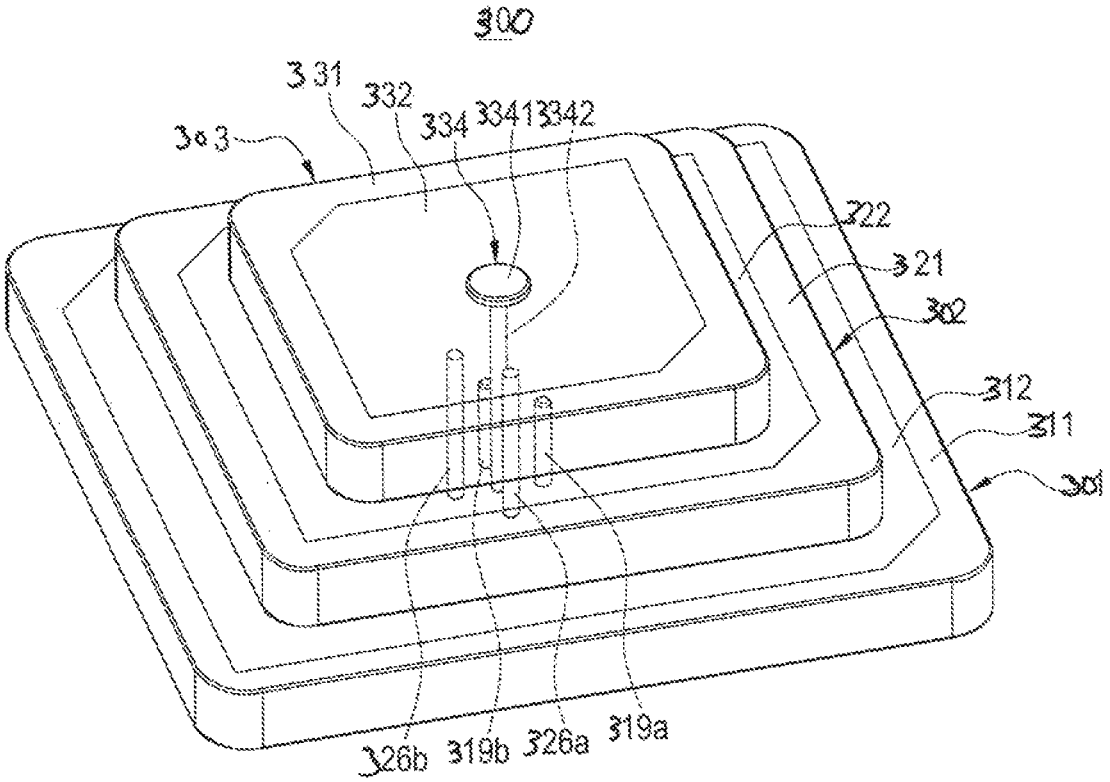
FIG. 14 shows an assembly drawing of the five-feed-in-and-three-stack antenna structure of the present invention.
Figure 15:
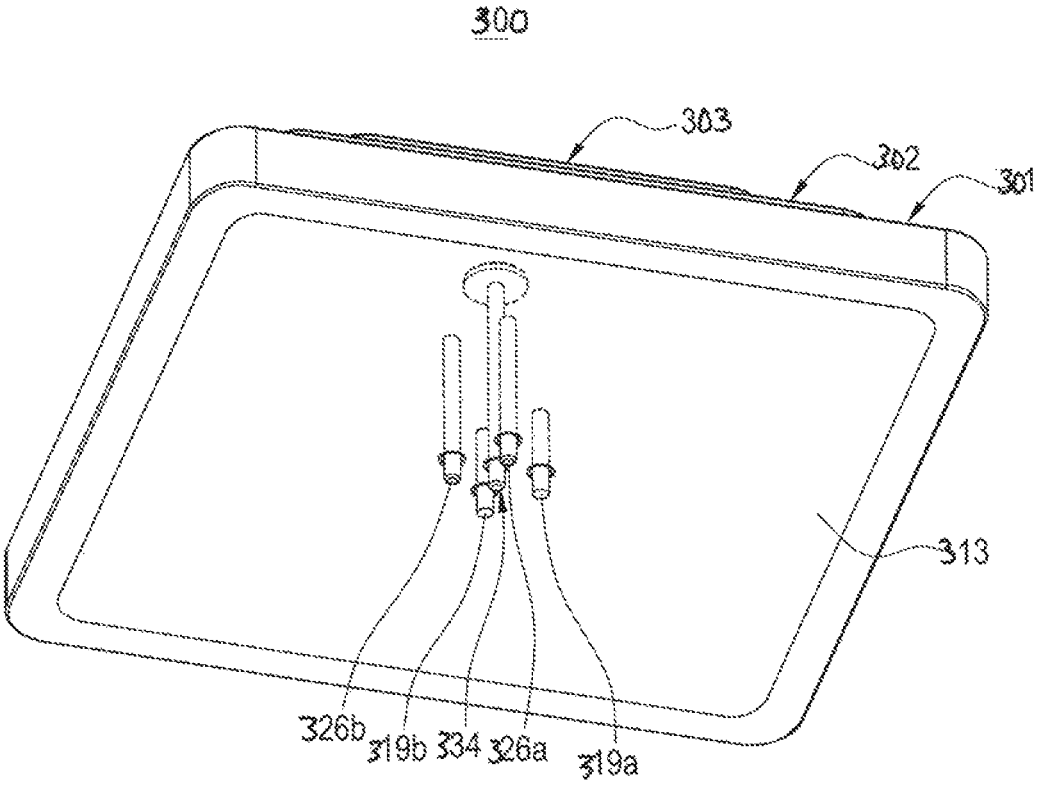
FIG. 15 shows an upward view of the five-feed-in-and-three-stack antenna structure of the present invention.
Figure 16:
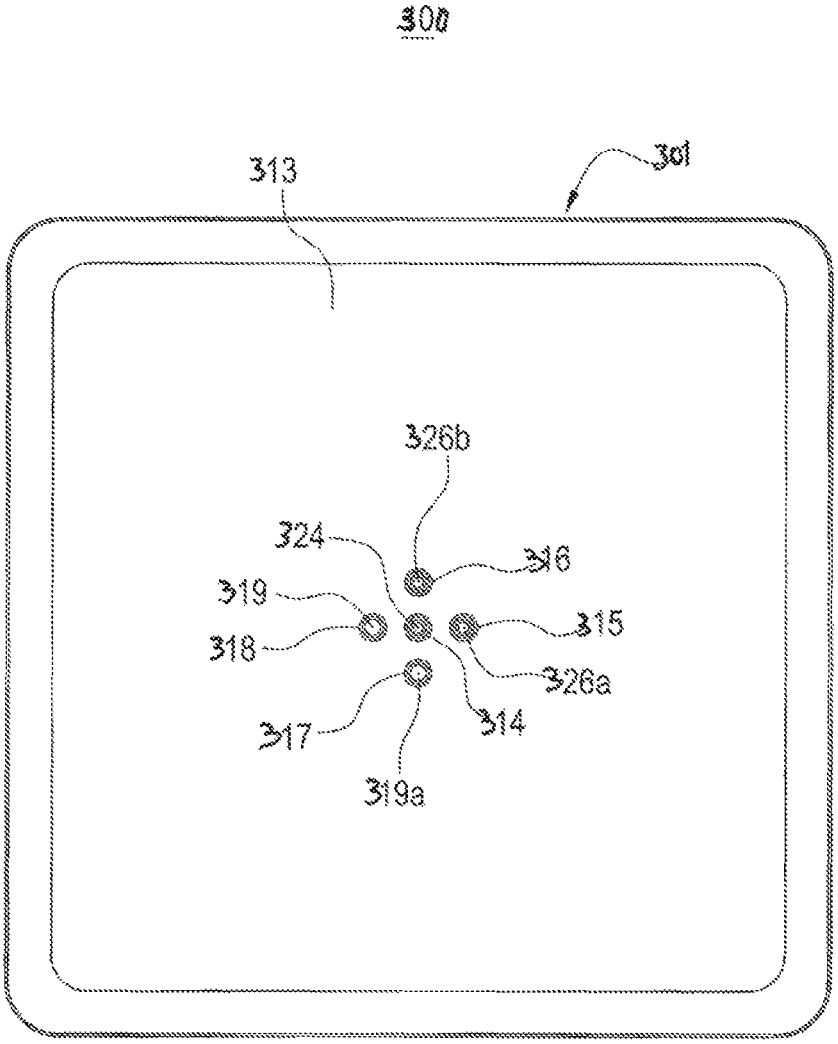
FIG. 16 shows the bottom surface of the first-base body of the present invention.

FIG. 13 shows an exploded view of the five-feed-in-and-three-stack antenna structure of the present invention. FIG. 14 shows an assembly drawing of the five-feed-in-and-three-stack antenna structure of the present invention. FIG. 15 shows an upward view of the five-feed-in-and-three-stack antenna structure of the present invention. FIG. 16 shows the bottom surface of the first-base body of the present invention. As shown in FIGS. 13-16, a five-feed-in-and-three-stack antenna structure 300 of the present invention comprises a first antenna 301, a second antenna 302 and a third antenna 303. Moreover, the first antenna 301, the second antenna 302 and the third antenna 303 are stacked as the five-feed-in-and-three-stack antenna structure 300 which is nearly cone-shaped. The five-feed-in-and-three-stack antenna structure 300 is formed to be able to receive different communication system signals having different frequencies.

The first antenna 301 comprises a first-base body 311, a first-radiation-metal layer 312, a grounded-metal layer 313 and two first-feed-in components 319*a*, 319*b*. The first-radiation-metal layer 312 is arranged on a surface of the first-base body 311. The grounded-metal layer 313 is arranged on a bottom surface of the first-base body 311. The first-base body 311 sets up (namely, defines) a first-through hole 314, a second-through hole 315, a third-through hole 316, a fourth-through hole 317 and a fifth-through hole 318. The first-through hole 314, the second-through hole 315, the third-through hole 316, the fourth-through hole 317 and the fifth-through hole 318 are through the first-base body 311, the first-radiation-metal layer 312 and the grounded-metal layer 313, and are defined to form a cross. The two first-feed-in components 319*a*, 319*b* are configured to break through the first-base body 311 through the fourth-through hole 317 and the fifth-through hole 318. The two first-feed-in components 319*a*, 319*b* are electrically connected to the first-radiation-metal layer 312. The two first-feed-in components 319*a*, 319*b* are through the bottom surface of the first-base body 311 to be outside the bottom surface of the first-base body 311, and neither of the two first-feed-in components 319*a*, 319*b* is electrically connected to the grounded-metal layer 313. In FIGS. 13-16, the first-base body 311 is a flat plate-type body or a block-shaped body made of ceramic dielectric materials.

The second antenna 302 comprises a second-base body 321, a second-radiation-metal layer 322 and two second-feed-in components 326*a*, 326*b*. The second-base body 321 is arranged on a surface of the first-radiation-metal layer 312 on the first-base body 311. An area of the second-base body 321 is smaller than an area of the first-radiation-metal layer 312. The first-radiation-metal layer 312 is exposed when the second-base body 321 is arranged on the surface of the first-radiation-metal layer 312. Moreover, the second-radiation-metal layer 322 is arranged on a surface of the second-base body 321. The second-base body 321 is configured to set up (namely, define) a sixth-through hole 323, a seventh-through hole 324 and an eighth-through hole 325. The sixth-through hole 323, the seventh-through hole 324 and the eighth-through hole 325 are through the second-base body 321 and the second-radiation-metal layer 322. The sixth-through hole 323, the seventh-through hole 324 and the eighth-through hole 325 are corresponding to the first-through hole 314, the second-through hole 315 and the third-through hole 316 of the first-base body 311 respectively. The two second-feed-in components 326*a*, 326*b* are through the seventh-through hole 324 and the eighth-through hole 325 respectively, and are electrically connected to the second-radiation-metal layer 322, and then are through the second-through hole 315 and the third-through hole 316 respectively to be extended outside the bottom surface of the first-base body 311, and neither of the two second-feed-in components 326*a*, 326*b* is electrically connected to the grounded-metal layer 313. In FIGS. 13-16, the second-base body 321 is a flat plate-type body or a block-shaped body made of ceramic dielectric materials.

The third-antenna 303 comprises a third-base body 331, a third-radiation-metal layer 332 and a third-feed-in component 334. The third-base body 331 is arranged on a surface of the second-radiation-metal layer 322 on the second-base body 321. An area of the third-base body 331 is smaller than an area of the second-radiation-metal layer 322. The second-radiation-metal layer 322 is exposed when the third-base body 331 is arranged on the surface of the second-radiation-metal layer 322. Moreover, the third-radiation-metal layer 332 is arranged on a surface of the third-base body 331. The third-base body 331 is configured to set up (namely, define) a ninth-through hole 333. The ninth-through hole 333 is through the third-base body 331 and the third-radiation-metal layer 332. The ninth-through hole 333 is corresponding to the sixth-through hole 323 of the second-base body 321 and the first-through hole 314 of the first-base body 311. The third-feed-in component 334 is in a T shape. The third-feed-in component 334 comprises a head 3341 and a shaft 3342. The head 3341 is extended to the shaft 3342. The shaft 3342 is through the ninth-through hole 333 of the third-base body 331, the sixth-through hole 323 of the second-base body 321 and the first-through hole 314 of the first-base body 311 to be outside the bottom surface of the first-base body 311. The third-feed-in component 334 is electrically connected to the third-radiation-metal layer 332 when the third-feed-in component 334 is through the ninth-through hole 333. The third-feed-in component 334 is not electrically connected to the grounded-metal layer 313 when the third-feed-in component 334 is through the bottom surface of the first-base body 311 to be outside the bottom surface of the first-base body 311. In FIGS. 13-16, the third-base body 331 is a flat plate-type body or a block-shaped body made of ceramic dielectric materials.

Figure 17:
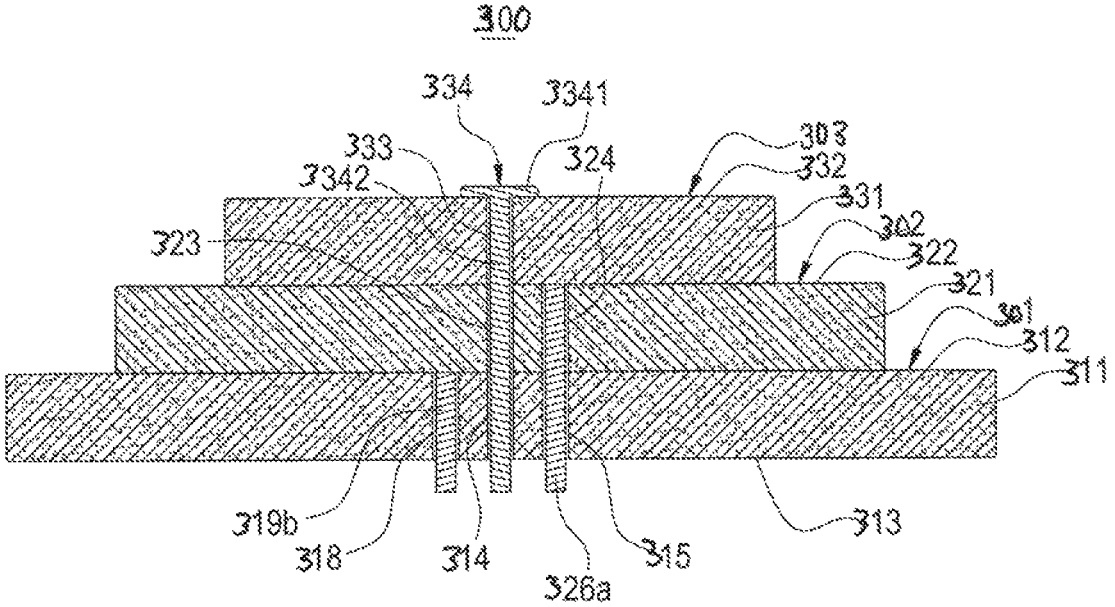
FIG. 17 shows a side-sectional view of the five-feed-in-and-three-stack antenna structure of the present invention.

FIG. 17 shows a side-sectional view of the five-feed-in-and-three-stack antenna structure of the present invention. As shown in FIG. 17, after the first-base body 311, the second-base body 321 and the third-base body 331 of the present invention are stacked orderly: the two first-feed-in components 319*a*, 319*b* are through the fourth-through hole 317 and the fifth-through hole 318 (of the first-base body 311); the two second-feed-in components 326*a*, 326*b* are through the seventh-through hole 324 and the eighth-through hole 325 (of the second-base body 321) and the second-through hole 315 and the third-through hole 316 (of the first-base body 311); and the third-feed-in component 334 is through the ninth-through hole 333 (of the third-base body 331) and the sixth-through hole 323 (of the second-base body 321) and the first-through hole 314 (of the first-base body 311), to form the five-feed-in-and-three-stack antenna structure 300.

Figure 18:
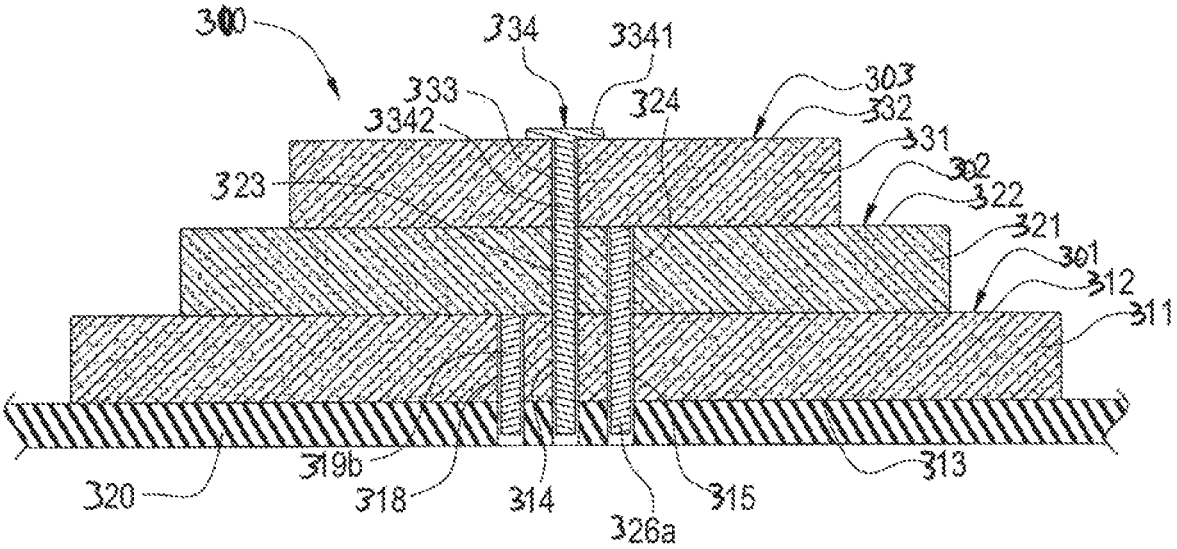
FIG. 18 shows that the five-feed-in-and-three-stack antenna structure of the present invention is electrically connected to a circuit board of an electronic equipment.

FIG. 18 shows that the five-feed-in-and-three-stack antenna structure of the present invention is electrically connected to a circuit board of an electronic equipment. After the first antenna 301, the second antenna 302 and the third antenna 303 are stacked, the two first-feed-in components 319*a*, 319*b*, the two second-feed-in components 326*a*, 326*b* and the third-feed-in component 334 are electrically connected to a circuit board 320 of an electronic equipment. The first antenna 301 forms to be able to receive GPS L5/L2 signals with frequencies 1100 MHz~1250 MHz. The second antenna 302 forms to be able to receive GPS/GNSS/BeiDou signals with frequencies 1500 MHz~1650 MHz. The third antenna 303 forms to be able to receive SDARS/WLAN signals with frequencies 2300 MHz~2500 MHz.

Because the five-feed-in-and-three-stack antenna structure 300 is electrically connected to (and arranged on) the circuit board 320 of the electronic equipment to be able to receive different wireless communication system signals with different frequencies, when the five-feed-in-and-three-stack antenna structure 300 is integrated with the electronic equipment to be used, neither the volume of the electronic equipment nor the area of the electronic equipment becomes larger.

Figure 19:
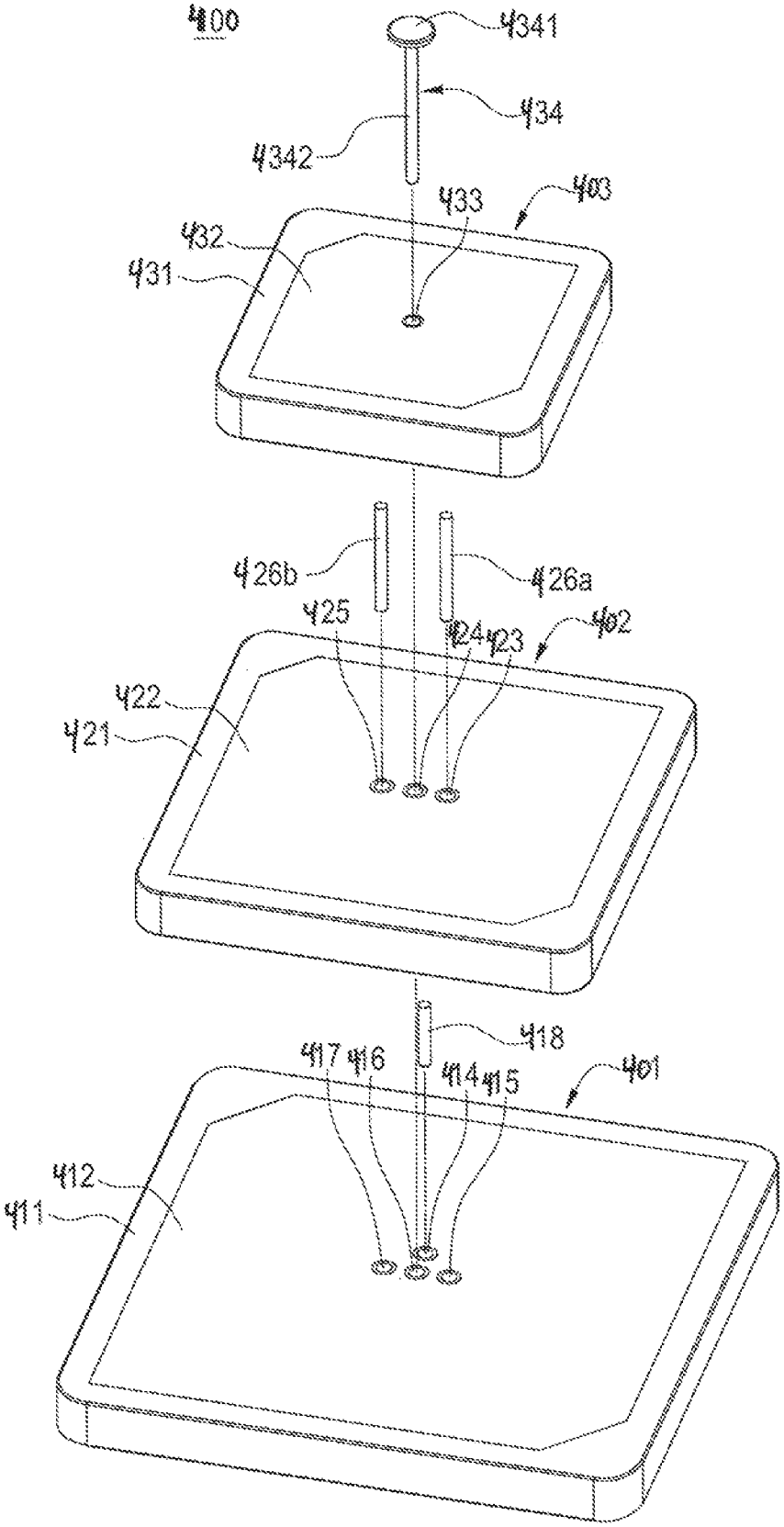
FIG. 19 shows an exploded view of the four-feed-in-and-three-stack antenna structure of the present invention.
Figure 20:
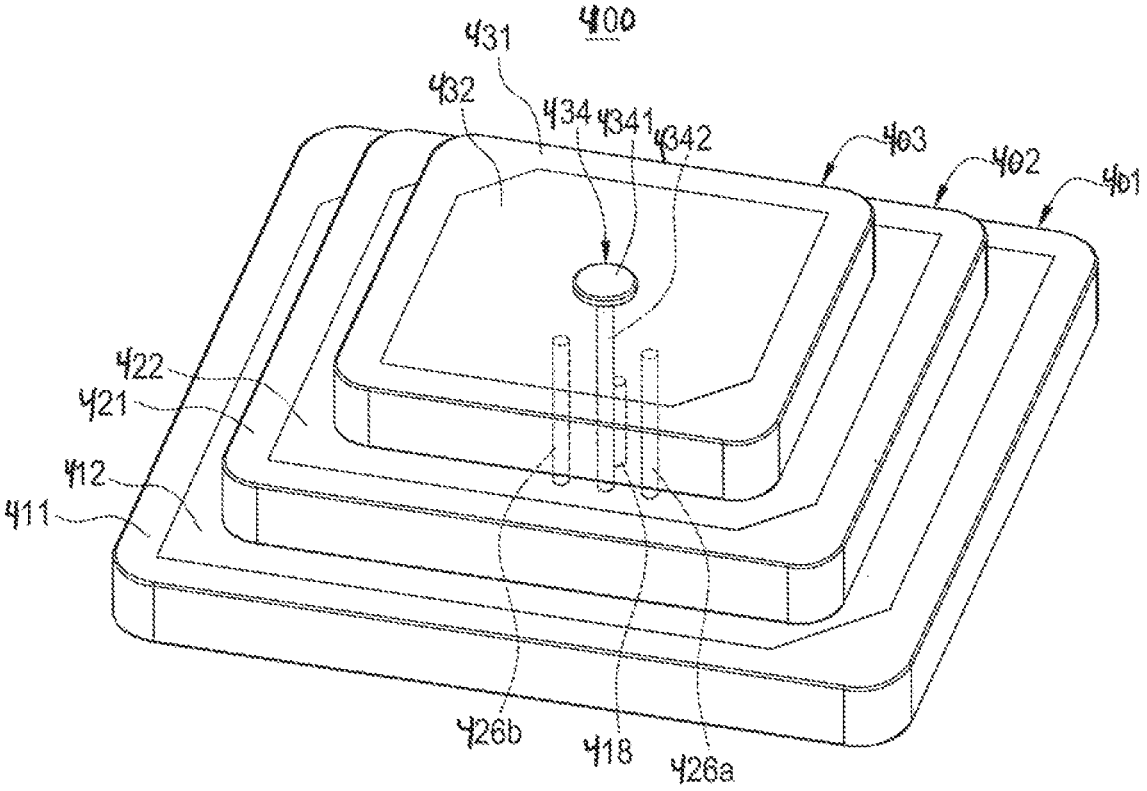
FIG. 20 shows an assembly drawing of the four-feed-in-and-three-stack antenna structure of the present invention.
Figure 21:
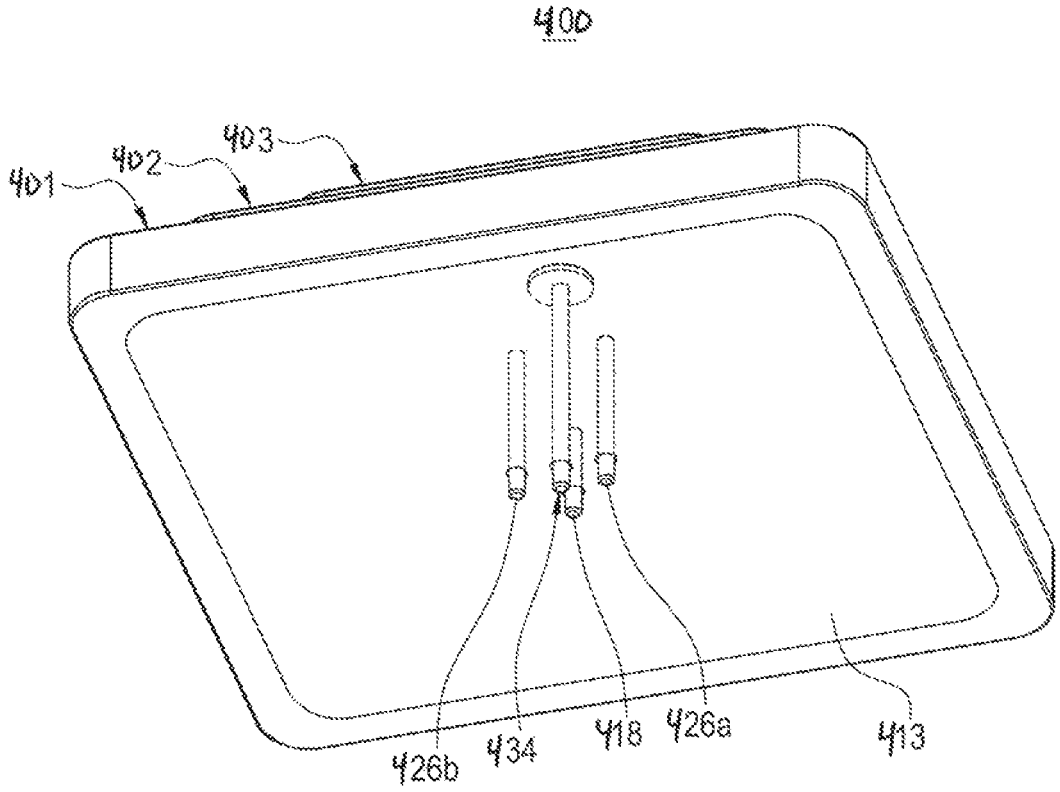
FIG. 21 shows an upward view of the four-feed-in-and-three-stack antenna structure of the present invention.
Figure 22:
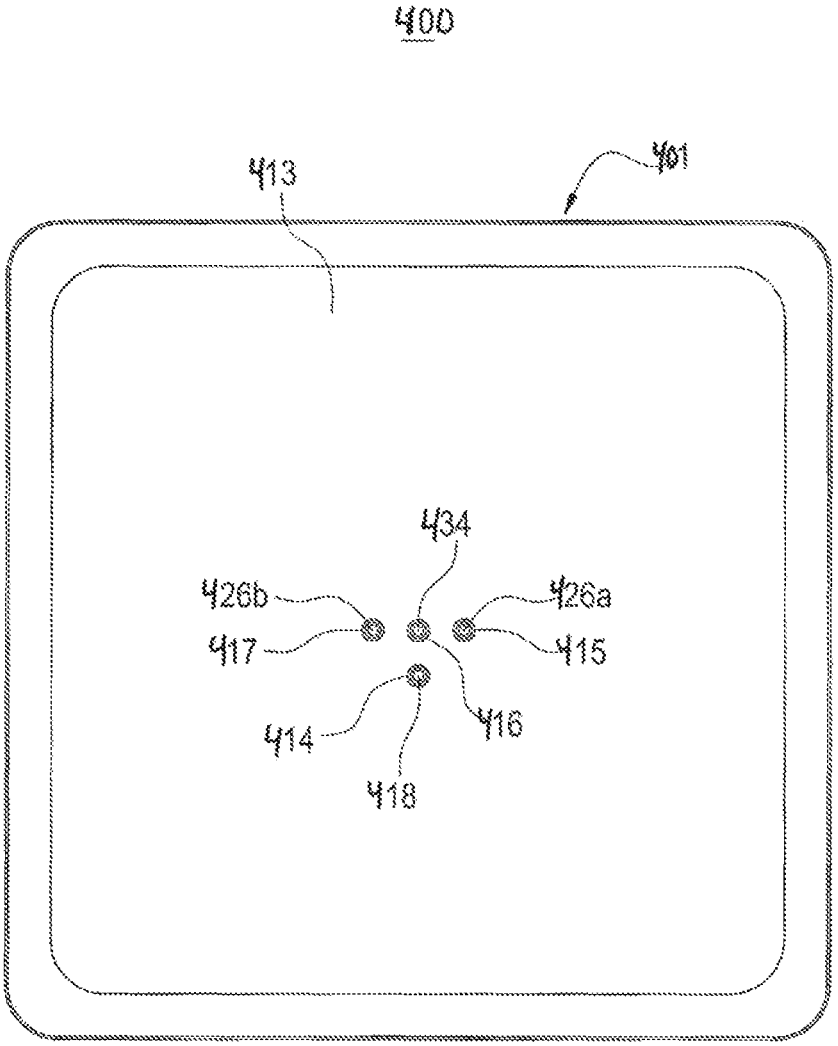
FIG. 22 shows the bottom surface of the first-base body of the present invention.

FIG. 19 shows an exploded view of the four-feed-in-and-three-stack antenna structure of the present invention. FIG. 20 shows an assembly drawing of the four-feed-in-and-three-stack antenna structure of the present invention. FIG. 21 shows an upward view of the four-feed-in-and-three-stack antenna structure of the present invention. FIG. 22 shows the bottom surface of the first-base body of the present invention. As shown in FIGS. 19-22, a four-feed-in-and-three-stack antenna structure 400 of the present invention comprises a first antenna 401, a second antenna 402 and a third antenna 403. Moreover, the first antenna 401, the second antenna 402 and the third antenna 403 are stacked as the four-feed-in-and-three-stack antenna structure 400 which is nearly cone-shaped. The four-feed-in-and-three-stack antenna structure 400 is formed to be able to receive different communication system signals having different frequencies.

The first antenna 401 comprises a first-base body 411, a first-radiation-metal layer 412, a grounded-metal layer 413 and a first-feed-in component 404. The first-radiation-metal layer 412 is arranged on a surface of the first-base body 411. The grounded-metal layer 413 is arranged on a bottom surface of the first-base body 411. The first-base body 411 sets up (namely, defines) a first-through hole 414, a second-through hole 415, a third-through hole 416 and a fourth-through hole 417. The first-through hole 414, the second-through hole 415, the third-through hole 416 and the fourth-through hole 417 are through the first-base body 411, the first-radiation-metal layer 412 and the grounded-metal layer 413. The first-feed-in component 404 is configured to break through the first-base body 411 through the first-through hole 414, and is electrically connected to the first-radiation-metal layer 412. The first-feed-in component 404 is through the bottom surface of the first-base body 411 to be outside the bottom surface of the first-base body 411, and the first-feed-in component 404 is not electrically connected to the grounded-metal layer 413 (namely, the first-feed-in component 404 fails to electrically connect to the grounded-metal layer 413). In FIGS. 19-22, the first-base body 411 is a flat plate-type body or a block-shaped body made of ceramic dielectric materials.

The second antenna 402 comprises a second-base body 421, a second-radiation-metal layer 422 and two second-feed-in components 426*a*, 426*b*. The second-base body 421 is arranged on a surface of the first-radiation-metal layer 412 on the first-base body 411. An area of the second-base body 421 is smaller than an area of the first-radiation-metal layer 412. The first-radiation-metal layer 412 is exposed when the second-base body 421 is arranged on the surface of the first-radiation-metal layer 412. Moreover, the second-radiation-metal layer 422 is arranged on a surface of the second-base body 421. The second-base body 421 is configured to set up (namely, define) a fifth-through hole 423, a sixth-through hole 424 and a seventh-through hole 425. The fifth-through hole 423, the sixth-through hole 424 and the seventh-through hole 425 are through the second-base body 421 and the second-radiation-metal layer 422. The fifth-through hole 423, the sixth-through hole 424 and the seventh-through hole 425 are corresponding to the second-through hole 415, the third-through hole 416 and the fourth-through hole 417 of the first-base body 411 respectively. The two second-feed-in components 426*a*, 426*b* are through the fifth-through hole 423 and the seventh-through hole 425 respectively, and are electrically connected to the second-radiation-metal layer 422, and then are through the second-through hole 415 and the fourth-through hole 417 of the first-base body 411 respectively to be extended outside the bottom surface of the first-base body 411, and neither of the two second-feed-in components 426*a*, 426*b* is electrically connected to the grounded-metal layer 413 (namely, the two second-feed-in components 426*a*, 426*b* fail to electrically connect to the grounded-metal layer 413). In FIGS. 19-22, the second-base body 421 is a flat plate-type body or a block-shaped body made of ceramic dielectric materials.

The third antenna 403 comprises a third-base body 431, a third-radiation-metal layer 432 and a third-feed-in component 434. The third-base body 431 is arranged on a surface of the second-radiation-metal layer 422 on the second-base body 421. An area of the third-base body 431 is smaller than an area of the second-radiation-metal layer 422. The second-radiation-metal layer 422 is exposed when the third-base body 431 is arranged on the surface of the second-radiation-metal layer 422. Moreover, the third-radiation-metal layer 432 is arranged on a surface of the third-base body 431. The third-base body 431 is configured to set up (namely, define) an eighth-through hole 433. The eighth-through hole 433 is through the third-base body 431 and the third-radiation-metal layer 432. The eighth-through hole 433 is corresponding to the sixth-through hole 424 of the second-base body 421 and the third-through hole 416 of the first-base body 411. The third-feed-in component 434 is in a T shape. The third-feed-in component 434 comprises a head 4341 and a shaft 4342. The head 4341 is extended to the shaft 4342. The shaft 4342 is through the eighth-through hole 433 of the third-base body 431, the sixth-through hole 424 of the second-base body 421 and the third-through hole 416 of the first-base body 411 to be outside the bottom surface of the first-base body 411. The third-feed-in component 434 is electrically connected to the third-radiation-metal layer 432 when the third-feed-in component 434 is through the eighth-through hole 433. The third-feed-in component 434 is not electrically connected to the grounded-metal layer 413 (namely, the third-feed-in component 434 fails to electrically connect to the grounded-metal layer 413) when the third-feed-in component 434 is through the bottom surface of the first-base body 411 to be outside the bottom surface of the first-base body 411. In FIGS. 19-22, the third-base body 431 is a flat plate-type body or a block-shaped body made of ceramic dielectric materials.

Figure 23:
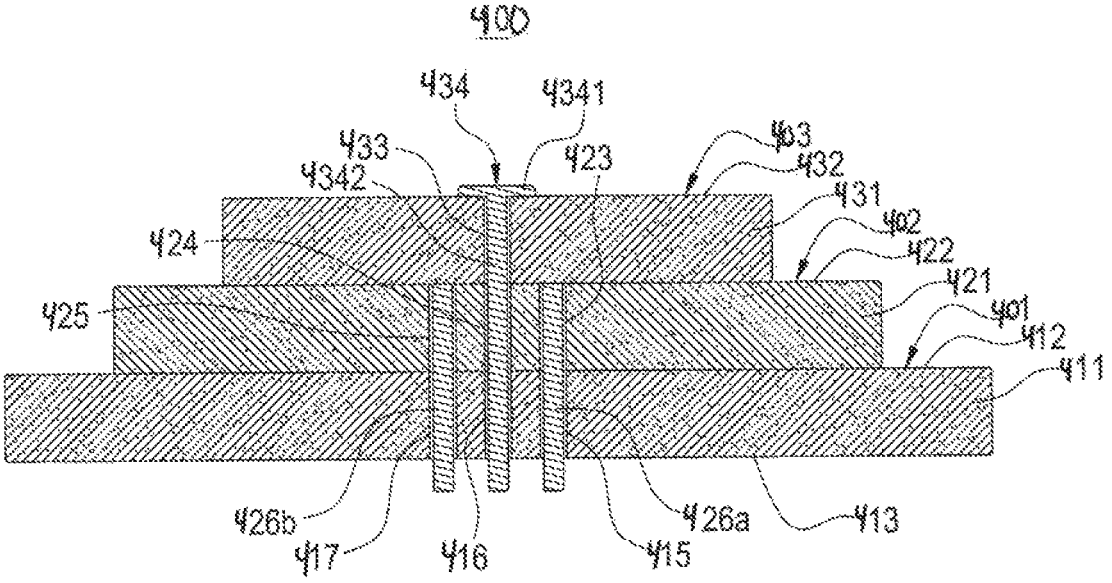
FIG. 23 shows a side-sectional view of the four-feed-in-and-three-stack antenna structure of the present invention.
Figure 24:
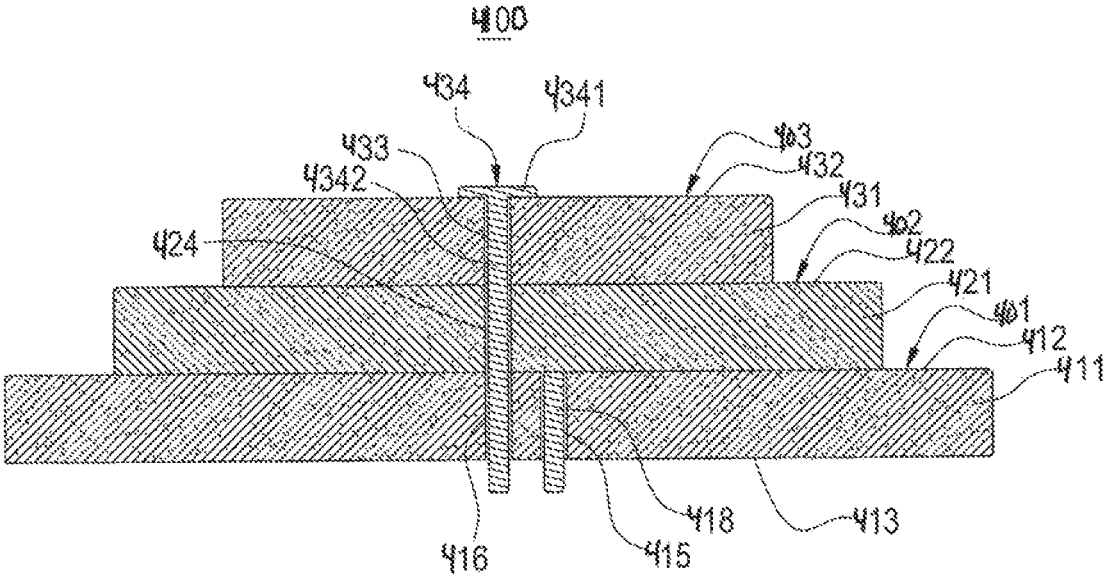
FIG. 24 shows another side-sectional view of the four-feed-in-and-three-stack antenna structure of the present invention.

FIG. 23 shows a side-sectional view of the four-feed-in-and-three-stack antenna structure of the present invention. FIG. 24 shows another side-sectional view of the four-feed-in-and-three-stack antenna structure of the present invention. As shown in FIGS. 23-24, after the first-base body 411, the second-base body 421 and the third-base body 431 of the present invention are stacked orderly: the first-feed-in component 404 is through the first-through hole 414 (of the first-base body 411); the two second-feed-in components 426*a*, 426*b* are through the fifth-through hole 423 and the seventh-through hole 425 (of the second-base body 421), and the second-through hole 415 and the fourth-through hole 417 (of the first-base body 411); the third-feed-in component 434 is through the eighth-through hole 433 (of the third-base body 431), and the sixth-through hole 424 (of the second-base body 421), and the third-through hole 416 (of the first-base body 411), to form the four-feed-in-and-three-stack antenna structure 400.

Figure 25:
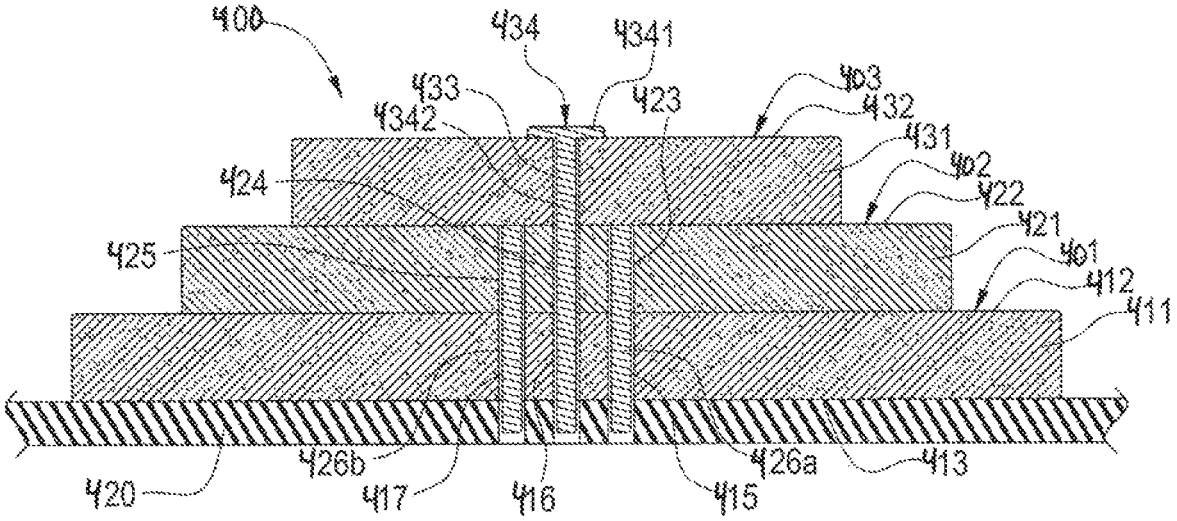
FIG. 25 shows that the four-feed-in-and-three-stack antenna structure of the present invention is electrically connected to a circuit board of an electronic equipment.

FIG. 25 shows that the four-feed-in-and-three-stack antenna structure of the present invention is electrically connected to a circuit board of an electronic equipment. After the first antenna 401, the second antenna 402 and the third antenna 403 of the present invention are stacked, the first-feed-in component 404, the two second-feed-in components 426*a*, 426*b* and the third-feed-in component 434 are electrically connected to a circuit board 420 of an electronic equipment (not shown in FIG. 25). The first antenna 401 forms to be able to receive GPS L5/L2 signals with frequencies 1100 MHz~1250 MHz. The second antenna 402 forms to be able to receive GPS/GNSS/BeiDou signals with frequencies 1500 MHz~1650 MHz. The third antenna 403 forms to be able to receive SDARS/WLAN signals with frequencies 2300 MHz~2500 MHz.

Because the four-feed-in-and-three-stack antenna structure 400 is electrically connected to and arranged on the circuit board 420 of the electronic equipment to be able to receive different wireless communication system signals with different frequencies, when the four-feed-in-and-three-stack antenna structure 400 is integrated with the electronic equipment to be used, neither the volume of the electronic equipment nor the area of the circuit board 420 becomes larger.

Figure 26:
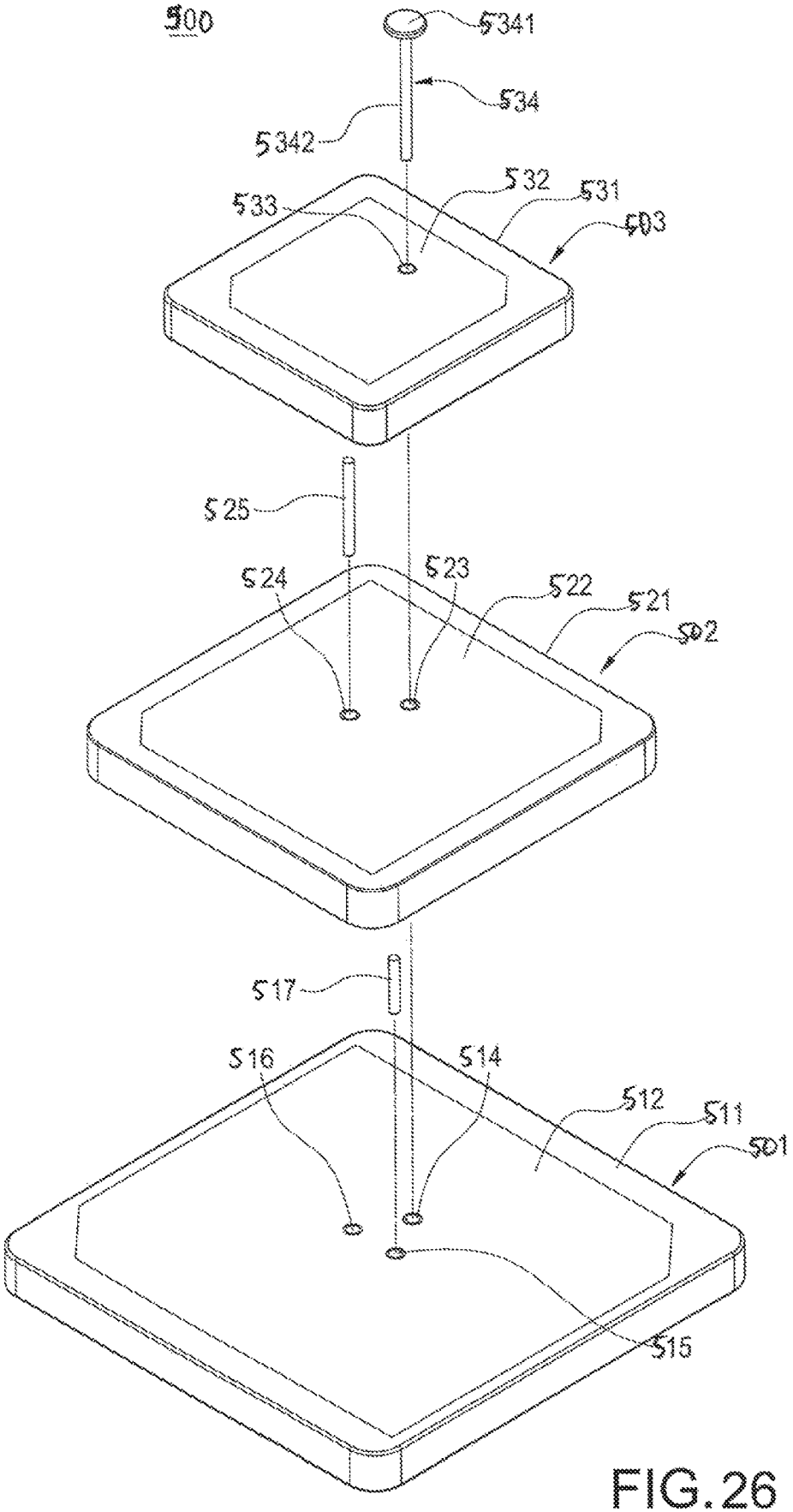
FIG. 26 shows an exploded view of the three-feed-in-and-three-stack antenna structure of the present invention.
Figure 27:
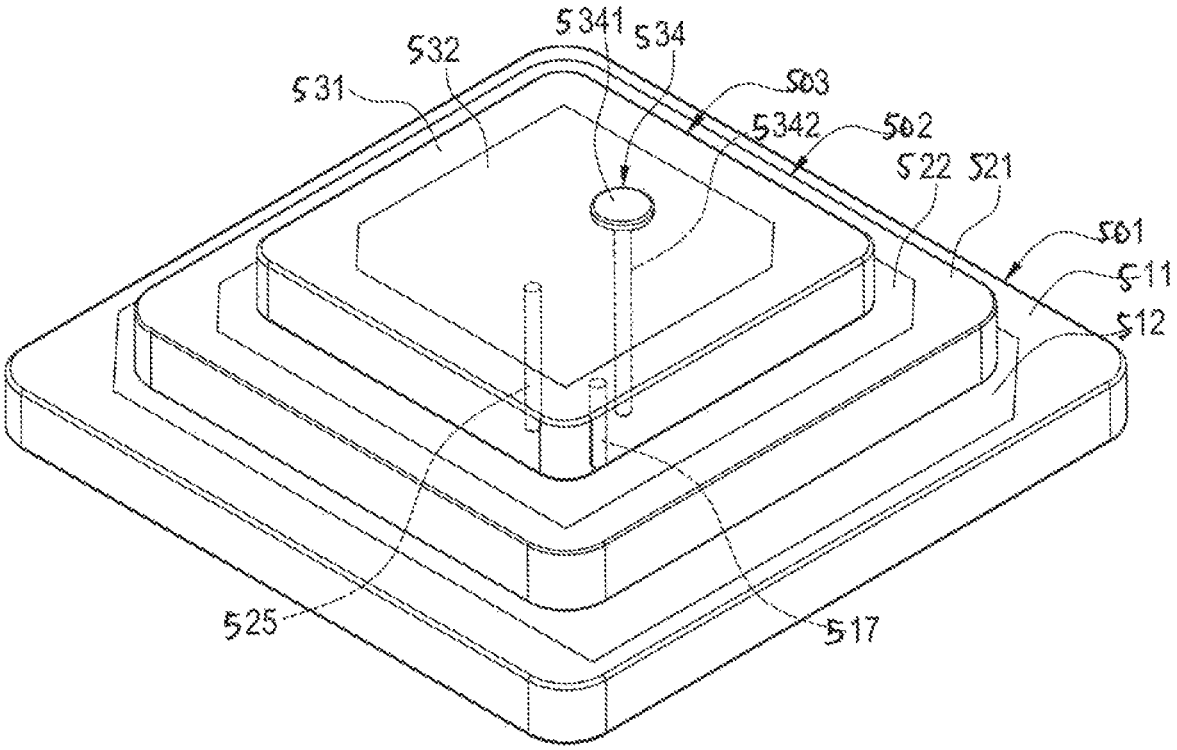
FIG. 27 shows an assembly drawing of the three-feed-in-and-three-stack antenna structure of the present invention.
Figure 28:
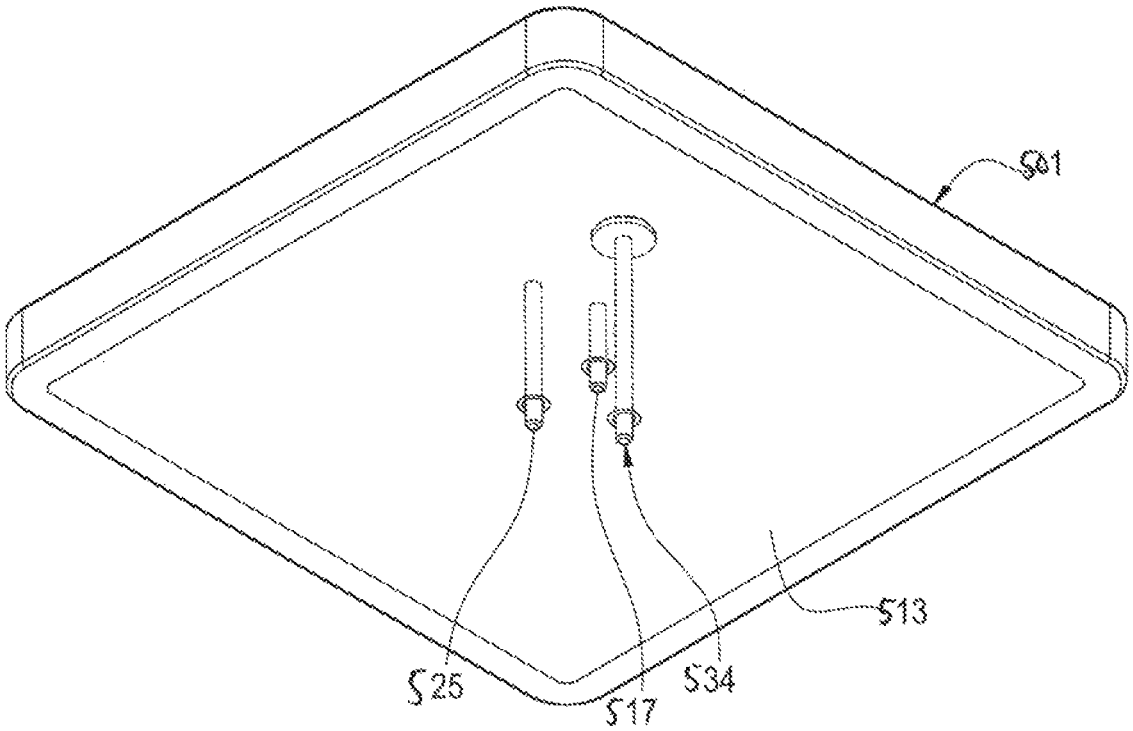
FIG. 28 shows an upward view of the three-feed-in-and-three-stack antenna structure of the present invention.
Figure 29:
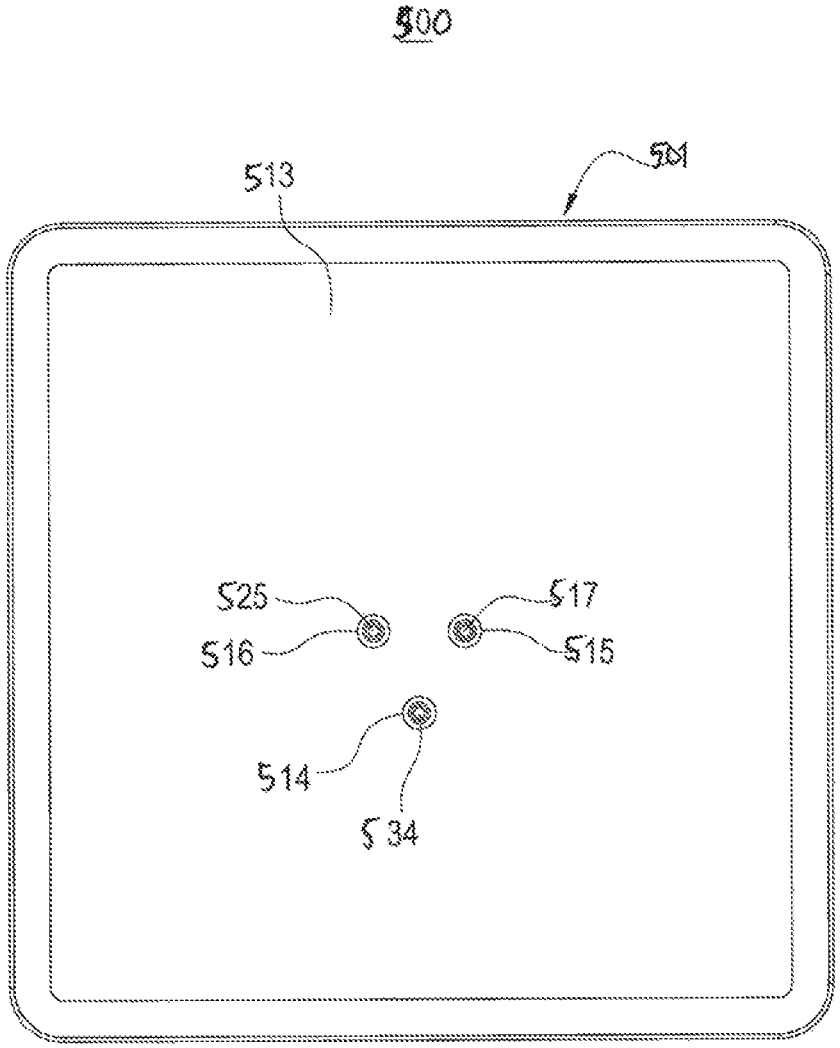
FIG. 29 shows the bottom surface of the first-base body of the present invention.

FIG. 26 shows an exploded view of the three-feed-in-and-three-stack antenna structure of the present invention. FIG. 27 shows an assembly drawing of the three-feed-in-and-three-stack antenna structure of the present invention. FIG. 28 shows an upward view of the three-feed-in-and-three-stack antenna structure of the present invention. FIG. 29 shows the bottom surface of the first-base body of the present invention. As shown in FIGS. 26-29, a three-feed-in-and-three-stack antenna structure 500 of the present invention comprises a first antenna 501, a second antenna 502 and a third antenna 503. Moreover, the first antenna 501, the second antenna 502 and the third antenna 503 are stacked as the three-feed-in-and-three-stack antenna structure 500 which is nearly cone-shaped. The three-feed-in-and-three-stack antenna structure 500 is formed to be able to receive different communication system signals having different frequencies.

The first antenna 501 comprises a first-base body 511, a first-radiation-metal layer 512, a grounded-metal layer 513 and a first-feed-in component 517. The first-radiation-metal layer 512 is arranged on a surface of the first-base body 511. The grounded-metal layer 513 is arranged on a bottom surface of the first-base body 511. The first-base body 511 sets up (namely, defines) a first-through hole 514, a second-through hole 515 and a third-through hole 516. The first-through hole 514, the second-through hole 515 and the third-through hole 516 are through the first-base body 511, the first-radiation-metal layer 512 and the grounded-metal layer 513. The first-feed-in component 517 breaks through the first-base body 511 through the second-through hole 515, and the first-feed-in component 517 is electrically connected to the first-radiation-metal layer 512. The first-feed-in component 517 is not electrically connected to the grounded-metal layer 513 after the first-feed-in component 517 is through the bottom surface of the first-base body 511 to be outside the bottom surface of the first-base body 511. In FIGS. 26-29, the first-base body 511 is a flat plate-type body or a block-shaped body made of ceramic dielectric materials.

The second antenna 502 comprises a second-base body 521, a second-radiation-metal layer 522 and a second-feed-in component 525. The second-base body 521 is arranged on a surface of the first-radiation-metal layer 512 on the first-base body 511. An area of the second-base body 521 is smaller than an area of the first-radiation-metal layer 512. The first-radiation-metal layer 512 is exposed when the second-base body 521 is arranged on the surface of the first-radiation-metal layer 512. Moreover, the second-radiation-metal layer 522 is arranged on a surface of the second-base body 521. The second-base body 521 sets up (namely, defines) a fourth-through hole 523 and a fifth-through hole 524. The fourth-through hole 523 and the fifth-through hole 524 are through the second-base body 521 and the second-radiation-metal layer 522. The fourth-through hole 523 and the fifth-through hole 524 are corresponding to the first-through hole 514 and the third-through hole 516 of the first-base body 511 respectively. After the second-feed-in component 525 is through the fifth-through hole 524 and is electrically connected to the second-radiation-metal layer 522, the second-feed-in component 525 is through the third-through hole 516 to be extended outside the bottom surface of the first-base body 511, and the second-feed-in component 525 is not electrically connected to the grounded-metal layer 513. In FIGS. 26-29, the second-base body 521 is a flat plate-type body or a block-shaped body made of ceramic dielectric materials.

The third antenna 503 comprises a third-base body 531, a third-radiation-metal layer 532 and a third-feed-in component 534. The third-base body 531 is arranged on a surface of the second-radiation-metal layer 522 on the second-base body 521. An area of the third-base body 531 is smaller than an area of the second-radiation-metal layer 522. The second-radiation-metal layer 522 is exposed when the third-base body 531 is arranged on the surface of the second-radiation-metal layer 522. Moreover, the third-radiation-metal layer 532 is arranged on a surface of the third-base body 531. The third-base body 531 sets up (namely, defines) a sixth-through hole 533. The sixth-through hole 533 is through the third-base body 531 and the third-radiation-metal layer 532. The sixth-through hole 533 is corresponding to the fourth-through hole 523 of the second-base body 521 and the first-through hole 514 of the first-base body 511. The third-feed-in component 534 is in a T shape. The third-feed-in component 534 comprises a head 5341 and a shaft 5342. The head 5341 is extended to the shaft 5342. The shaft 5342 is through the sixth-through hole 533 of the third-base body 531, the fourth-through hole 523 of the second-base body 521 and the first-through hole 514 of the first-base body 511 to be outside the bottom surface of the first-base body 511. The third-feed-in component 534 is electrically connected to the third-radiation-metal layer 532 when the third-feed-in component 534 is through the sixth-through hole 533. The third-feed-in component 534 is not electrically connected to the grounded-metal layer 513 when the third-feed-in component 534 is through the bottom surface of the first-base body 511 to be outside the bottom surface of the first-base body 511. In FIGS. 26-29, the third-base body 531 is a flat plate-type body or a block-shaped body made of ceramic dielectric materials.

Figure 30:
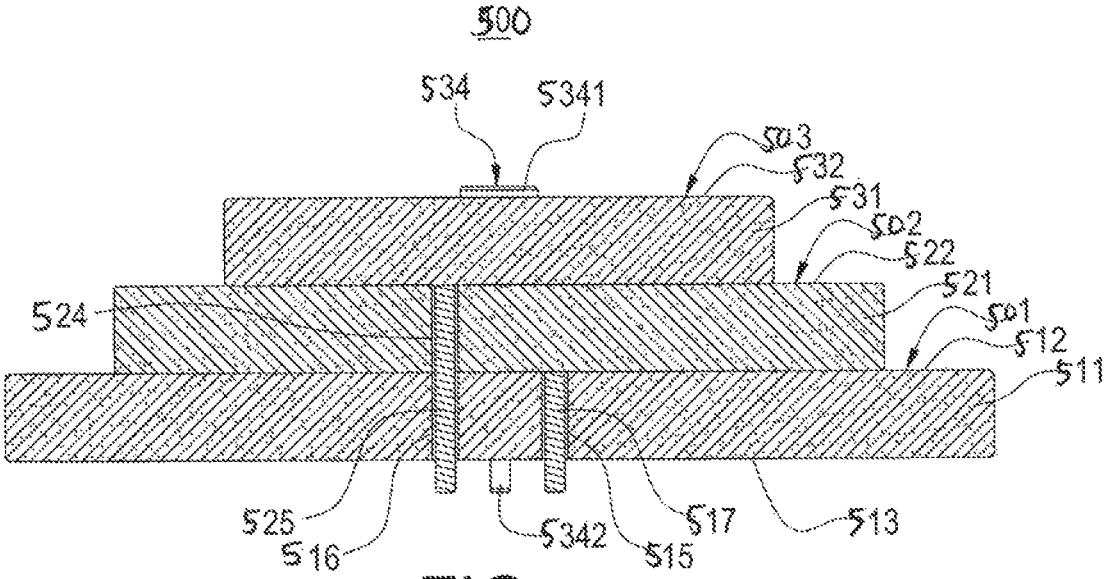
FIG. 30 shows a side-sectional view of the three-feed-in-and-three-stack antenna structure of the present invention.
Figure 31:
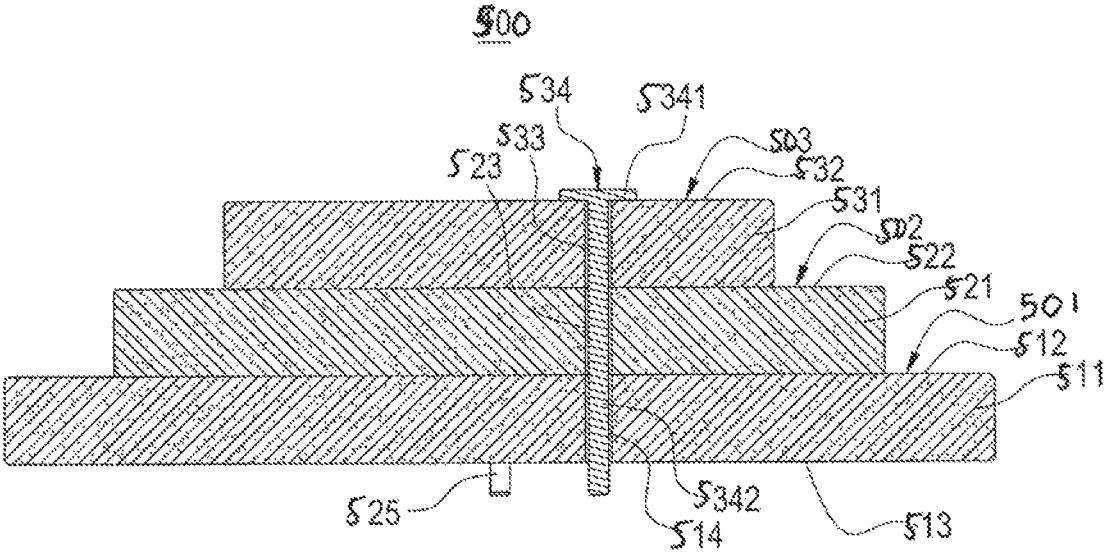
FIG. 31 shows another side-sectional view of the three-feed-in-and-three-stack antenna structure of the present invention.

FIG. 30 shows a side-sectional view of the three-feed-in-and-three-stack antenna structure of the present invention. FIG. 31 shows another side-sectional view of the three-feed-in-and-three-stack antenna structure of the present invention. As shown in FIGS. 30-31, after the first-base body 511, the second-base body 521 and the third-base body 531 of the present invention are stacked orderly, the first-feed-in component 517 is through the second-through hole 515 of the first-base body 511, and the second-feed-in component 525 is through the fifth-through hole 524 of the second-base body 521 and the third-through hole 516 of the first-base body 511, and the third-feed-in component 534 is through the sixth-through hole 533 of the third-base body 531, the fourth-through hole 523 of the second-base body 521 and the first-through hole 514 of the first-base body 511, to form the three-feed-in-and-three-stack antenna structure 500.

Figure 32:
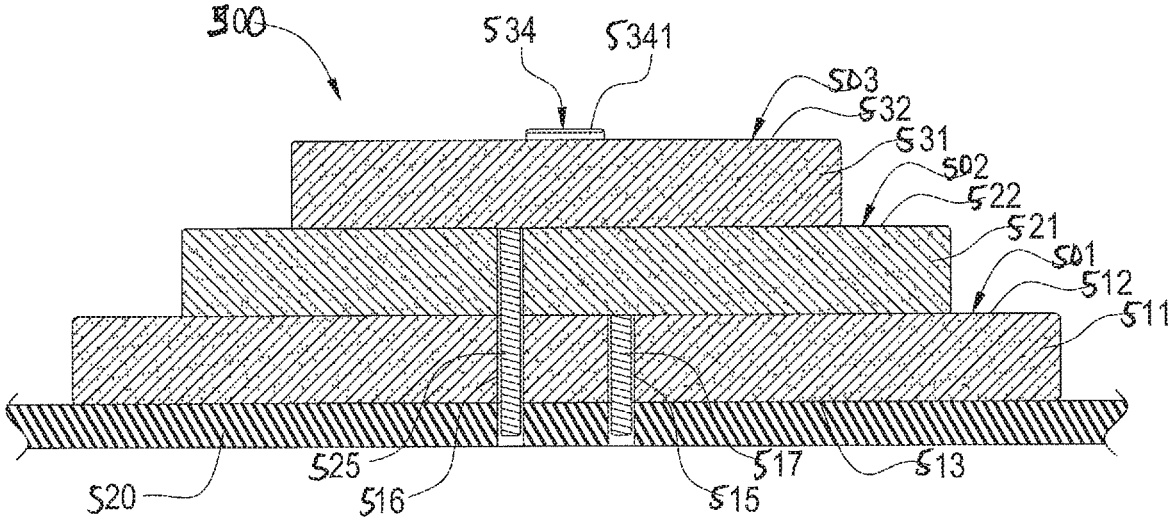
FIG. 32 shows that the three-feed-in-and-three-stack antenna structure of the present invention is electrically connected to a circuit board of an electronic equipment.

FIG. 32 shows that the three-feed-in-and-three-stack antenna structure of the present invention is electrically connected to a circuit board of an electronic equipment. In the present invention, after the first antenna 501, the second antenna 502 and the third antenna 503 are stacked, the first-feed-in component 517, the second-feed-in component 525 and the third-feed-in component 534 are electrically connected to a circuit board 520 of an electronic equipment. The first antenna 501 forms to be able to receive GPS L5/L2 signals with frequencies 1100 MHz~1250 MHz. The second antenna 502 forms to be able to receive GPS/GNSS/BeiDou signals with frequencies 1500 MHz~1650 MHz. The third antenna 503 forms to be able to receive SDARS/WLAN signals with frequencies 2300 MHz~2500 MHz.

Because the three-feed-in-and-three-stack antenna structure 500 is electrically connected to (and arranged on) the circuit board 520 of the electronic equipment to be able to receive different wireless communication system signals with different frequencies, when the three-feed-in-and-three-stack antenna structure 500 is integrated with the electronic equipment to be used, neither the volume of the electronic equipment nor the area of the electronic equipment becomes larger.

Figure 33:
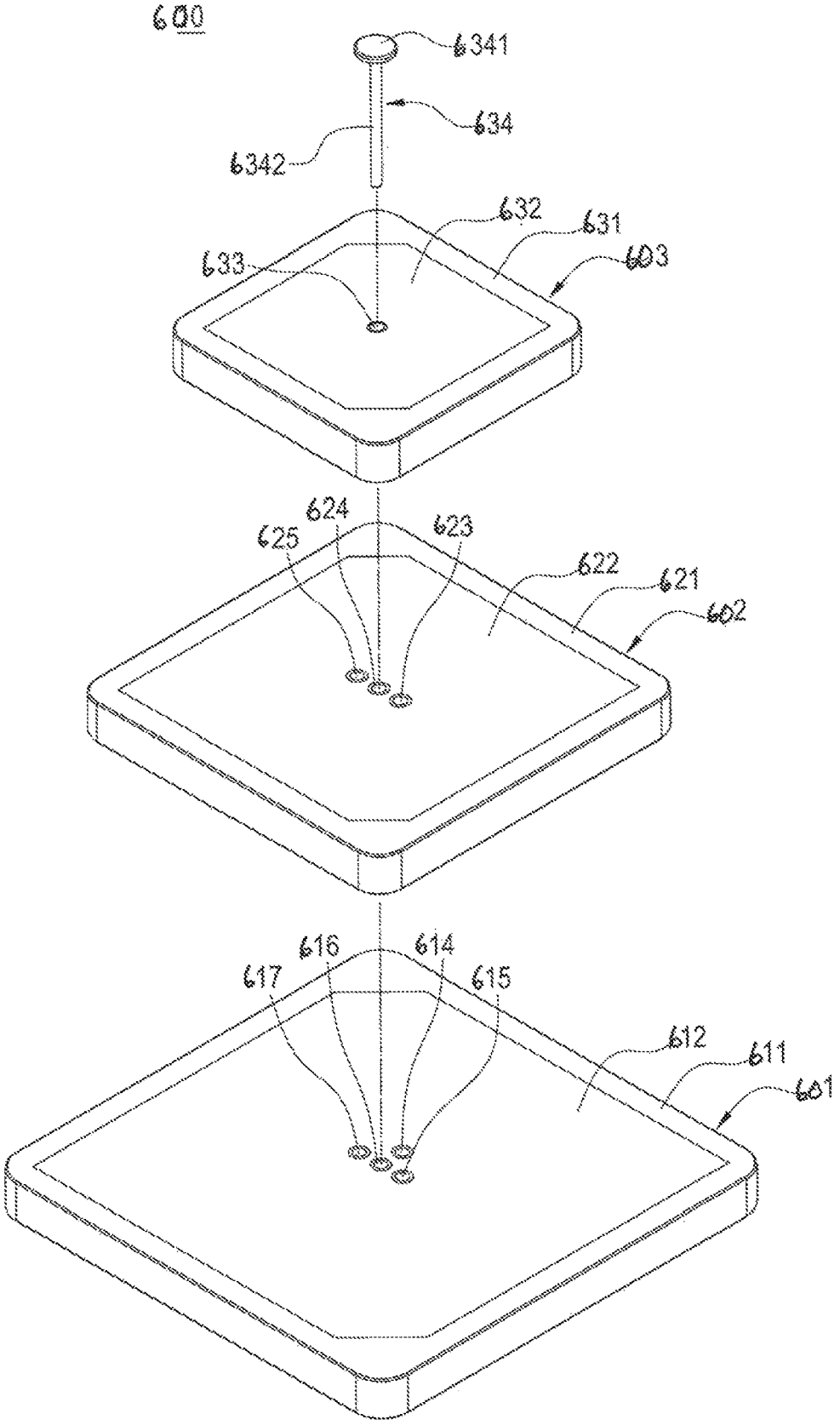
FIG. 33 shows an exploded view of the first embodiment of the four-hole-and-three-stack antenna structure of the present invention.
Figure 34:
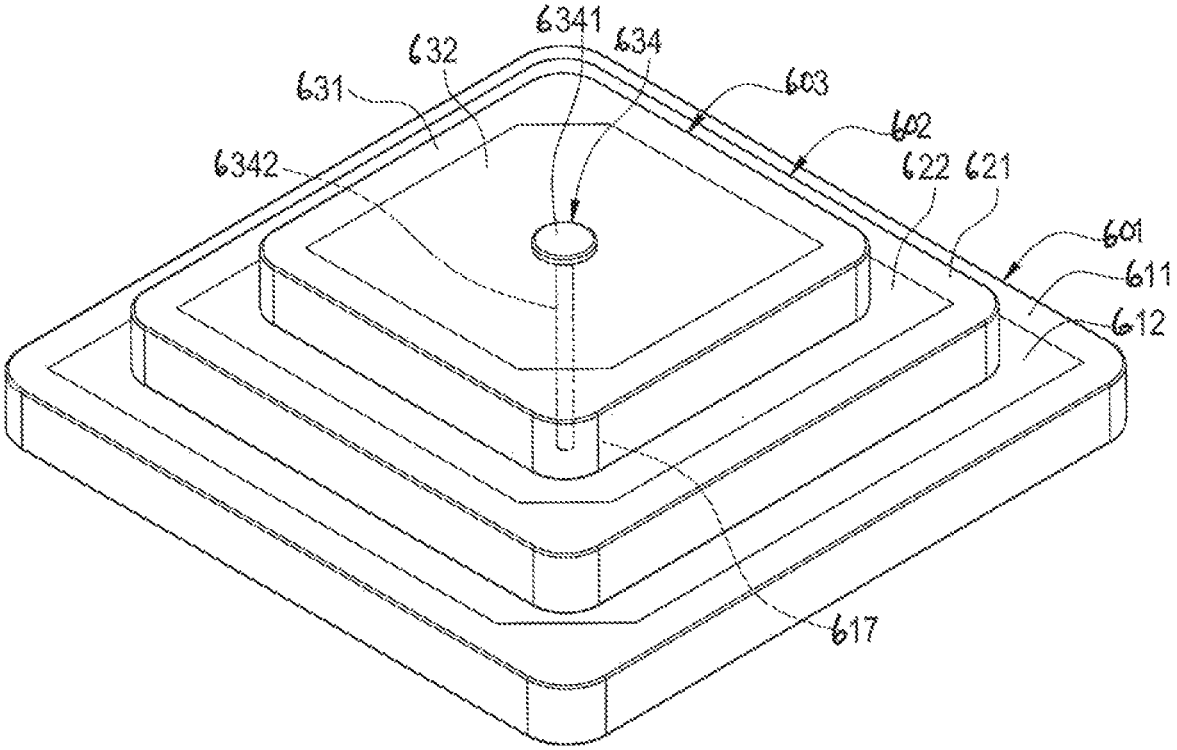
FIG. 34 shows an assembly drawing of the first embodiment of the four-hole-and-three-stack antenna structure of the present invention.
Figure 35:
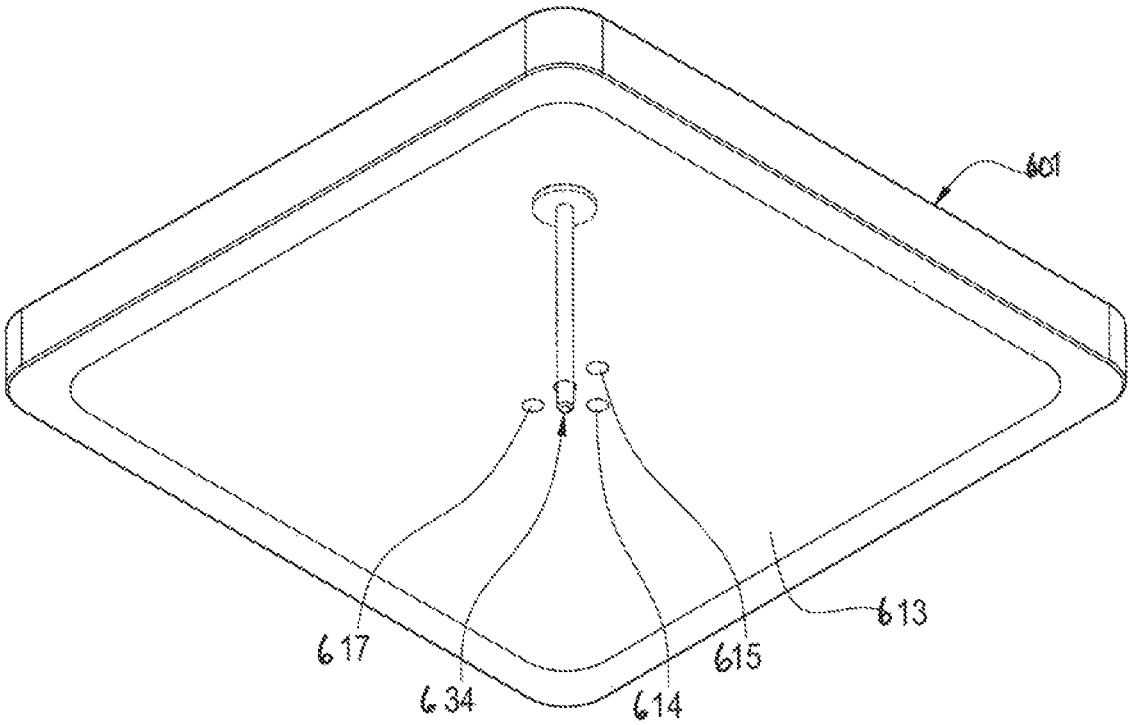
FIG. 35 shows an upward view of the first embodiment of the four-hole-and-three-stack antenna structure of the present invention.
Figure 36:
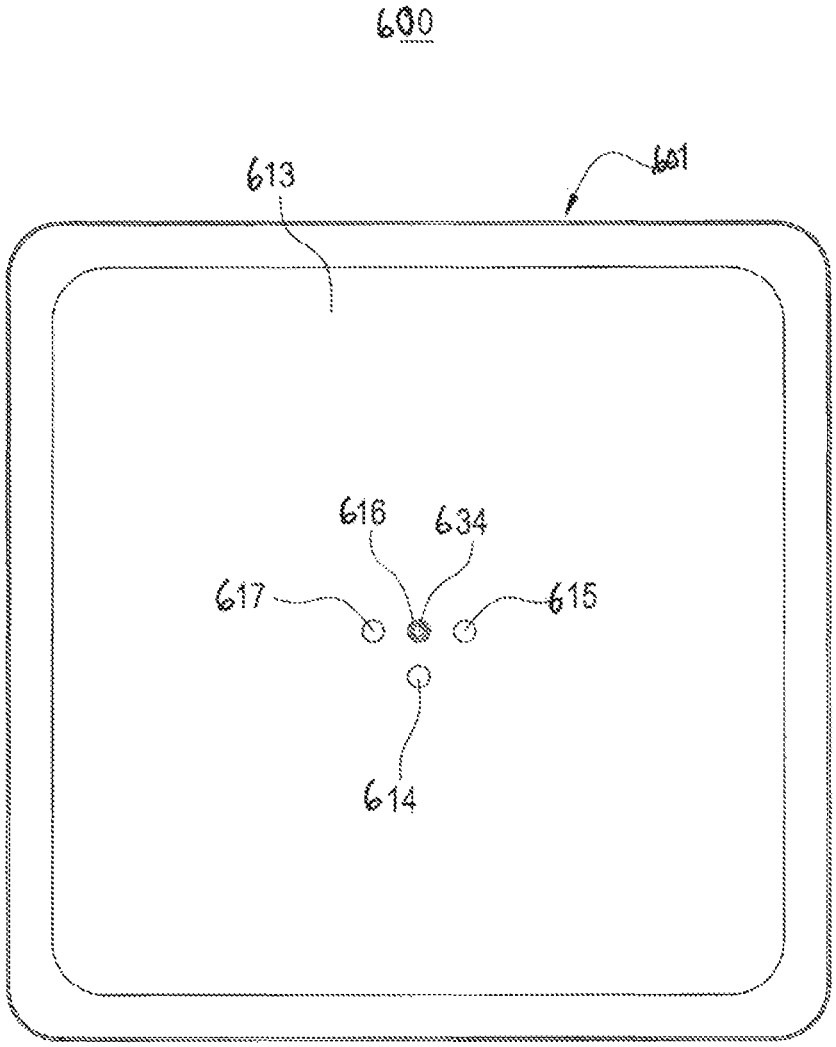
FIG. 36 shows the bottom surface of the first-base body of the present invention.

FIG. 33 shows an exploded view of the first embodiment of the four-hole-and-three-stack antenna structure of the present invention. FIG. 34 shows an assembly drawing of the first embodiment of the four-hole-and-three-stack antenna structure of the present invention. FIG. 35 shows an upward view of the first embodiment of the four-hole-and-three-stack antenna structure of the present invention. FIG. 36 shows the bottom surface of the first-base body of the present invention. As shown in FIGS. 33-36, a four-hole-and-three-stack antenna structure 600 of the present invention comprises a first antenna 601, a second antenna 602 and a third antenna 603. Moreover, the first antenna 601, the second antenna 602 and the third antenna 603 are stacked as the four-hole-and-three-stack antenna structure 600 which is nearly cone-shaped. The four-hole-and-three-stack antenna structure 600 is formed to be able to receive different communication system signals having different frequencies.

The first antenna 601 comprises a first-base body 611, a first-radiation-metal layer 612 and a grounded-metal layer 613. The first-radiation-metal layer 612 is arranged on a surface of the first-base body 611. The grounded-metal layer 613 is arranged on a bottom surface of the first-base body 611. The first-base body 611 sets up (namely, defines) a first-through hole 614, a second-through hole 615, a third-through hole 616, and a fourth-through hole 617. The first-through hole 614, the second-through hole 615, the third-through hole 616, and the fourth-through hole 617 are through the first-base body 611, the first-radiation-metal layer 612 and the grounded-metal layer 613. In FIGS. 33-36, the first-base body 611 is a flat plate-type body or a block-shaped body made of ceramic dielectric materials.

The second antenna 602 comprises a second-base body 621 and a second-radiation-metal layer 622. The second-base body 621 is arranged on a surface of the first-radiation-metal layer 612 on the first-base body 611. An area of the second-base body 621 is smaller than an area of the first-radiation-metal layer 612. The first-radiation-metal layer 612 is exposed when the second-base body 621 is arranged on the surface of the first-radiation-metal layer 612. Moreover, the second-radiation-metal layer 622 is arranged on a surface of the second-base body 621. The second-base body 621 is configured to set up (namely, define) a fifth-through hole 623, a sixth-through hole 624 and a seventh-through hole 625. The fifth-through hole 623, the sixth-through hole 624 and the seventh-through hole 625 are through the second-base body 621 and the second-radiation-metal layer 622. The fifth-through hole 623, the sixth-through hole 624 and the seventh-through hole 625 are corresponding to the second-through hole 615, the third-through hole 616 and the fourth-through hole 617 of the first-base body 611 respectively. In FIGS. 33-36, the second-base body 621 is a flat plate-type body or a block-shaped body made of ceramic dielectric materials.

The third-antenna 603 comprises a third-base body 631, a third-radiation-metal layer 632 and a first-feed-in component 634. The third-base body 631 is arranged on a surface of the second-radiation-metal layer 622 on the second-base body 621. An area of the third-base body 631 is smaller than an area of the second-radiation-metal layer 622. The second-radiation-metal layer 622 is exposed when the third-base body 631 is arranged on the surface of the second-radiation-metal layer 622. Moreover, the third-radiation-metal layer 632 is arranged on a surface of the third-base body 631. The third-base body 631 is configured to set up (namely, define) an eighth-through hole 633. The eighth-through hole 633 is through the third-base body 631 and the third-radiation-metal layer 632. The eighth-through hole 633 is corresponding to the sixth-through hole 624 of the second-base body 621 and the third-through hole 616 of the first-base body 611.

The first-feed-in component 634 is in a T shape. The first-feed-in component 634 comprises a head 6341 and a shaft 6342. The head 6341 is extended to the shaft 6342. The shaft 6342 is through the eighth-through hole 633 of the third-base body 631, the sixth-through hole 624 of the second-base body 621 and the third-through hole 616 of the first-base body 611 to be outside the bottom surface of the first-base body 611. The first-feed-in component 634 is electrically connected to the third-radiation-metal layer 632 when the first-feed-in component 634 is through the eighth-through hole 633. The first-feed-in component 634 is coupled to and connected to the second-radiation-metal layer 622 when the first-feed-in component 634 is through the second-base body 621. The first-feed-in component 634 is coupled to and connected to the first-radiation-metal layer 612 on the first-base body 611 when the first-feed-in component 634 is through the third-through hole 616. The first-feed-in component 634 is not electrically connected to the grounded-metal layer 613 (namely, the first-feed-in component 634 fails to electrically connect to the grounded-metal layer 613) when the first-feed-in component 634 is through the bottom surface of the first-base body 611 to be outside the bottom surface of the first-base body 611. In FIGS. 33-36, the third-base body 631 is a flat plate-type body or a block-shaped body made of ceramic dielectric materials.

Figure 37:
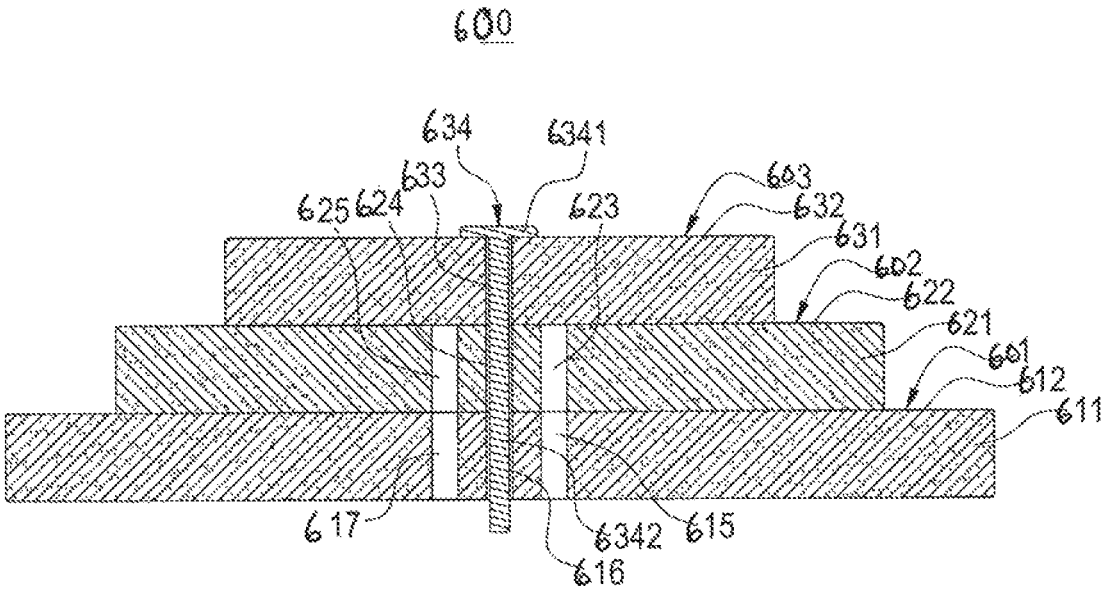
FIG. 37 shows a side-sectional view of the first embodiment of the four-hole-and-three-stack antenna structure of the present invention.

FIG. 37 shows a side-sectional view of the first embodiment of the four-hole-and-three-stack antenna structure of the present invention. As shown in FIG. 37, after the first antenna 601, the second antenna 602 and the third antenna 603 of the present invention are stacked orderly, the first-feed-in component 634 is through the eighth-through hole 633 and is electrically connected to the third-radiation-metal layer 632. The first-feed-in component 634 is coupled to and connected to the second-radiation-metal layer 622 when the first-feed-in component 634 is through the second-base body 621. The first-feed-in component 634 is coupled to and connected to the first-radiation-metal layer 612 on the first-base body 611 when the first-feed-in component 634 is through the third-through hole 616. The first-feed-in component 634 is not electrically connected to the grounded-metal layer 613 (namely, the first-feed-in component 634 fails to electrically connect to the grounded-metal layer 613) when the first-feed-in component 634 is through the bottom surface of the first-base body 611 to be outside the bottom surface of the first-base body 611. The four-hole-and-three-stack antenna structure 600 with a single feed-in is formed, wherein looking at the bottom surface of the first antenna 601, there are four holes.

Figure 38:
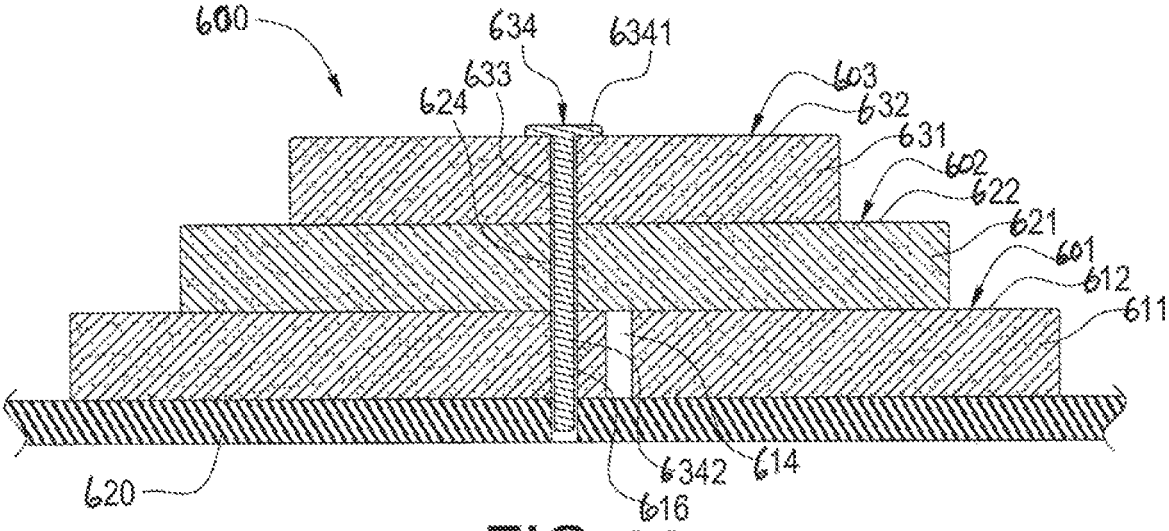
FIG. 38 shows the first embodiment that the four-hole-and-three-stack antenna structure of the present invention is electrically connected to a circuit board of an electronic equipment.

FIG. 38 shows the first embodiment that the four-hole-and-three-stack antenna structure of the present invention is electrically connected to a circuit board of an electronic equipment. After the first antenna 601, the second antenna 602 and the third antenna 603 of the present invention are stacked, the first-feed-in component 634 is electrically connected to a circuit board 620 of an electronic equipment (not shown in FIG. 38). The first-radiation-metal layer 612 (of the first antenna 601) and the first-feed-in component 634 form a coupling connection to be able to receive, for example, GPS L5/L2 signals with frequencies 1100 MHz~1250 MHz. The second-radiation-metal layer 622 (of the second antenna 602) and the first-feed-in component 634 form a coupling connection to be able to receive, for example, GPS/GNSS/BeiDou signals with frequencies 1500 MHz~1650 MHz. The third-radiation-metal layer 632 (of the third antenna 603) is electrically connected to the first-feed-in component 634 to be able to receive, for example, SDARS/WLAN signals with frequencies 2300 MHz~2500 MHz.

Because the four-hole-and-three-stack antenna structure 600 is electrically connected to (and arranged on) the circuit board 620 of the electronic equipment to be able to receive different wireless communication system signals with different frequencies, when the four-hole-and-three-stack antenna structure 600 is integrated with the electronic equipment to be used, neither the volume of the electronic equipment nor the area of the electronic equipment becomes larger.

Figure 39:
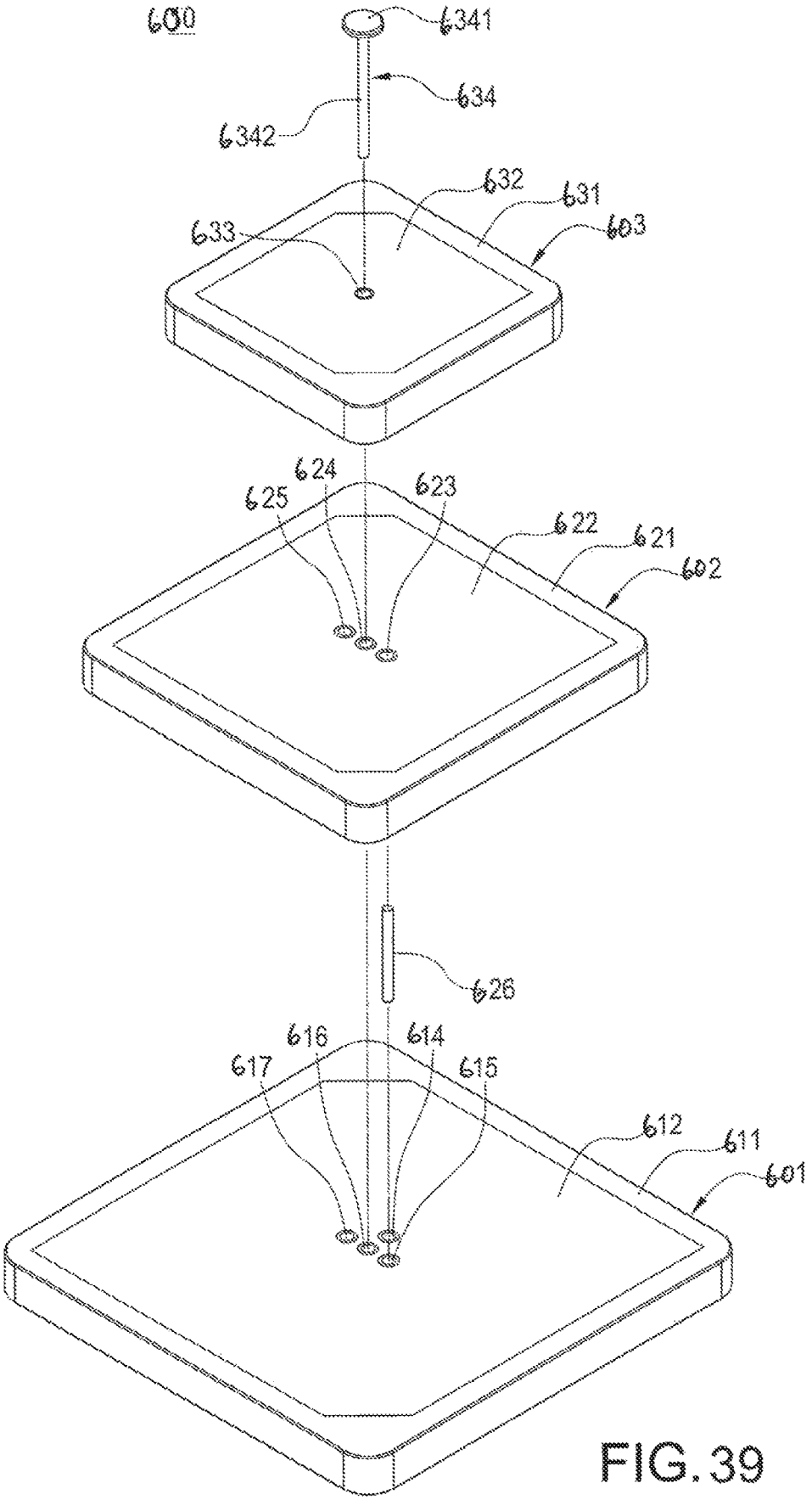
FIG. 39 shows an exploded view of the second embodiment of the four-hole-and-three-stack antenna structure of the present invention.

FIG. 39 shows an exploded view of the second embodiment of the four-hole-and-three-stack antenna structure of the present invention. As shown in FIG. 39, the second embodiment is basically similar with the first embodiment. The difference is that the second embodiment comprises a second-feed-in component 626. The second-feed-in component 626 is through the fifth-through hole 623 of the second-base body 621 and is electrically connected to the second-radiation-metal layer 622, and then is through the second-through hole 615 of the first-base body 611 and is coupled to and connected to the first-radiation-metal layer 612. The four-hole-and-three-stack antenna structure 600 with two feed-ins is formed.

Figure 40:
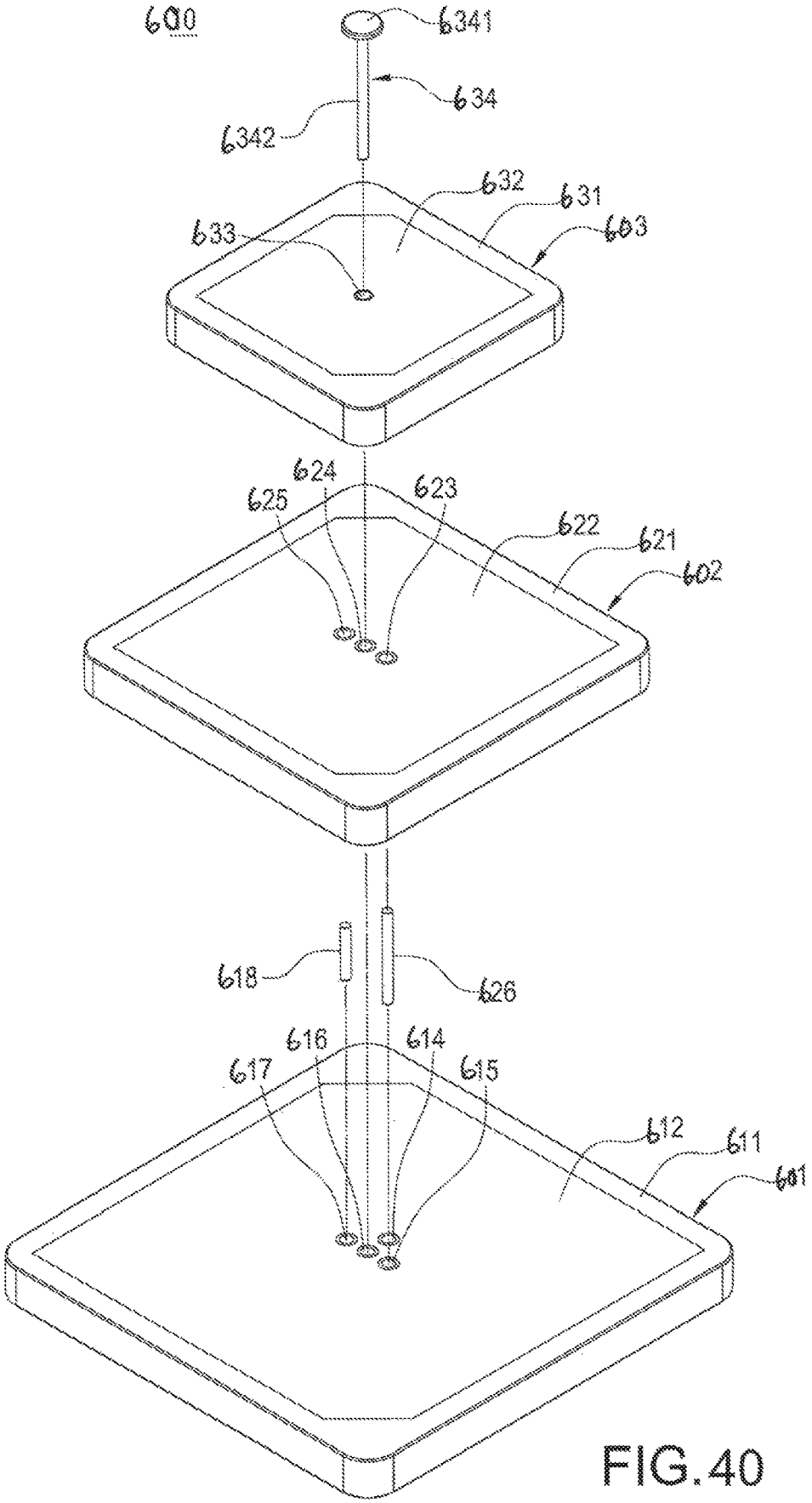
FIG. 40 shows an exploded view of the third embodiment of the four-hole-and-three-stack antenna structure of the present invention.

FIG. 40 shows an exploded view of the third embodiment of the four-hole-and-three-stack antenna structure of the present invention. As shown in FIG. 40, the third embodiment is basically similar with the second embodiment. The difference is that the third embodiment comprises a third-feed-in component 618. The third-feed-in component 618 is through the fourth-through hole 617 of the first-base body 611 and is electrically connected to the first-radiation-metal layer 612. The four-hole-and-three-stack antenna structure 600 with three feed-ins is formed.

Figure 41:
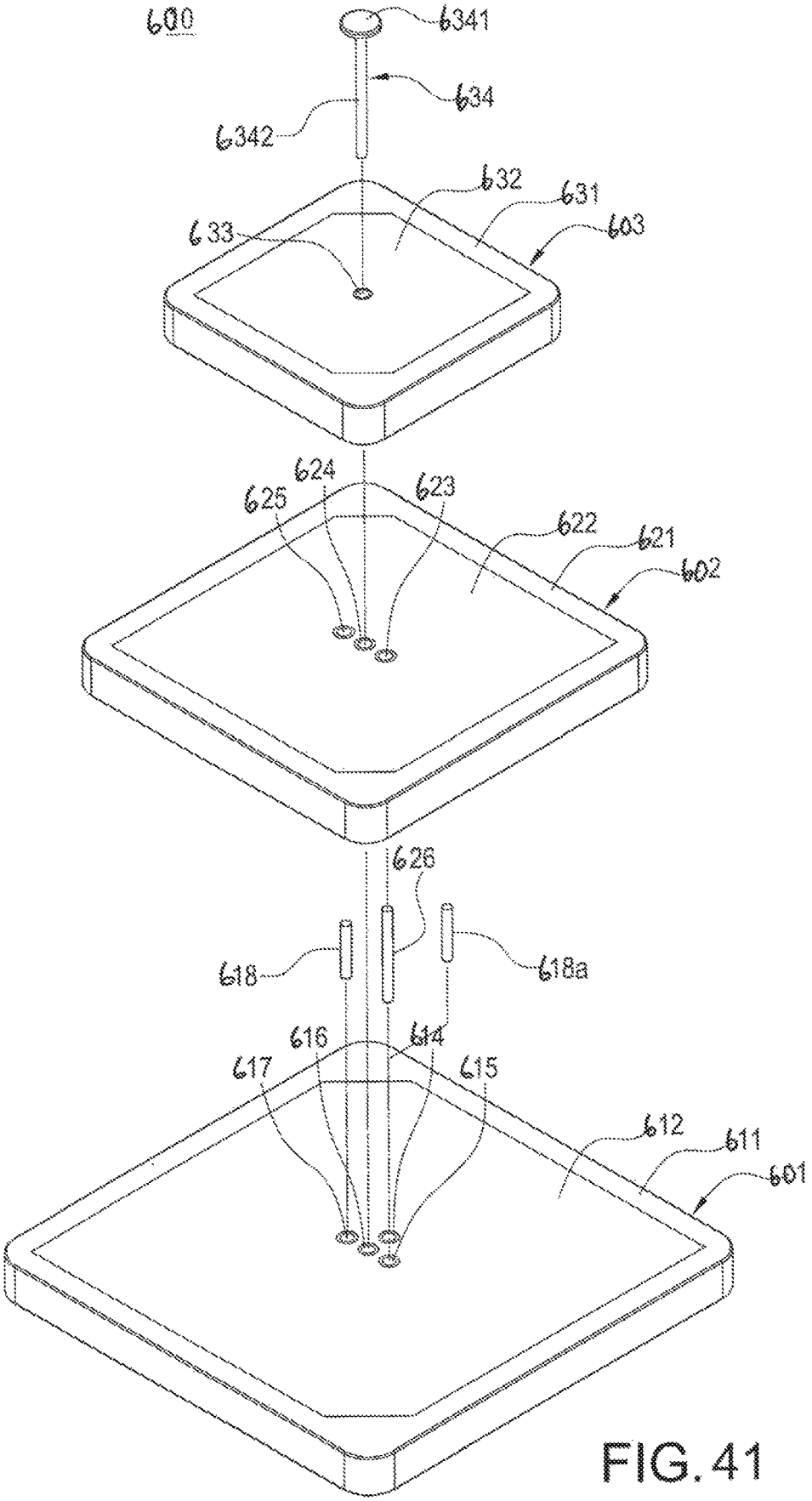
FIG. 41 shows an exploded view of the fourth embodiment of the four-hole-and-three-stack antenna structure of the present invention.

FIG. 41 shows an exploded view of the fourth embodiment of the four-hole-and-three-stack antenna structure of the present invention. As shown in FIG. 41, the fourth embodiment is basically similar with the third embodiment. The difference is that the fourth embodiment comprises two third-feed-in components 618. The two third-feed-in components 618*a* are through the fourth-through hole 617 and the first-through hole 614 of the first-base body 611 and are electrically connected to the first-radiation-metal layer 612. The four-hole-and-three-stack antenna structure 600 with four feed-ins is formed.

Figure 42:
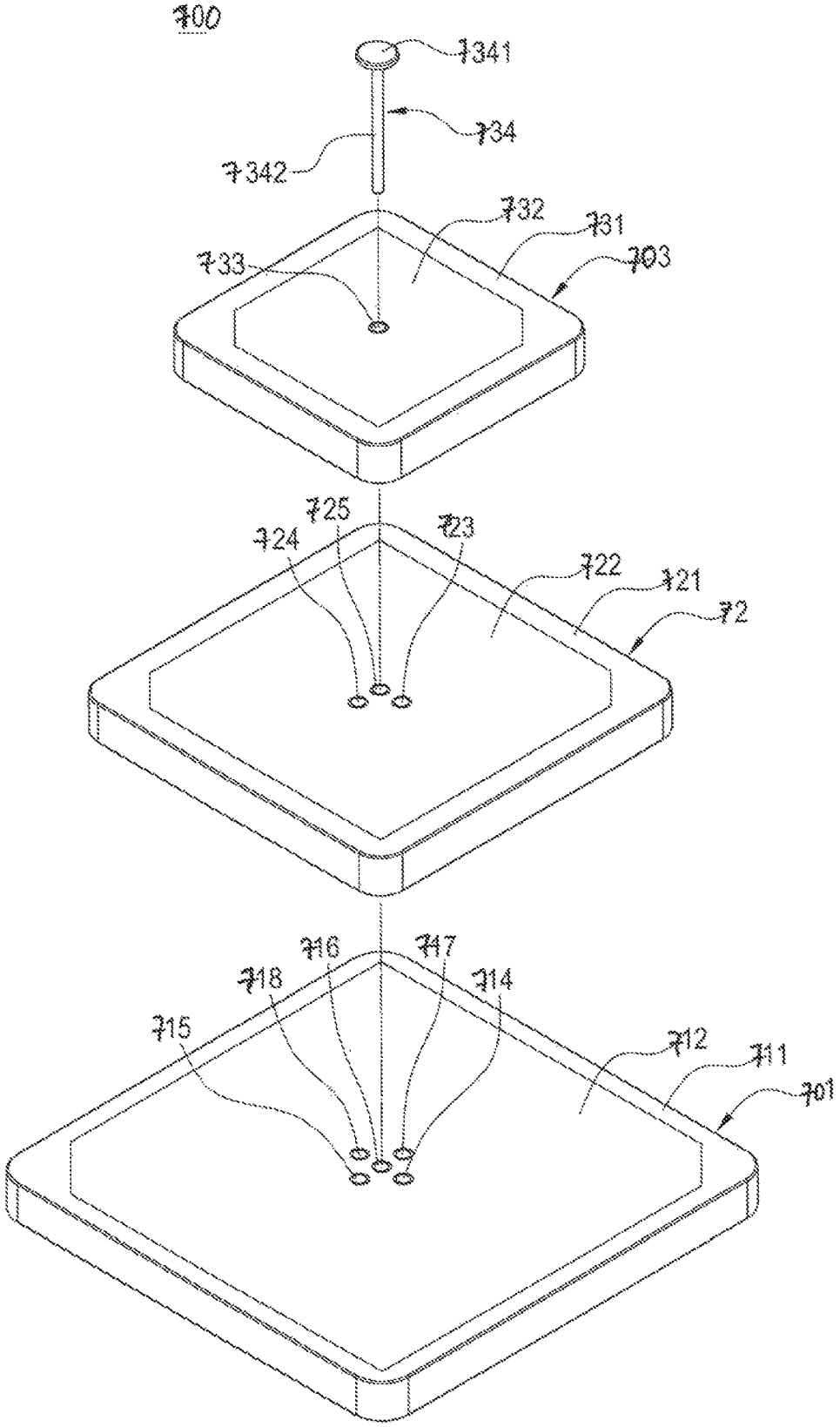
FIG. 42 shows an exploded view of the first embodiment of the five-hole-and-three-stack antenna structure of the present invention.
Figure 43:
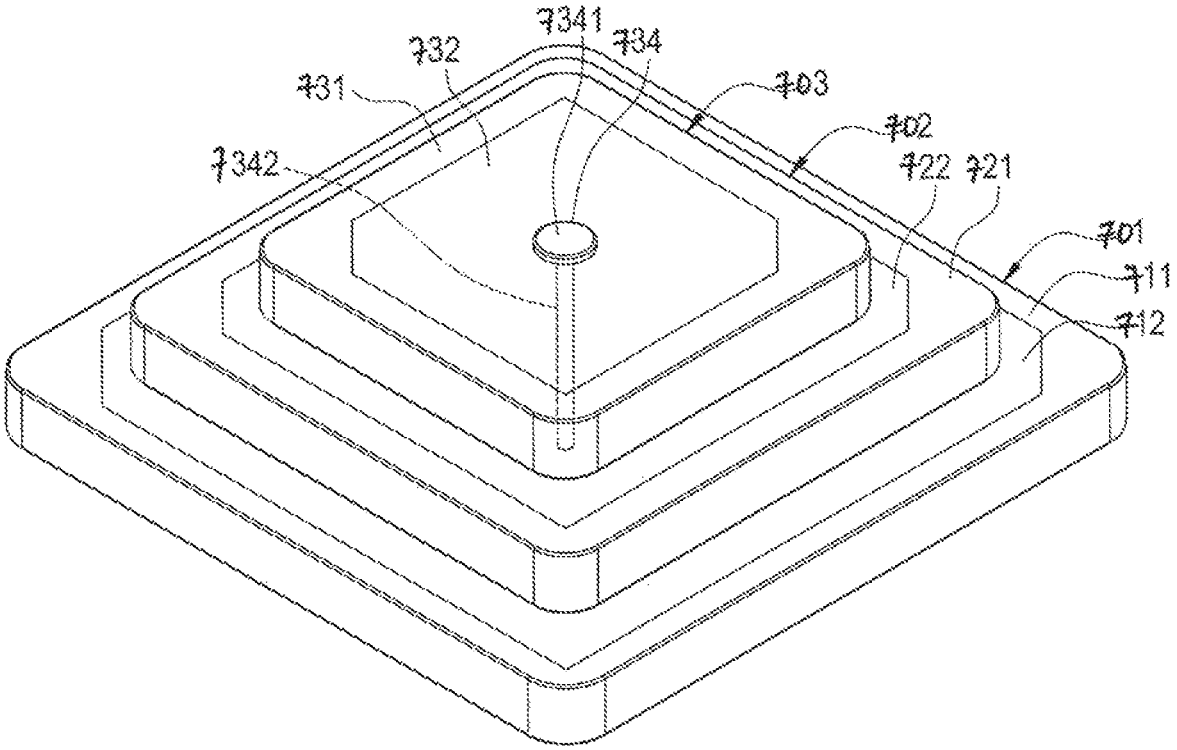
FIG. 43 shows an assembly drawing of the first embodiment of the five-hole-and-three-stack antenna structure of the present invention.
Figure 44:
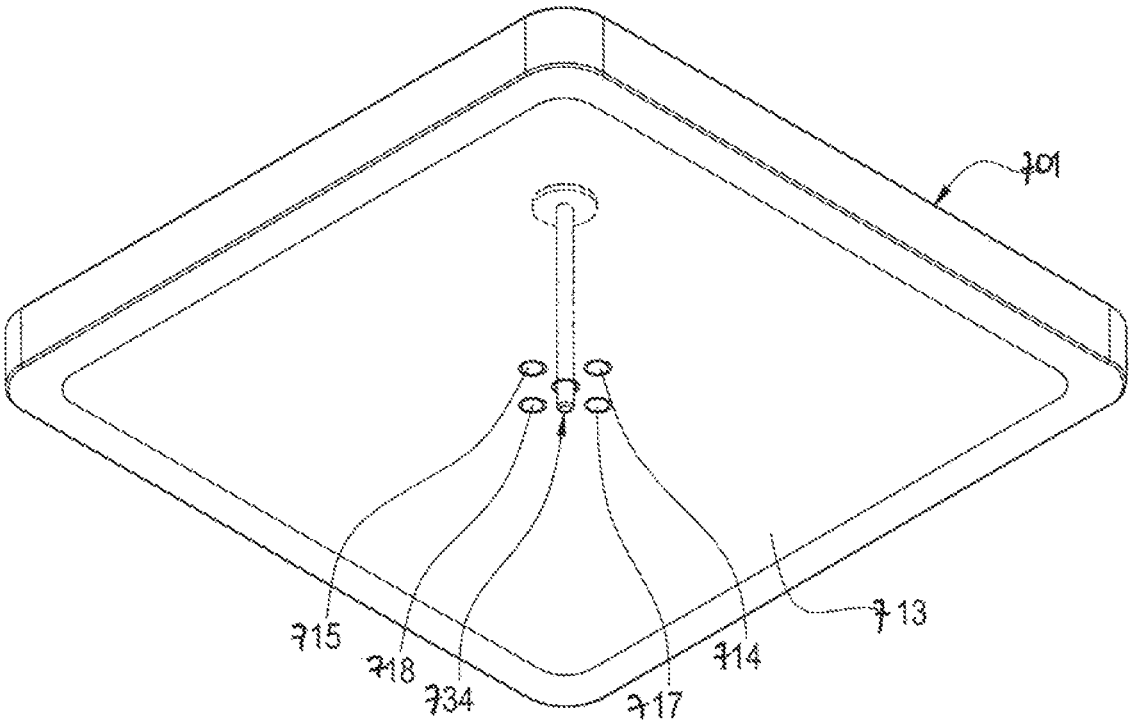
FIG. 44 shows an upward view of the first embodiment of the five-hole-and-three-stack antenna structure of the present invention.
Figure 45:
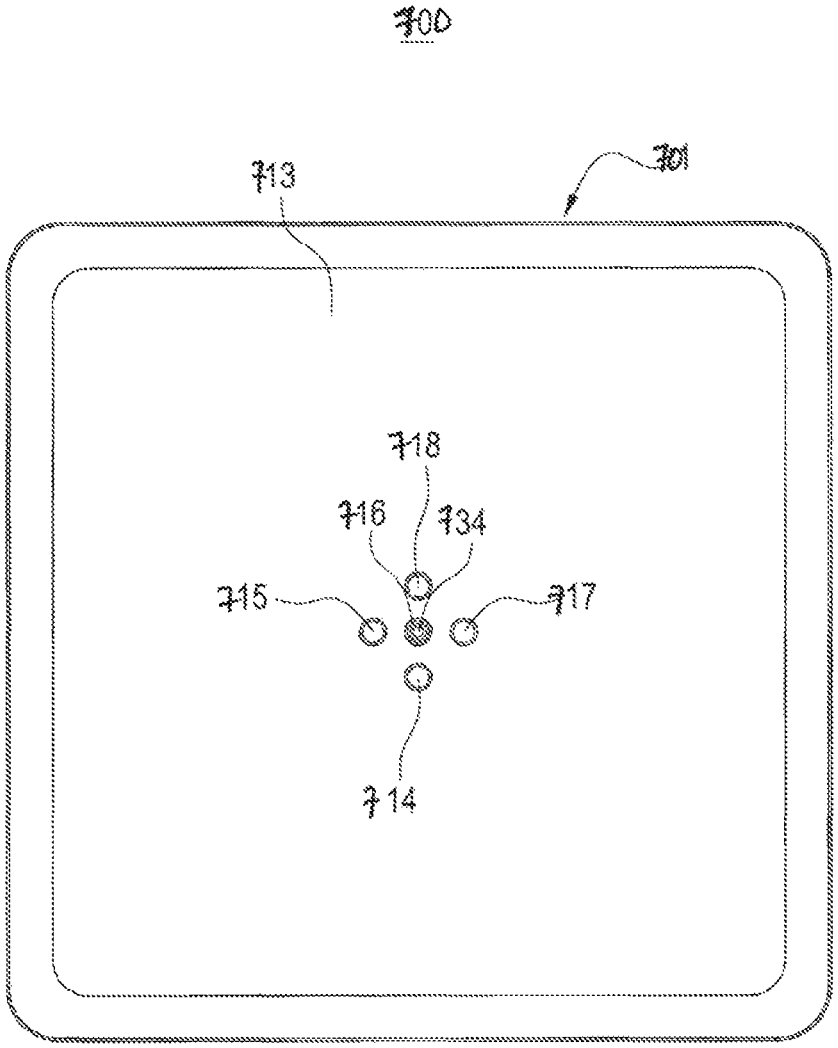
FIG. 45 shows the bottom surface of the first-base body of the present invention.

FIG. 42 shows an exploded view of the first embodiment of the five-hole-and-three-stack antenna structure of the present invention. FIG. 43 shows an assembly drawing of the first embodiment of the five-hole-and-three-stack antenna structure of the present invention. FIG. 44 shows an upward view of the first embodiment of the five-hole-and-three-stack antenna structure of the present invention. FIG. 45 shows the bottom surface of the first-base body of the present invention. As shown in FIGS. 42-45, a five-hole-and-three-stack antenna structure 700 of the present invention comprises a first antenna 701, a second antenna 702 and a third antenna 703. Moreover, the first antenna 701, the second antenna 702 and the third antenna 703 are stacked as the five-hole-and-three-stack antenna structure 700 which is nearly cone-shaped. The five-hole-and-three-stack antenna structure 700 is formed to be able to receive different communication system signals having different frequencies.

The first antenna 701 comprises a first-base body 711, a first-radiation-metal layer 712 and a grounded-metal layer 713. The first-radiation-metal layer 712 is arranged on a surface of the first-base body 711. The grounded-metal layer 713 is arranged on a bottom surface of the first-base body 711. The first-base body 711 sets up (namely, defines) a first-through hole 714, a second-through hole 715, a third-through hole 716, a fourth-through hole 717 and a fifth-through hole 707. The first-through hole 714, the second-through hole 715, the third-through hole 716, the fourth-through hole 717 and the fifth-through hole 707 are through the first-base body 711, the first-radiation-metal layer 712 and the grounded-metal layer 713. In FIGS. 42-45, the first-base body 711 is a flat plate-type body or a block-shaped body made of ceramic dielectric materials.

The second antenna 702 comprises a second-base body 721 and a second-radiation-metal layer 722. The second-base body 721 is arranged on a surface of the first-radiation-metal layer 712 on the first-base body 711. An area of the second-base body 721 is smaller than an area of the first-radiation-metal layer 712. The first-radiation-metal layer 712 is exposed when the second-base body 721 is arranged on the surface of the first-radiation-metal layer 712. Moreover, the second-radiation-metal layer 722 is arranged on a surface of the second-base body 721. The second-base body 721 is configured to set up (namely, define) a sixth-through hole 723, a seventh-through hole 724 and an eighth-through hole 725. The sixth-through hole 723, the seventh-through hole 724 and the eighth-through hole 725 are through the second-base body 721 and the second-radiation-metal layer 722. The sixth-through hole 723, the seventh-through hole 724 and the eighth-through hole 725 are corresponding to the first-through hole 714, the second-through hole 715 and the third-through hole 716 of the first-base body 711 respectively. In FIGS. 42-45, the second-base body 721 is a flat plate-type body or a block-shaped body made of ceramic dielectric materials.

The third-antenna 703 comprises a third-base body 731, a third-radiation-metal layer 732 and a first-feed-in component 734. The third-base body 731 is arranged on a surface of the second-radiation-metal layer 722 on the second-base body 721. An area of the third-base body 731 is smaller than an area of the second-radiation-metal layer 722. The second-radiation-metal layer 722 is exposed when the third-base body 731 is arranged on the surface of the second-radiation-metal layer 722. Moreover, the third-radiation-metal layer 732 is arranged on a surface of the third-base body 731. The third-base body 731 is configured to set up (namely, define) a ninth-through hole 733. The ninth-through hole 733 is through the third-base body 731 and the third-radiation-metal layer 732. The ninth-through hole 733 is corresponding to the eighth-through hole 725 of the second-base body 721 and the third-through hole 716 of the first-base body 711. The first-feed-in component 734 is in a T shape. The third-feed-in component 734 comprises a head 7341 and a shaft 7342. The head 7341 is extended to the shaft 7342. The shaft 7342 is through the ninth-through hole 733 of the third-base body 731, the eighth-through hole 725 of the second-base body 721 and the third-through hole 716 of the first-base body 711 to be outside the bottom surface of the first-base body 711. The first-feed-in component 734 is electrically connected to the third-radiation-metal layer 732 when the first-feed-in component 734 is through the nine-through hole 733. The first-feed-in component 734 is coupled to and connected to the second-radiation-metal layer 722 when the first-feed-in component 734 is through the eighth-through hole 725 of the second-base body 721. The first-feed-in component 734 is coupled to and connected to the first-radiation-metal layer 712 on the first-base body 711 when the first-feed-in component 734 is through the third-through hole 716. The first-feed-in component 734 is not electrically connected to the grounded-metal layer 713 (namely, the first-feed-in component 734 fails to electrically connect to the grounded-metal layer 713) when the first-feed-in component 734 is through the bottom surface of the first-base body 711 to be outside the bottom surface of the first-base body 711. In FIGS. 42-45, the third-base body 731 is a flat plate-type body or a block-shaped body made of ceramic dielectric materials.

Figure 46:
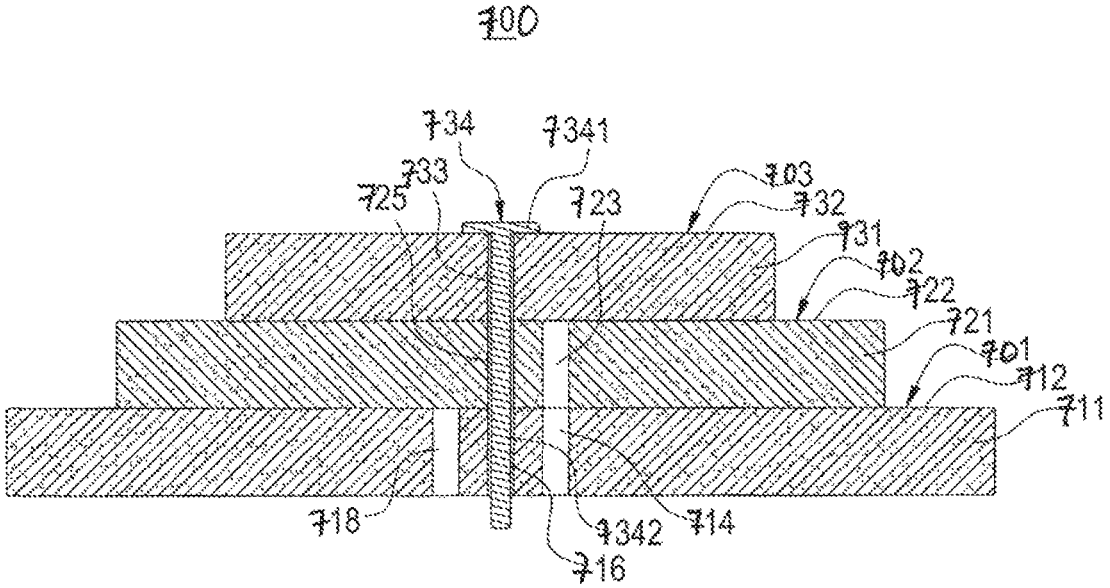
FIG. 46 shows a side-sectional view of the first embodiment of the five-hole-and-three-stack antenna structure of the present invention.

FIG. 46 shows a side-sectional view of the first embodiment of the five-hole-and-three-stack antenna structure of the present invention. As shown in FIG. 46, after the first antenna 701, the second antenna 702 and the third antenna 703 of the present invention are stacked orderly, the first-feed-in component 734 is through the ninth-through hole 733 and is electrically connected to the third-radiation-metal layer 732. The first-feed-in component 734 is coupled to and connected to the second-radiation-metal layer 722 when the first-feed-in component 734 is through the eighth-through hole 725 of the second-base body 721. The first-feed-in component 734 is coupled to and connected to the first-radiation-metal layer 712 on the first-base body 711 when the first-feed-in component 734 is through the third-through hole 716. The first-feed-in component 734 is not electrically connected to the grounded-metal layer 713 (namely, the first-feed-in component 734 fails to electrically connect to the grounded-metal layer 713) when the first-feed-in component 734 is through the bottom surface of the first-base body 711 to be outside the bottom surface of the first-base body 711. The five-hole-and-three-stack antenna structure 700 with a single feed-in is formed, wherein looking at the bottom surface of the first antenna 701, there are five holes.

Figure 47:
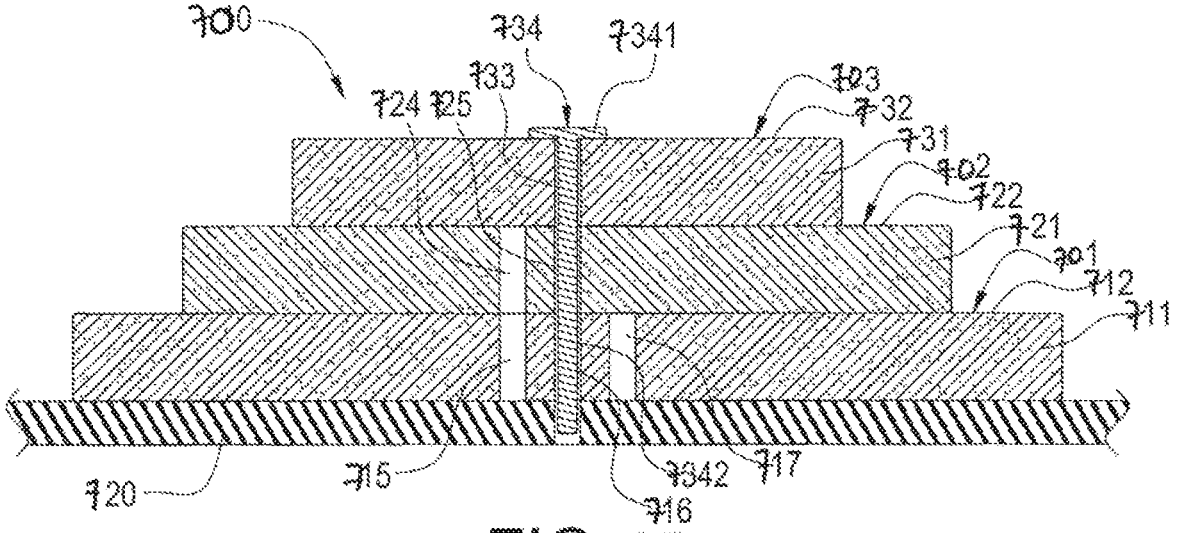
FIG. 47 shows the first embodiment that the five-hole-and-three-stack antenna structure of the present invention is electrically connected to a circuit board of an electronic equipment.

FIG. 47 shows the first embodiment that the five-hole-and-three-stack antenna structure of the present invention is electrically connected to a circuit board of an electronic equipment. After the first antenna 701, the second antenna 702 and the third antenna 703 of the present invention are stacked, the first-feed-in component 734 is electrically connected to a circuit board 720 of an electronic equipment (not shown in FIG. 47). The first-radiation-metal layer 712 (of the first antenna 701) and the first-feed-in component 734 form a coupling connection to be able to receive, for example, GPS L5/L2 signals with frequencies 1100 MHz~1250 MHz. The second-radiation-metal layer 722 (of the second antenna 702) and the first-feed-in component 734 form a coupling connection to be able to receive, for example, GPS/GNSS/BeiDou signals with frequencies 1500 MHz~1650 MHz. The third-radiation-metal layer 732 (of the third antenna 703) is electrically connected to the first-feed-in component 734 to be able to receive, for example, SDARS/WLAN signals with frequencies 2300 MHz~2500 MHz.

Because the five-hole-and-three-stack antenna structure 700 is electrically connected to (and arranged on) the circuit board 720 of the electronic equipment to be able to receive different wireless communication system signals with different frequencies, when the five-hole-and-three-stack antenna structure 700 is integrated with the electronic equipment to be used, neither the volume of the electronic equipment nor the area of the electronic equipment becomes larger.

Figure 48:
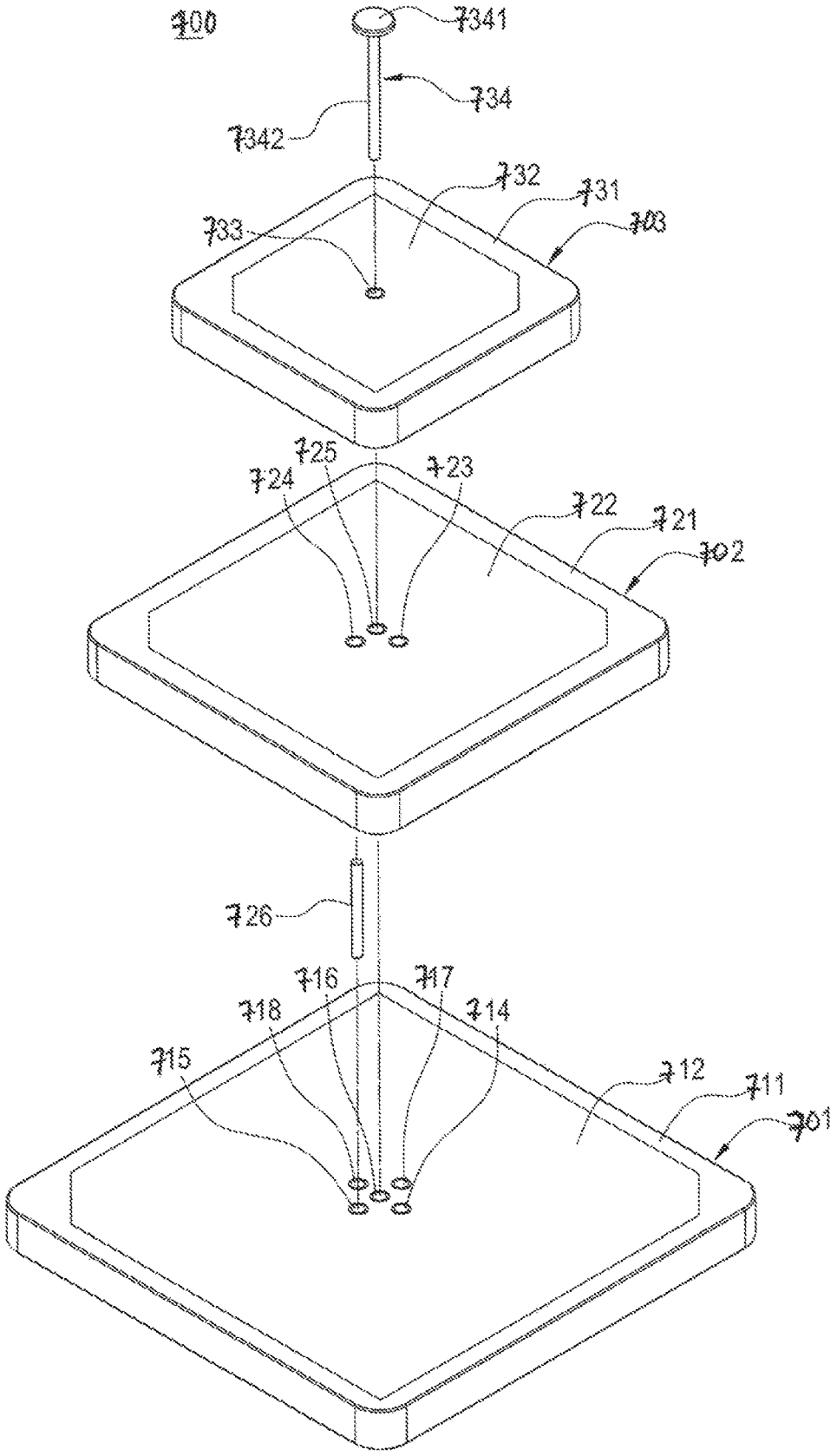
FIG. 48 shows an exploded view of the second embodiment of the five-hole-and-three-stack antenna structure of the present invention.

FIG. 48 shows an exploded view of the second embodiment of the five-hole-and-three-stack antenna structure of the present invention. As shown in FIG. 48, the second embodiment is basically similar with the first embodiment. The difference is that the second embodiment comprises a second-feed-in component 726. The second-feed-in component 726 is through the seventh-through hole 724 of the second-base body 721 and is electrically connected to the second-radiation-metal layer 722, and then is through the second-through hole 715 of the first-base body 711 and is coupled to and connected to the first-radiation-metal layer 712. The five-hole-and-three-stack antenna structure 700 with two feed-ins is formed.

Figure 49:
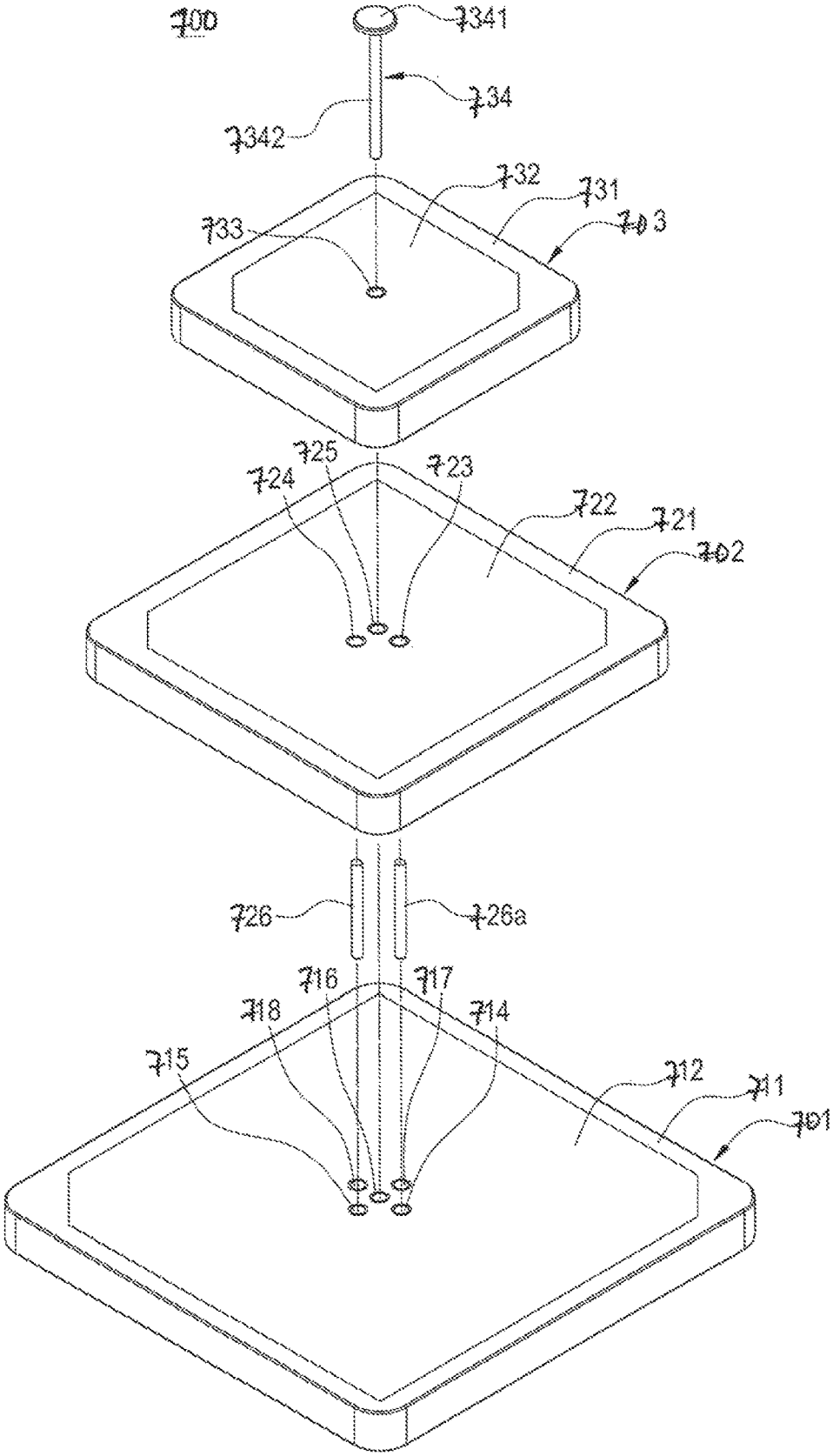
FIG. 49 shows an exploded view of the third embodiment of the five-hole-and-three-stack antenna structure of the present invention.

FIG. 49 shows an exploded view of the third embodiment of the five-hole-and-three-stack antenna structure of the present invention. As shown in FIG. 49, the third embodiment is basically similar with the second embodiment. The difference is that the third embodiment comprises a second-feed-in component 726*a*. The two second-feed-in components 726, 726*a* are through the seventh-through hole 724 and the sixth-through hole 723 of the second-base body 721 and are electrically connected to the second-radiation-metal layer 722, and then are through the second-through hole 715 and the first-through hole 714 of the first-base body 711 and are coupled to and connected to the first-radiation-metal layer 712. The five-hole-and-three-stack antenna structure 700 with three feed-ins is formed.

Figure 50:
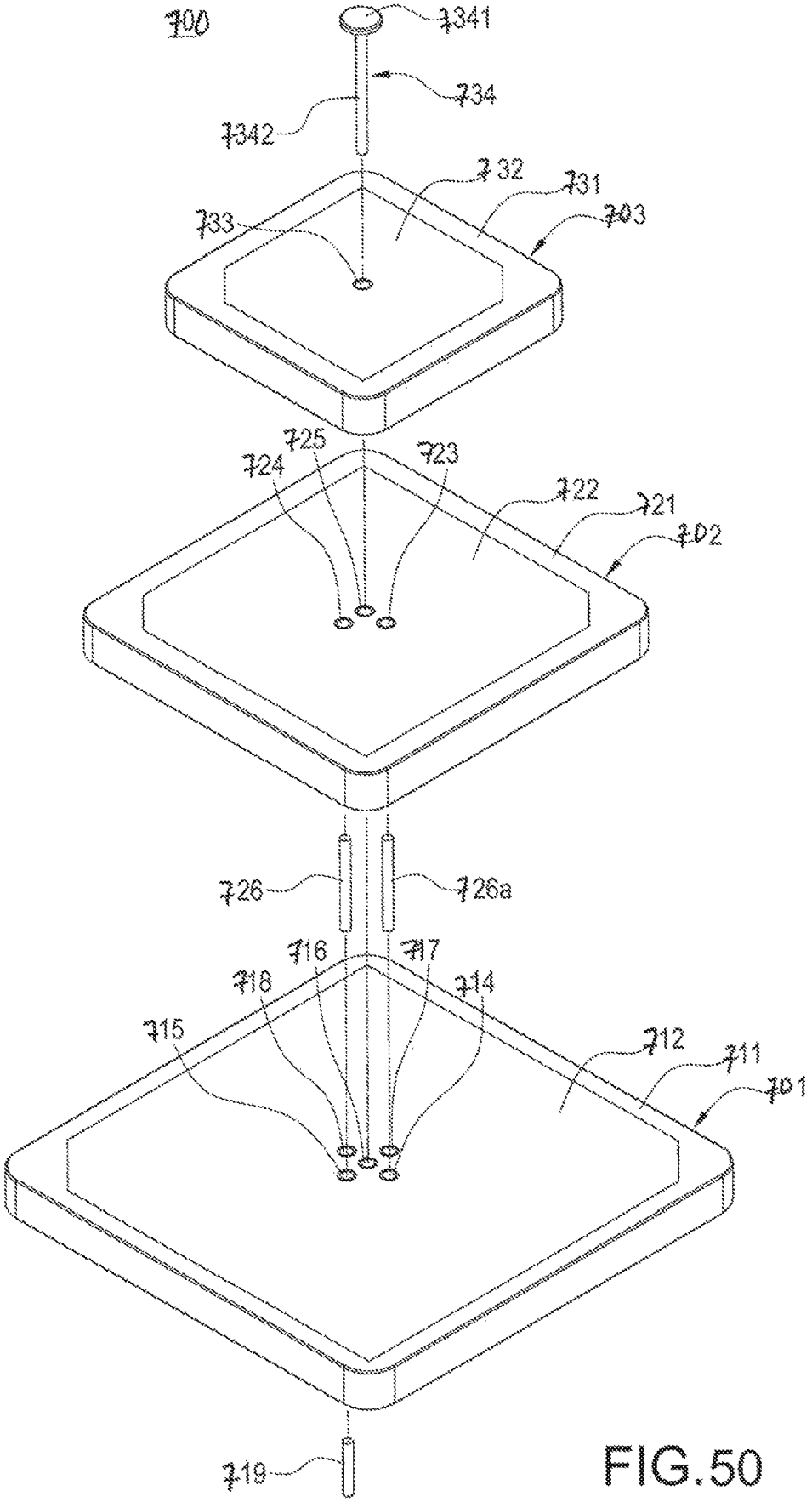
FIG. 50 shows an exploded view of the fourth embodiment of the five-hole-and-three-stack antenna structure of the present invention.

FIG. 50 shows an exploded view of the fourth embodiment of the five-hole-and-three-stack antenna structure of the present invention. As shown in FIG. 50, the fourth embodiment is basically similar with the third embodiment. The difference is that the fourth embodiment comprises a third-feed-in component 719. The third-feed-in component 719 is through the fifth-through hole 707 of the first-base body 711 and is electrically connected to the first-radiation-metal layer 712. The five-hole-and-three-stack antenna structure 700 with four feed-ins is formed.

Figure 51:
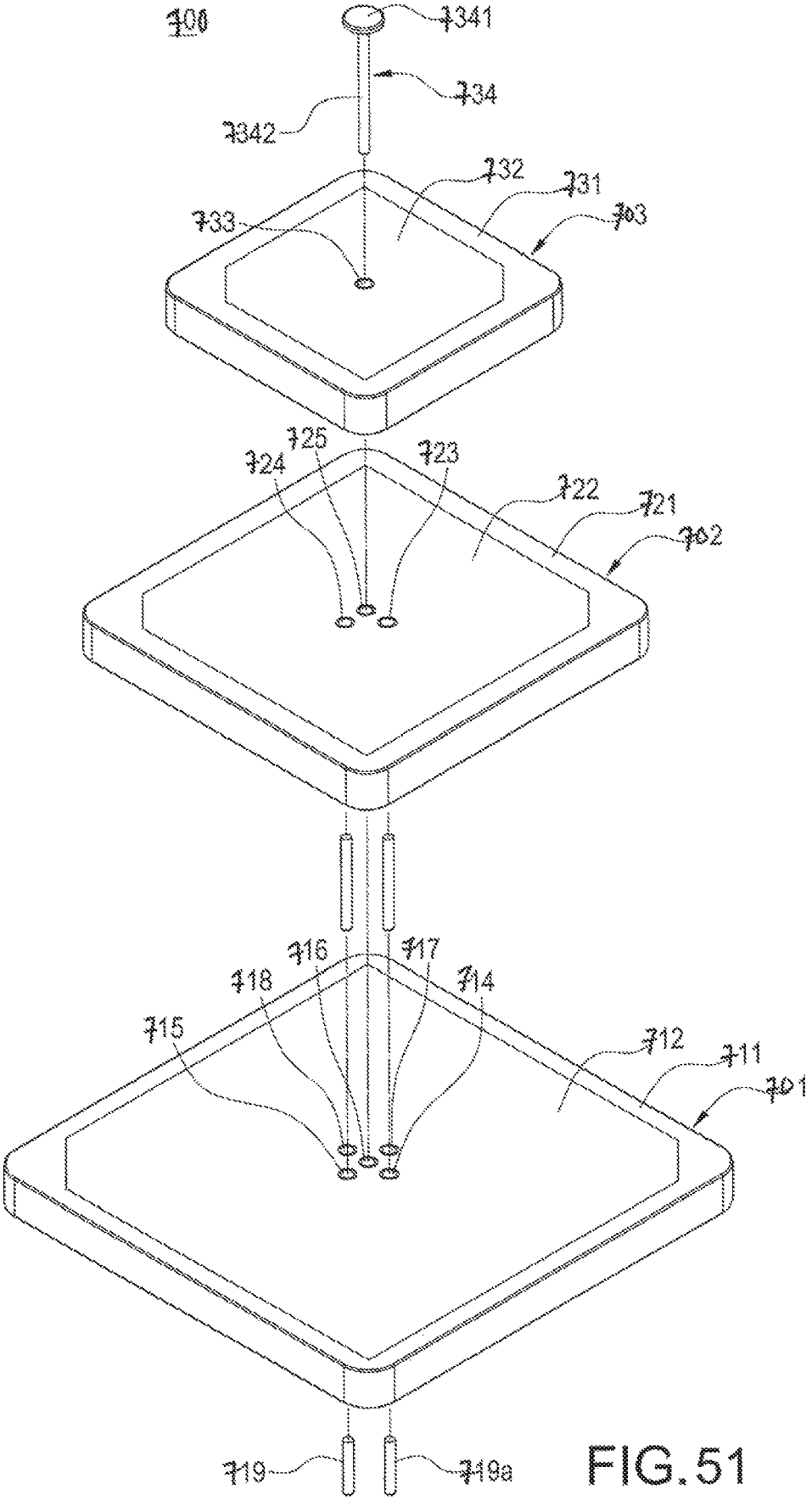
FIG. 51 shows an exploded view of the fifth embodiment of the five-hole-and-three-stack antenna structure of the present invention.

FIG. 51 shows an exploded view of the fifth embodiment of the five-hole-and-three-stack antenna structure of the present invention. As shown in FIG. 50, the fifth embodiment is basically similar with the fourth embodiment. The difference is that the fifth embodiment comprises a third-feed-in component 719*a*. The two third-feed-in components 719, 719*a* are through the fifth-through hole 707 and the fourth-through hole 717 of the first-base body 711, and are electrically connected to the first-radiation-metal layer 712. The five-hole-and-three-stack antenna structure 700 with five feed-ins is formed.

Figure 52:
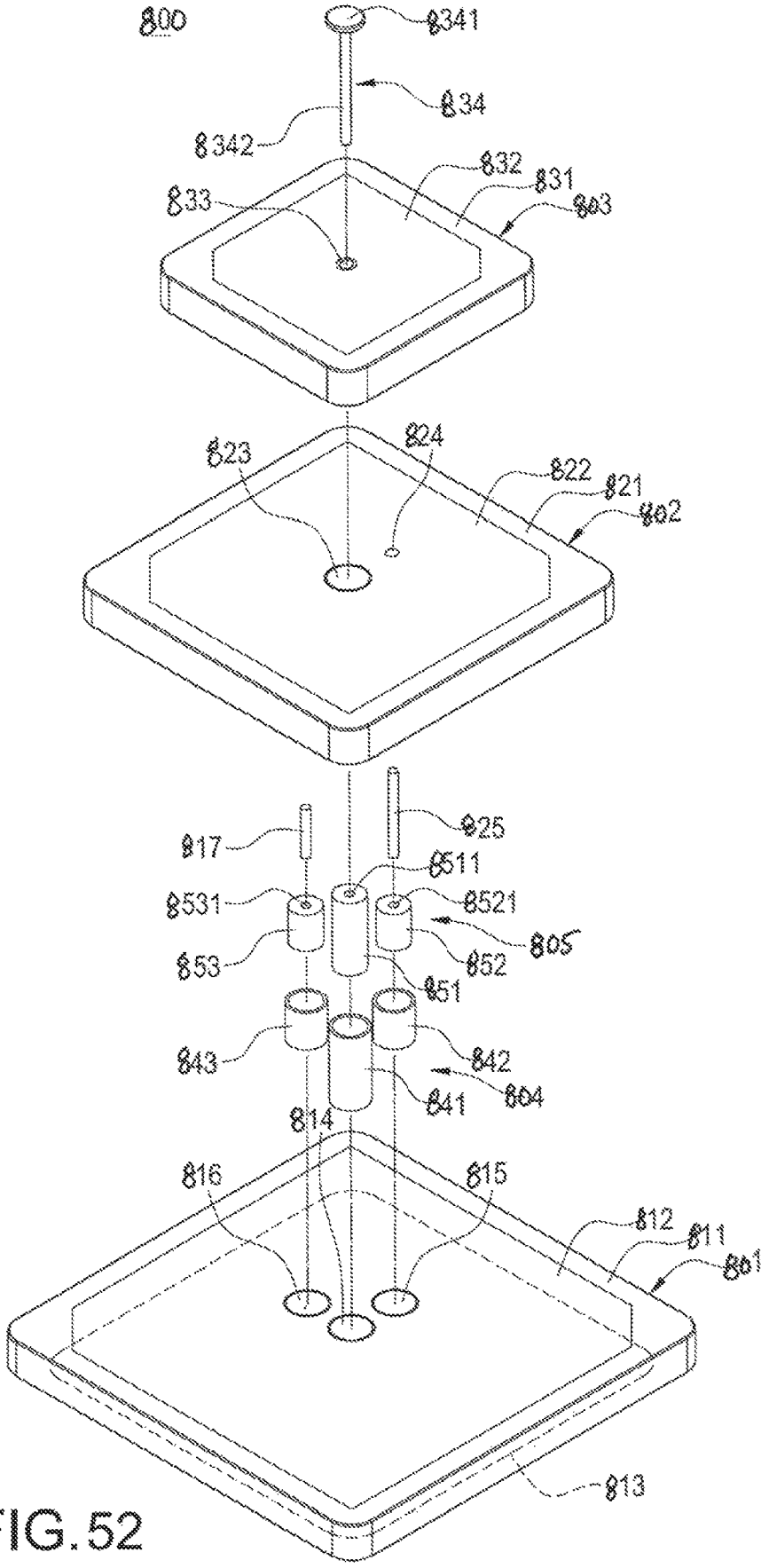
FIG. 52 shows an exploded view of the feed-in-hole-insulation ceramic antenna structure of the present invention.
Figure 53:
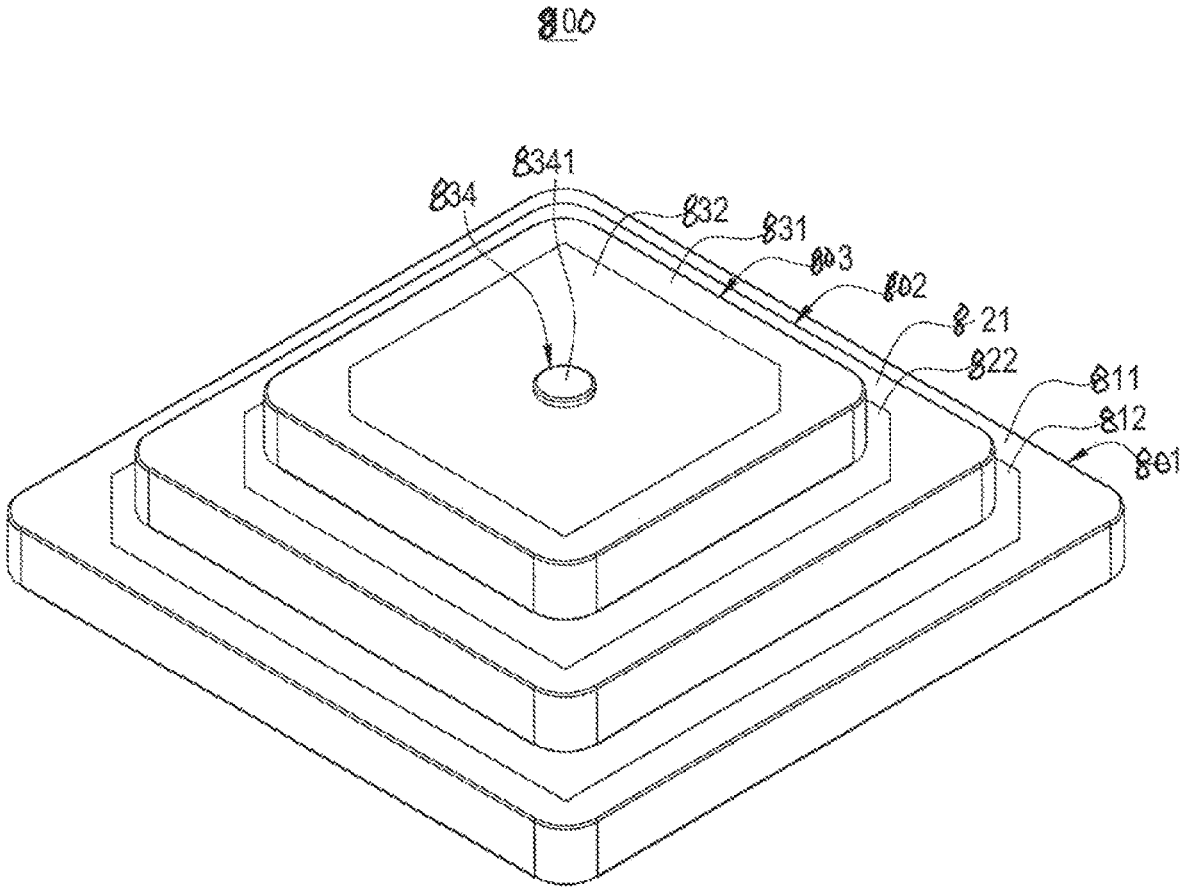
FIG. 53 shows an assembly drawing of the feed-in-hole-insulation ceramic antenna structure of the present invention.
Figure 54:
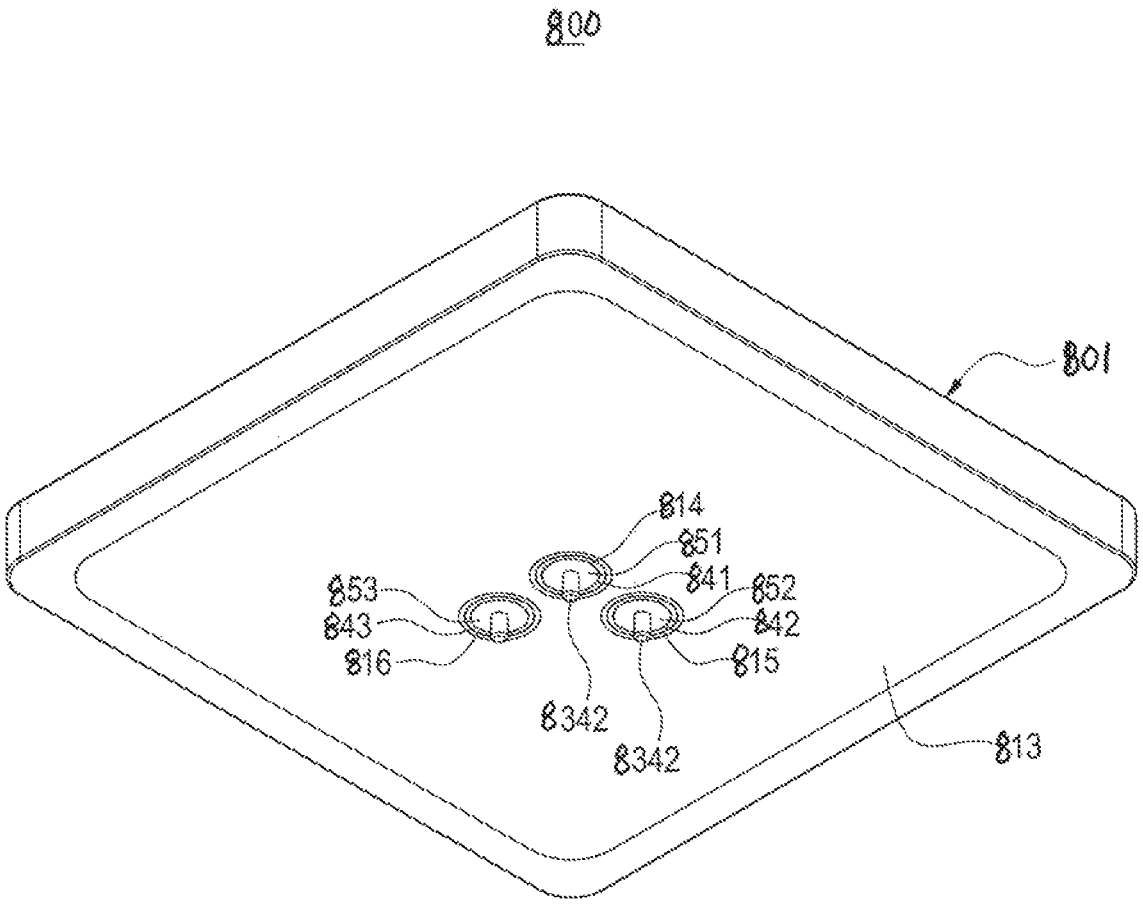
FIG. 54 shows an upward view of the feed-in-hole-insulation ceramic antenna structure of the present invention.
Figure 55:
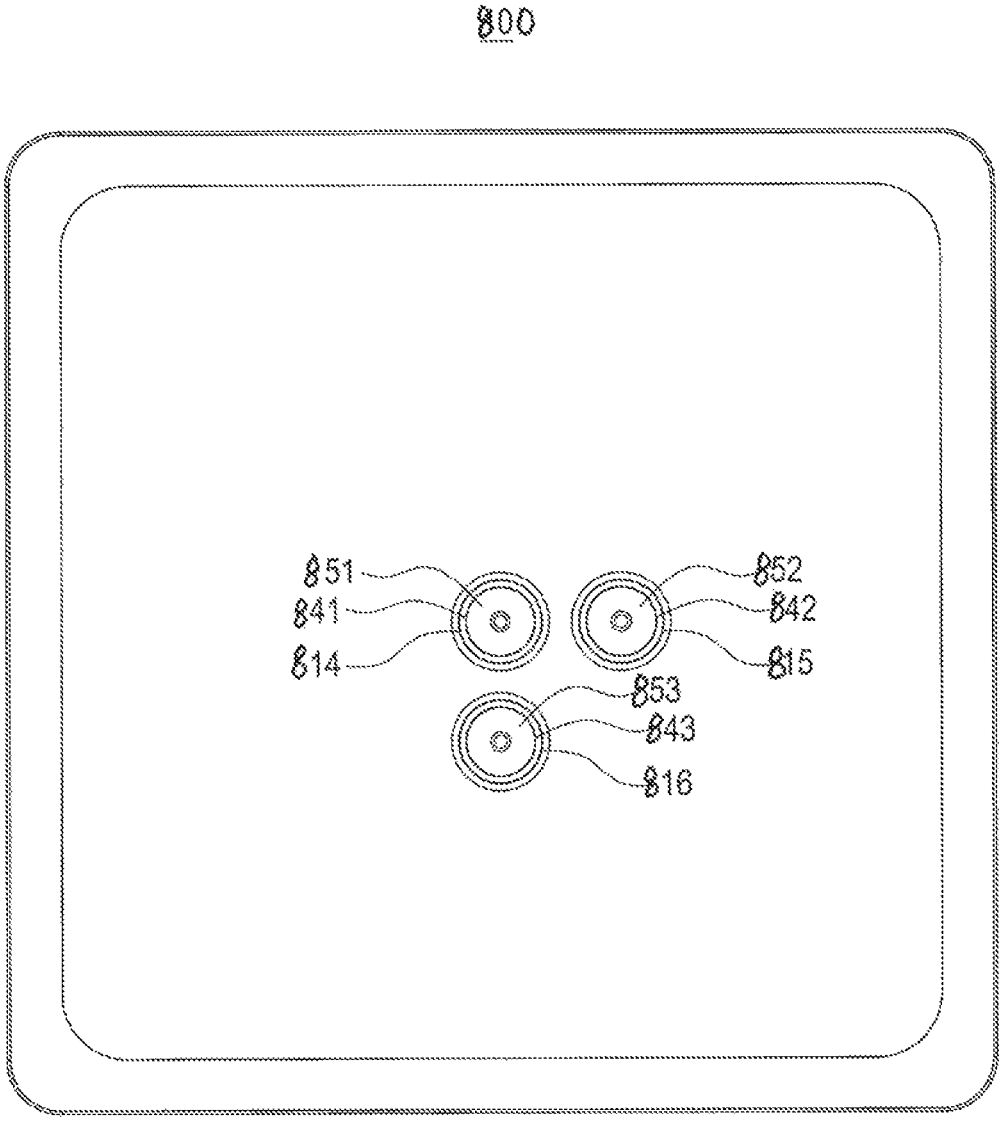
FIG. 55 shows a bottom surface of the feed-in-hole-insulation ceramic antenna structure of the present invention.

FIG. 52 shows an exploded view of the feed-in-hole-insulation ceramic antenna structure of the present invention. FIG. 53 shows an assembly drawing of the feed-in-hole-insulation ceramic antenna structure of the present invention. FIG. 54 shows an upward view of the feed-in-hole-insulation ceramic antenna structure of the present invention. FIG. 55 shows a bottom surface of the feed-in-hole-insulation ceramic antenna structure of the present invention. As shown in FIGS. 52-55, a feed-in-hole-insulation ceramic antenna structure 800 of the present invention comprises a first antenna 801, a second antenna 802, a third antenna 803, a conductive-layer group 804 and a dielectric-layer group 805. Moreover, the first antenna 801, the second antenna 802 and the third antenna 803 are stacked as the feed-in-hole-insulation ceramic antenna structure 800 which is nearly cone-shaped. At the same time, the conductive-layer group 804 and the dielectric-layer group 805 are arranged on signal feed-in paths of the first antenna 801 and the second antenna 802. Therefore, the signal feed-in paths achieve an impedance matching of 50-Ohm characteristics as a coaxial cable (not shown in FIGS. 52-55), so that a receiving ability of the feed-in-hole-insulation ceramic antenna structure 800 is better.

The first antenna 801 comprises a first-base body 811, a first-radiation-metal layer 812, a grounded-metal layer 813 and a first-feed-in component 817. The first-radiation-metal layer 812 is arranged on a surface of the first-base body 811. The grounded-metal layer 813 is arranged on a bottom surface of the first-base body 811. The first-base body 811 sets up (namely, defines) a first-through hole 814, a second-through hole 815 and a third-through hole 816. The first-through hole 814, the second-through hole 815 and the third-through hole 816 are through the first-base body 811, the first-radiation-metal layer 812 and the grounded-metal layer 813. The first-feed-in component 817 is configured to break through the first-base body 811 through the third-through hole 816, and is electrically connected to the first-radiation-metal layer 812. After the first-feed-in component 817 is through the bottom surface of the first-base body 811 to be outside the bottom surface of the first-base body 811, the first-feed-in component 817 is not electrically connected to the grounded-metal layer 813 (namely, the first-feed-in component 817 fails to electrically connect to the grounded-metal layer 813). In FIGS. 52-55, the first-base body 811 is a flat plate-type body or a block-shaped body made of ceramic dielectric materials.

The second antenna 802 comprises a second-base body 821, a second-radiation-metal layer 822 and a second-feed-in components 825. The second-base body 821 is arranged on a surface of the first-radiation-metal layer 812 on the first-base body 811. An area of the second-base body 821 is smaller than an area of the first-radiation-metal layer 812. The first-radiation-metal layer 812 is exposed when the second-base body 821 is arranged on the surface of the first-radiation-metal layer 812. Moreover, the second-radiation-metal layer 822 is arranged on a surface of the second-base body 821. The second-base body 821 is configured to set up (namely, define) a fourth-through hole 823 and a fifth-through hole 824. The fourth-through hole 823 and the fifth-through hole 824 are through the second-base body 821 and the second-radiation-metal layer 822. The fourth-through hole 823 and the fifth-through hole 824 are corresponding to the first-through hole 814 and the second-through hole 815 of the first-base body 811. After the second-feed-in component 825 is electrically connected to the second-radiation-metal layer 822 through the fifth-through hole 824, then the second-feed-in component 825 is through the second-through hole 815 to be extended to be outside the bottom surface of the first-base body 811. The second-feed-in component 825 is not electrically connected to the grounded-metal layer 813 (namely, the second-feed-in component 825 fails to electrically connect to the grounded-metal layer 813). In FIGS. 52-55, the second-base body 821 is a flat plate-type body or a block-shaped body made of ceramic dielectric materials.

The third-antenna 803 comprises a third-base body 831, a third-radiation-metal layer 832 and a third-feed-in component 834. The third-base body 831 is arranged on a surface of the second-radiation-metal layer 822 on the second-base body 821. An area of the third-base body 831 is smaller than an area of the second-radiation-metal layer 822. The second-radiation-metal layer 822 is exposed when the third-base body 831 is arranged on the surface of the second-radiation-metal layer 822. Moreover, the third-radiation-metal layer 832 is arranged on a surface of the third-base body 831. The third-base body 831 is configured to set up (namely, define) a sixth-through hole 833. The sixth-through hole 833 is through the third-base body 831 and the third-radiation-metal layer 832. The sixth-through hole 833 is corresponding to the fourth-through hole 823 of the second-base body 821 and the first-through hole 814 of the first-base body 811. The third-feed-in component 834 is in a T shape. The third-feed-in component 834 comprises a head 8341 and a shaft 8342. The head 8341 is extended to the shaft 8342. The shaft 8342 is through the sixth-through hole 833 of the third-base body 831, the fourth-through hole 823 of the second-base body 821 and the first-through hole 814 of the first-base body 811 to be outside the bottom surface of the first-base body 811. The third-feed-in component 834 is electrically connected to the third-radiation-metal layer 832 when the third-feed-in component 834 is through the sixth-through hole 833. The third-feed-in component 834 is not electrically connected to the grounded-metal layer 813 (namely, the third-feed-in component 834 fails to electrically connect to the grounded-metal layer 813) when the third-feed-in component 834 is through the bottom surface of the first-base body 811 to be outside the bottom surface of the first-base body 811. In FIGS. 52-55, the third-base body 831 is a flat plate-type body or a block-shaped body made of ceramic dielectric materials.

The conductive-layer group 804 comprises a first-conductive layer 841, a second-conductive layer 842 and a third-conductive layer 843. The first-conductive layer 841 is arranged on a hole wall of the first-through hole 814 of the first-base body 811 and on a hole wall of the fourth-through hole 823 of the second-base body 821. The first-conductive layer 841 is electrically connected to the grounded-metal layer 813. The second-conductive layer 842 is arranged on a hole wall of the second-through hole 815 of the first-base body 811 and is electrically connected to the grounded-metal layer 813. The third-conductive layer 843 is arranged on a hole wall of the third-through hole 816 and is electrically connected to the grounded-metal layer 813. In FIGS. 52-55, the first-conductive layer 841, the second-conductive layer 842 and the third-conductive layer 843 are copper rings.

The dielectric-layer group 805 comprises a first-dielectric layer 851, a second-dielectric layer 853 and a third-dielectric layer 853. The first-dielectric layer 851 is arranged in the first-conductive layer 841. The first-dielectric layer 851 is configured to define a first-punched hole 8511. The third-feed-in component 834 is through the first-punched hole 8511. The second-dielectric layer 853 is arranged in the second-conductive layer 842. The second-dielectric layer 842 is configured to define a second-punched hole 8521. The second-feed-in component 825 is through the second-punched hole 8521. The third-dielectric layer 853 is arranged in the third-conductive layer 843. The third-dielectric layer 853 is configured to define a third-punched hole 8531. The first-feed-in component 817 is through the third-punched hole 8531. In FIGS. 52-55, the first-dielectric layer 851, the second-dielectric layer 853 and the third-dielectric layer 853 are teflons, wherein the teflon is called polytetrafluoroethylene (PTFE).

Moreover, the dielectric-layer group 805 is arranged between the conductive-layer group 804 and the first-feed-in component 817, the second-feed-in component 825 and the third-feed-in component 834, to form to comprise characteristics of the coaxial cable (namely, so that the feed-in-hole-insulation ceramic antenna structure 800 comprises the characteristics of the coaxial cable).

Figure 56:
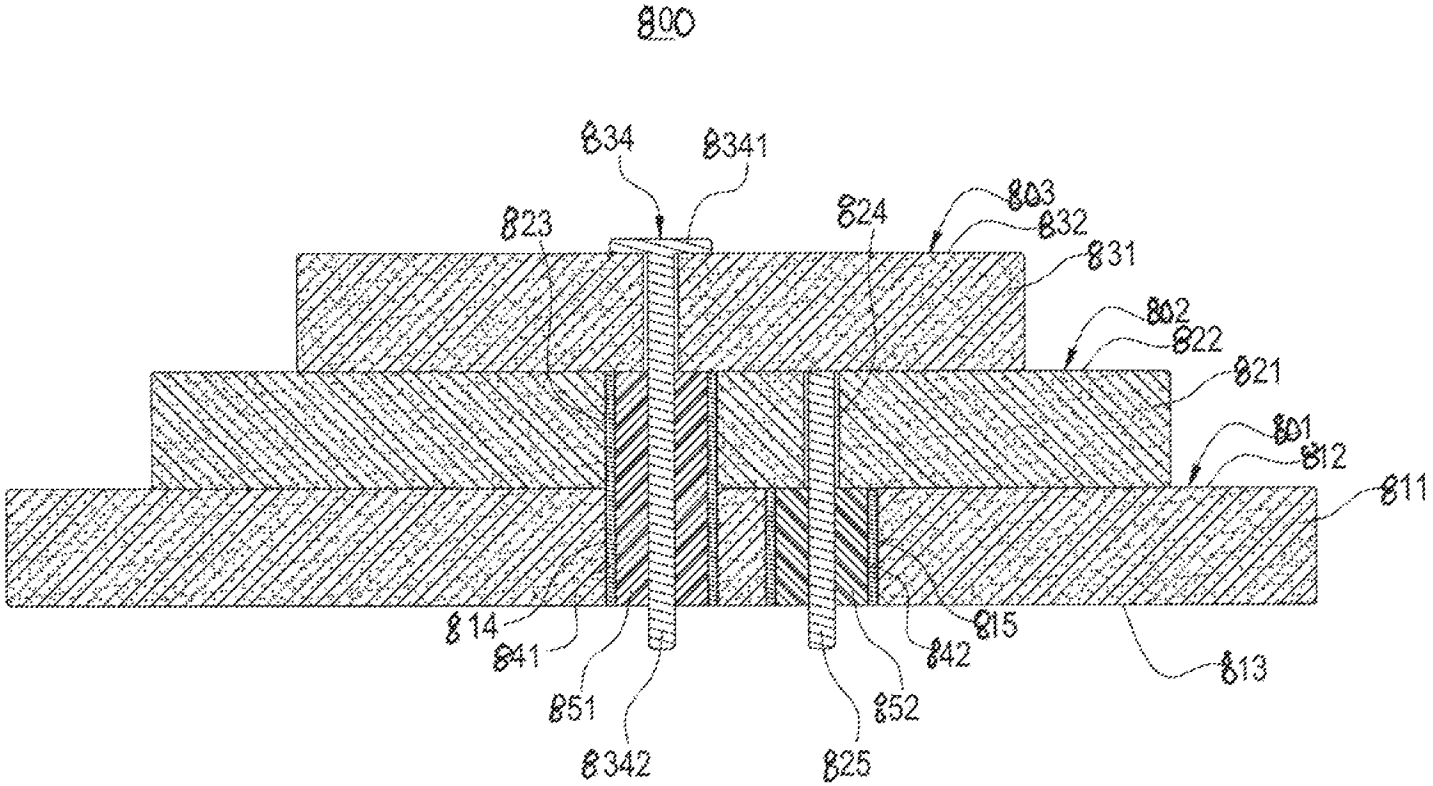
FIG. 56 shows a side-sectional view of the feed-in-hole-insulation ceramic antenna structure of the present invention.

FIG. 56 shows a side-sectional view of the feed-in-hole-insulation ceramic antenna structure of the present invention. As shown in FIG. 56, after the first-base body 811, the second-base body 821 and the third-base body 831 of the present invention are stacked orderly: the first-conductive layer 841 of the conductive-layer group 804 is arranged on the hole wall of the first-through hole 814 of the first-base body 811 and on the hole wall of the fourth-through hole 823 of the second-base body 821; the first-conductive layer 841 is electrically connected to the grounded-metal layer 813; the second-conductive layer 842 is arranged on the hole wall of the second-through hole 815 of the first-base body 811 and is electrically connected to the grounded-metal layer 813; the third-conductive layer 843 is arranged on the hole wall of the third-through hole 816 and is electrically connected to the grounded-metal layer 813.

The first-dielectric layer 851 of the dielectric-layer group 805 is arranged in the first-conductive layer 841. The second-dielectric layer 853 is arranged in the second-conductive layer 842. The third-dielectric layer 853 is arranged in the third-conductive layer 843. The first-feed-in component 817 is through the third-dielectric layer 853 after the first-feed-in component 817 is electrically connected to the first-radiation-metal layer 812. The second-feed-in component 825 is through the fifth-through hole 824 and the second-dielectric layer 853 after the second-feed-in component 825 is electrically connected to the second-radiation-metal layer 822. The third-feed-in component 834 is through the sixth-through hole 833 and the first-dielectric layer 851 after the third-feed-in component 834 is electrically connected to the third-radiation-metal layer 832.

After the first-feed-in component 817 is through the third-dielectric layer 853, the second-feed-in component 825 is through the second-dielectric layer 853, and the third-feed-in component 834 is through the first-dielectric layer 851, the feed-in paths achieve the same characteristics of the 50-Ohm impedance as a coaxial cable (not shown in FIG. 56). After the thickness of the stacked antennas increase, the stacked antennas are not mismatch, and the stacked antennas retain an original receiving performance of the stacked antennas.

Figure 57:
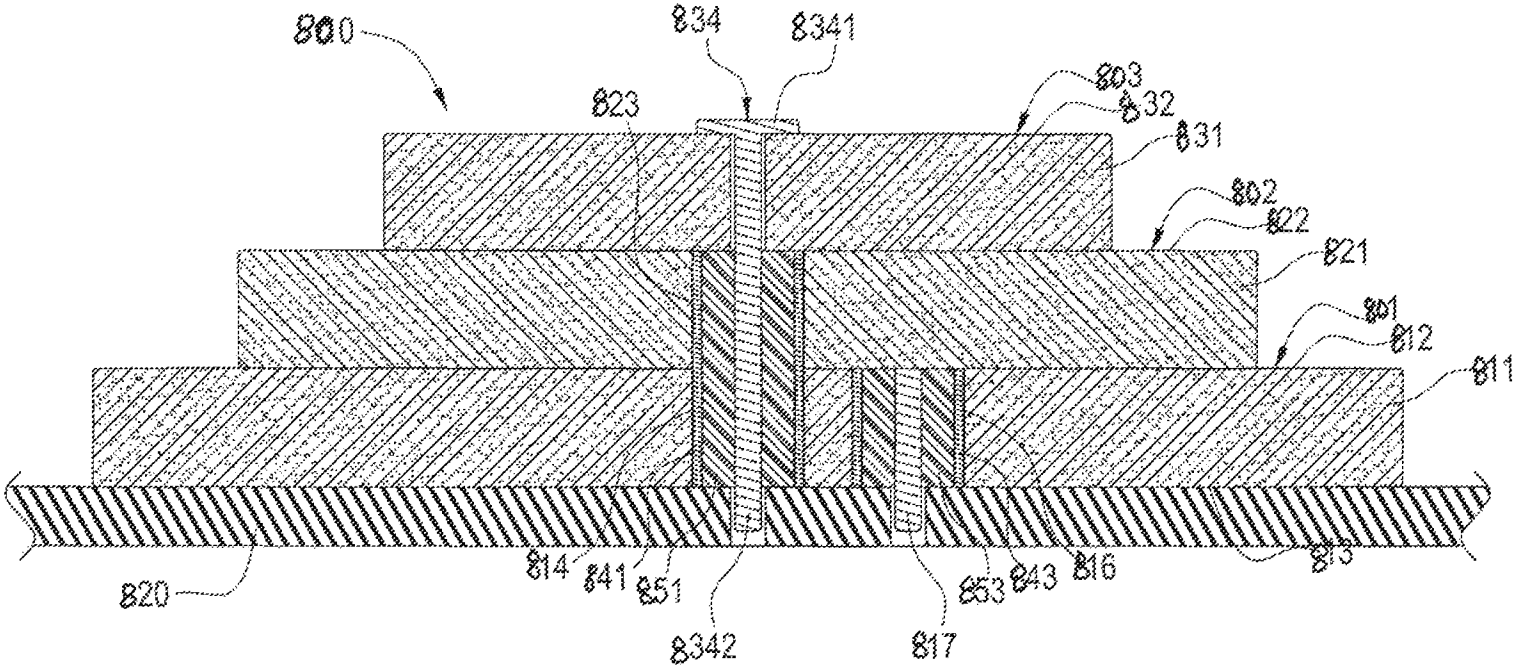
FIG. 57 shows that the feed-in-hole-insulation ceramic antenna structure of the present invention is electrically and fixedly connected to a circuit board of an electronic item.

FIG. 57 shows that the feed-in-hole-insulation ceramic antenna structure of the present invention is electrically and fixedly connected to a circuit board of an electronic item. As shown in FIG. 57, after the first antenna 801, the second antenna 802 and the third antenna 803 are stacked, the first antenna 801, the second antenna 802 and the third antenna 803 are electrically connected to a circuit board 820 of an electronic item (not shown in FIG. 57). The first antenna 801 forms to be able to receive GPS L5/L2 signals with frequencies 1100 MHz~1250 MHz. The second antenna 802 forms to be able to receive GPS/GNSS/BeiDou signals with frequencies 1500 MHz~1650 MHz. The third antenna 803 forms to be able to receive SDARS/WLAN signals with frequencies 2300 MHz~2500 MHz.

ITEMS

The present disclosure relates to the following items:

Item 1 relates to a stack antenna comprising: a first antenna comprising a first base body, a first radiation metal layer, a grounded metal layer and two first feed-in components, the first radiation metal layer arranged on a surface of the first base body, the grounded metal layer arranged on a bottom surface of the first base body, the two first feed-in components through the first base body, the two first feed-in components electrically connected to the first radiation metal layer through the first base body, the two first feed-in components through the bottom surface of the first base body, and neither of the two first feed-in components electrically connected to the grounded metal layer a second antenna comprising a second base body, a second radiation metal layer and two second feed-in components, the second base body arranged on a surface of the first radiation metal layer on the first base body, the second radiation metal layer arranged on a surface of the second base body, the two second feed-in components through the second base body and the first base body, and electrically connected to the second radiation metal layer, the two second feed-in components configured to break through the bottom surface of the first base body to be outside the bottom surface of the first base body, and neither of the two second feed-in components electrically connected to the grounded metal layer a third antenna comprising a third base body, a third radiation metal layer and a third feed-in component, the third base body arranged on a surface of the second radiation metal layer on the second base body, the third radiation metal layer arranged on a surface of the third base body, the third feed-in component through the third base body, the second base body and the first base body after the third feed-in component is electrically connected to the third radiation metal layer, the third feed-in component configured to break through the bottom surface of the first base body to be outside the bottom surface of the first base body and not electrically connected to the grounded metal layer and a circuit board electrically connected to the third feed-in component, the two second feed-in components and the two first feed-in components through the third base body, the second base body and the first base body.

Item 2 relates to the stack antenna of item 1, wherein the first base body is configured to define a first through hole, a second through hole, a third through hole, a fourth through hole and a fifth through hole the first through hole, the second through hole, the third through hole, the fourth through hole and the fifth through hole are through the first base body, the first radiation metal layer and the grounded metal layer, and are defined to form a cross; the two first feed-in components are configured to break through the first base body through the fourth through hole and the fifth through hole.

Item 3 relates to the stack antenna in item 2, wherein the second base body is configured to define a sixth through hole, a seventh through hole and an eighth through hole the sixth through hole, the seventh through hole and the eighth through hole are through the second base body and the second radiation metal layer the sixth through hole, the seventh through hole and the eighth through hole are corresponding to the first through hole, the second through hole and the third through hole of the first base body respectively; the two second feed-in components are through the seventh through hole and the eighth through hole respectively, and are electrically connected to the second radiation metal layer, and then are through the second through hole and the third through hole respectively to be extended outside the bottom surface of the first base body, and neither of the two second feed-in components is electrically connected to the grounded metal layer.

Item 4 relates to the stack antenna in item 3, wherein the third base body is configured to define a ninth through hole the ninth through hole is through the third base body and the third radiation metal layer the ninth through hole is corresponding to the sixth through hole of the second base body and the first through hole of the first base body.

Item 5 relates to the stack antenna in item 4, wherein the third feed-in component is through the ninth through hole of the third base body, the sixth through hole of the second base body and the first through hole of the first base body to be outside the bottom surface of the first base body the third feed-in component is electrically connected to the third radiation metal layer when the third feed-in component is through the ninth through hole the third feed-in component is not electrically connected to the grounded metal layer when the third feed-in component is through the bottom surface of the first base body to be outside the bottom surface of the first base body.

Item 6 relates to the stack antenna in item 1, wherein the third feed-in component is in a T shape; the third feed-in component comprises a head and a shaft the head is extended to the shaft.

Item 7 relates to the stack antenna in item 5, wherein the circuit board comprises a front side and a back side, and is configured to define a first punched hole, a second punched hole, a third punched hole, a fourth punched hole and a fifth punched hole the first punched hole, the second punched hole, the third punched hole, the fourth punched hole and the fifth punched hole are corresponding to the first through hole, the second through hole, the third through hole, the fourth through hole and the fifth through hole respectively; each of the first punched hole, the second punched hole, the third punched hole, the fourth punched hole and the fifth punched hole comprises an electrical connection point on the back side each of the electrical connection points is extended to an electrical fixing-connection point the two first feed-in components, the two second feed-in components and the third feed-in component are through the bottom surface of the first base body of the first antenna to be outside the bottom surface of the first base body, and are electrically connected to the electrical connection points on the back side of the circuit board through the fourth punched hole, the fifth punched hole, the second punched hole, the third punched hole and the first punched hole orderly.

Item 8 relates to the stack antenna in item 1, wherein an area of the second base body is smaller than an area of the first radiation metal layer the first radiation metal layer is exposed when the second base body is arranged on the surface of the first radiation metal layer.

Item 9 relates to the stack antenna in item 1, wherein an area of the third base body is smaller than an area of the second radiation metal layer the second radiation metal layer is exposed when the third base body is arranged on the surface of the second radiation metal layer.

Item 10 relates to the stack antenna in item 1, wherein the first base body, the second base body and the third base body are flat plate-type bodies or block-shaped bodies made of ceramic dielectric materials.

Item 11 relates to an electronic apparatus, comprising: a mainboard, and a stack antenna, comprising: a first antenna comprising a first base body and a first radiation metal layer arranged on a surface of the first base body a second antenna comprising a second base body arranged on a surface of the first radiation metal layer on the first base body and a second radiation metal layer arranged on a surface of the second base body, wherein an area of the second base body is smaller than an area of the first radiation metal layer a third antenna comprising a third base body arranged on a surface of the second radiation metal layer on the second base body and a third radiation metal layer arranged on a surface of the third base body, wherein an area of the third base body is smaller than an area of the second radiation metal layer and a circuit board electrically connected respectively to the first antenna, the second, and the third antenna wherein the stack antenna is surface-mounted on the mainboard.

Item 12 relates to a patch antenna structure comprising: a conducting component appearing as a sheet body; and a patch antenna arranged below the conducting component, wherein the conducting component is arranged correspondingly above the patch antenna, so that the conducting component is configured to change the radiation pattern of the patch antenna.

Item 13 relates to the patch antenna of item 12 further comprising: a support component comprising a closed end and an open end, the closed end arranged correspondingly to the open end wherein the conducting component is arranged on a side of the closed end and wherein the patch antenna is arranged on the open end, wherein the conducting component is configured to change the radiation pattern of the patch antenna to improve a range for receiving signals from a terrestrial base station.

Item 14 relates to the patch antenna of item 13, wherein the support component is a hollowed-out cover made of an insulating material.

Item 15 relates to the patch antenna of item 13 wherein the insulating material is a plastic or a rubber.

Item 16 relates to the patch antenna of item 13, wherein the conducting component is a metal conducting material, and the side of the closed end that the conducting component is arranged on is an inner side or an outer side.

Item 17 relates to the patch antenna of item 15, wherein the patch antenna is a cube and is arranged on an inner wall of the open end of the support component the patch antenna comprises a base body, a radiation metal layer, a grounded metal layer and a signal feed-in body the base body is made of a ceramic dielectric; the radiation metal layer is arranged on a top surface of the base body and is corresponding to the conducting component the grounded metal layer is arranged on a bottom surface of the base body the signal feed-in body is in a T shape; the signal feed-in body comprises a head and a shaft the signal feed-in body is through the base body a terminal of the shaft of the signal feed-in body is configured to break through the bottom surface of the base body the shaft is not electrically connected to the grounded metal layer the head of the signal feed-in body is electrically connected to the radiation metal layer, so that the radiation metal layer is configured to form a signal receiving side.

Item 18 relates to the patch antenna of item 12 further comprising: a support component wherein the conducting component is arranged on a top of the support component wherein the patch antenna is arranged on a bottom of the support component, so that the conducting component is above the patch antenna correspondingly; and wherein the conducting component is configured to change the radiation pattern of the patch antenna to improve a range for receiving signals from a terrestrial base station.

Item 19 relates to the patch antenna of item 12, wherein the support component is made of a material with a permittivity below 2.

Item 20 relates to the patch antenna of item 19, wherein the support component is a blocky object.

Item 21 relates to the patch antenna of items 19 wherein the support component a styrofoam.

Item 22 relates to the patch antenna of item 19 wherein the support component is a foam.

Item 23 relates to the patch antenna of item 19 wherein the patch antenna is a cube and is arranged on the bottom of the support component the patch antenna comprises a base body, a radiation metal layer, a grounded metal layer and a signal feed-in body the base body is made of a ceramic dielectric; the radiation metal layer is arranged on a top surface of the base body and is arranged on the bottom of the support component the grounded metal layer is arranged on a bottom surface of the base body the signal feed-in body is in a T shape; the signal feed-in body comprises a head and a shaft the signal feed-in body is through the base body a terminal of the shaft of the signal feed-in body is configured to break through the bottom surface of the base body the shaft is not electrically connected to the grounded metal layer the head of the signal feed-in body is electrically connected to the radiation metal layer, so that the radiation metal layer is configured to form a signal receiving side.

Item 24 relates to the patch antenna of item 12, wherein the conducting component is arranged in parallel to the patch antenna.

Item 25 relates to the patch antenna of item 12, wherein a distance from the conducting component to the patch antenna is in a range of 0.4 cm to 0.5 cm.

Item 26 relates to the patch antenna of item 12, wherein the patch antenna supports frequency range of Satellite Digital Audio Radio Service ("SDARS").

Item 27 relates to the patch antenna of item An antenna system for a motor vehicle, said antenna system receiving signals from a satellite, said antenna system comprising a patch antenna structure, said patch antenna structure comprising: a conducting component appearing as a sheet body; and a patch antenna arranged below the conducting component wherein the conducting component is arranged correspondingly above the patch antenna and is arranged horizontally with respect to the motor vehicle, so that the conducting component is configured to enhance the radiation pattern of the patch antenna in a horizontal direction.

Item 28 relates to the patch antenna of item 27, wherein the conducting component is removable to restore the radiation pattern of the patch antenna.

Item 29 relates to a stack antenna structure electrically connected to a circuit board of an electronic equipment, the stack antenna structure comprising: a first antenna comprising a first-base body, a first-radiation-metal layer, a grounded-metal layer and two first-feed-in components, the first-radiation-metal layer arranged on a surface of the first-base body, the grounded-metal layer arranged on a bottom surface of the first-base body, the two first-feed-in components through the first-base body, the two first-feed-in components electrically connected to the first-radiation-metal layer through the first-base body, the two first-feed-in components through the bottom surface of the first-base body, and neither of the two first-feed-in components electrically connected to the grounded-metal layer a second antenna comprising a second-base body, a second-radiation-metal layer and two second-feed-in components, the second-base body arranged on a surface of the first-radiation-metal layer on the first-base body, the second-radiation-metal layer arranged on a surface of the second-base body, the two second-feed-in components through the second-base body and the first-base body, and electrically connected to the second-radiation-metal layer, the two second-feed-in components configured to break through the bottom surface of the first-base body to be outside the bottom surface of the first-base body, and neither of the two second-feed-in components electrically connected to the grounded-metal layer and a third antenna comprising a third-base body, a third-radiation-metal layer and a third-feed-in component, the third-base body arranged on a surface of the second-radiation-metal layer on the second-base body, the third-radiation-metal layer arranged on a surface of the third-base body, the third-feed-in component through the third-base body, the second-base body and the first-base body after the third-feed-in component is electrically connected to the third-radiation-metal layer, the third-feed-in component configured to break through the bottom surface of the first-base body to be outside the bottom surface of the first-base body and not electrically connected to the grounded-metal layer.

Item 30 relates to the stack antenna structure in item 29, wherein the first-base body is configured to define a first-through hole, a second-through hole, a third-through hole, a fourth-through hole and a fifth-through hole the first-through hole, the second-through hole, the third-through hole, the fourth-through hole and the fifth-through hole are through the first-base body, the first-radiation-metal layer and the grounded-metal layer, and are defined to form a cross; the two first-feed-in components are configured to break through the first-base body through the fourth-through hole and the fifth-through hole.

Item 31 relates to the stack antenna structure in item 30, wherein the second-base body is configured to define a sixth-through hole, a seventh-through hole and an eighth-through hole the sixth-through hole, the seventh-through hole and the eighth-through hole are through the second-base body and the second-radiation-metal layer the sixth-through hole, the seventh-through hole and the eighth-through hole are corresponding to the first-through hole, the second-through hole and the third-through hole of the first base body respectively.

Item 32 relates to the stack antenna structure in item 31, wherein the two second-feed-in components are through the seventh-through hole and the eighth-through hole respectively, and are electrically connected to the second-radiation-metal layer, and then are through the second-through hole and the third-through hole respectively to be extended outside the bottom surface of the first-base body, and neither of the two second-feed-in components is electrically connected to the grounded-metal layer.

Item 33 relates to the stack antenna structure in item 32, wherein the third-base body is configured to define a ninth-through hole the ninth-through hole is through the third-base body and the third-radiation-metal layer the ninth-through hole is corresponding to the sixth-through hole of the second-base body and the first-through hole of the first-base body.

Item 34 relates to the stack antenna structure in item 33, wherein the third-feed-in component is through the ninth-through hole of the third-base body, the sixth-through hole of the second-base body and the first-through hole of the first-base body to be outside the bottom surface of the first-base body the third-feed-in component is electrically connected to the third-radiation-metal layer when the third-feed-in component is through the ninth-through hole the third-feed-in component is not electrically connected to the grounded-metal layer when the third-feed-in component is through the bottom surface of the first-base body to be outside the bottom surface of the first-base body.

Item 35 relates to the stack antenna structure in item 29, wherein the third-feed-in component is in a T shape; the third-feed-in component comprises a head and a shaft the head is extended to the shaft.

Item 36 relates to the stack antenna structure in item 29, wherein an area of the second-base body is smaller than an area of the first-radiation-metal layer the first-radiation-metal layer is exposed when the second-base body is arranged on the surface of the first-radiation-metal layer.

Item 37 relates to the stack antenna structure in item 29, wherein an area of the third-base body is smaller than an area of the second-radiation-metal layer the second-radiation-metal layer is exposed when the third-base body is arranged on the surface of the second-radiation-metal layer.

Item 38 relates to the stack antenna structure in item 29, wherein the first-base body, the second-base body and the third-base body are flat plate-type bodies or block-shaped bodies made of ceramic dielectric materials.

Item 39 relates to an electronic apparatus, comprising: a circuit board, and a stack antenna structure electrically connected to a circuit board, the stack antenna structure comprising: a first antenna comprising a first base body, a first radiation metal layer arranged on a surface of the first base body, and two first-feed-in components a second antenna comprising a second base body arranged on a surface of the first radiation metal layer on the first base body, a second radiation metal layer arranged on a surface of the second base body, and two second-feed-in components, wherein an area of the second base body is smaller than an area of the first radiation metal layer and a third antenna comprising a third base body arranged on a surface of the second radiation metal layer on the second base body, a third radiation metal layer arranged on a surface of the third base body, and a third-feed-in component, wherein an area of the third base body is smaller than an area of the second radiation metal layer.

Item 39 relates to a stack antenna structure electrically connected to and arranged on a circuit board of an electronic equipment, the stack antenna structure comprising: a first antenna comprising a first-base body, a first-radiation-metal layer, a grounded-metal layer and a first-feed-in component, the first-radiation-metal layer arranged on a surface of the first-base body, the grounded-metal layer arranged on a bottom surface of the first-base body, the first-feed-in component through the first-base body, the first-feed-in component electrically connected to the first-radiation-metal layer through the first-base body, the first-feed-in component through the bottom surface of the first-base body, and the first-feed-in component not electrically connected to the grounded-metal layer a second antenna comprising a second-base body, a second-radiation-metal layer and two second-feed-in components, the second-base body arranged on a surface of the first-radiation-metal layer on the first-base body, the second-radiation-metal layer arranged on a surface of the second-base body, the two second-feed-in components through the second-base body and the first-base body, and electrically connected to the second-radiation-metal layer, the two second-feed-in components configured to break through the bottom surface of the first-base body to be outside the bottom surface of the first-base body, and neither of the two second-feed-in components electrically connected to the grounded-metal layer and a third antenna comprising a third-base body, a third-radiation-metal layer and a third-feed-in component, the third-base body arranged on a surface of the second-radiation-metal layer on the second-base body, the third-radiation-metal layer arranged on a surface of the third-base body, the third-feed-in component through the third-base body, the second-base body and the first-base body after the third-feed-in component is electrically connected to the third-radiation-metal layer, the third-feed-in component configured to break through the bottom surface of the first-base body to be outside the bottom surface of the first-base body and not electrically connected to the grounded-metal layer.

Item 40 relates to a stack antenna structure in item 39, wherein the first-base body is configured to define a first-through hole, a second-through hole, a third-through hole and a fourth-through hole the first-through hole, the second-through hole, the third-through hole and the fourth-through hole are through the first-base body, the first-radiation-metal layer and the grounded-metal layer the first-feed-in component is configured to break through the first-base body through the first-through hole.

Item 41 relates to a stack antenna structure in item 40, wherein the second-base body is configured to define a fifth-through hole, a sixth-through hole and a seventh-through hole the fifth-through hole, the sixth-through hole and the seventh-through hole are through the second-base body and the second-radiation-metal layer the fifth-through hole, the sixth-through hole and the seventh-through hole are corresponding to the second-through hole, the third-through hole and the fourth-through hole of the first base body respectively.

Item 42 relates to a stack antenna structure in item 41, wherein the two second-feed-in components are through the fifth-through hole and the seventh-through hole respectively, and are electrically connected to the second-radiation-metal layer, and then are through the second-through hole and the fourth-through hole respectively to be extended outside the bottom surface of the first-base body, and neither of the two second-feed-in components is electrically connected to the grounded-metal layer.

Item 43 relates to a stack antenna structure in item 42, wherein the third-base body is configured to define an eighth-through hole the eighth-through hole is through the third-base body and the third-radiation-metal layer the eighth-through hole is corresponding to the sixth-through hole of the second-base body, and the third-through hole of the first-base body.

Item 44 relates to a antenna structure in item 43, wherein the third-feed-in component is through the eighth-through hole of the third-base body, the sixth-through hole of the second-base body, and the third-through hole of the first-base body to be outside the bottom surface of the first-base body the third-feed-in component is electrically connected to the third-radiation-metal layer when the third-feed-in component is through the eighth-through hole the third-feed-in component is not electrically connected to the grounded-metal layer when the third-feed-in component is through the bottom surface of the first-base body to be outside the bottom surface of the first-base body.

Item 45 relates to a stack antenna structure in item 40, wherein the third-feed-in component is in a T shape; the third-feed-in component comprises a head and a shaft the head is extended to the shaft.

Item 46 relates to a stack antenna structure in item 40, wherein an area of the second-base body is smaller than an area of the first-radiation-metal layer the first-radiation-metal layer is exposed when the second-base body is arranged on the surface of the first-radiation-metal layer.

Item 47 relates to a stack antenna structure in item 40, wherein an area of the third-base body is smaller than an area of the second-radiation-metal layer the second-radiation-metal layer is exposed when the third-base body is arranged on the surface of the second-radiation-metal layer.

Item 48 relates to a stack antenna structure in item 40, wherein the first-base body, the second-base body and the third-base body are flat plate-type bodies or block-shaped bodies made of ceramic dielectric materials.

Item 49 relates to an electronic apparatus, comprising: a circuit board, and a stack antenna structure electrically connected to a circuit board, the stack antenna structure comprising: a first antenna comprising a first base body, a first radiation metal layer arranged on a surface of the first base body, and a first-feed-in component a second antenna comprising a second base body arranged on a surface of the first radiation metal layer on the first base body, a second radiation metal layer arranged on a surface of the second base body, and two second-feed-in components, wherein an area of the second base body is smaller than an area of the first radiation metal layer and a third antenna comprising a third base body arranged on a surface of the second radiation metal layer on the second base body, a third radiation metal layer arranged on a surface of the third base body, and a third-feed-in component, wherein an area of the third base body is smaller than an area of the second radiation metal layer.

Item 50 relates to a stack antenna structure electrically connected to a circuit board of an electronic equipment, the stack antenna structure comprising: a first antenna comprising a first-base body, a first-radiation-metal layer, a grounded-metal layer and a first-feed-in component, the first-radiation-metal layer arranged on a surface of the first-base body, the grounded-metal layer arranged on a bottom surface of the first-base body, the first-feed-in component through the first-base body, the first-feed-in component electrically connected to the first-radiation-metal layer through the first-base body, the first-feed-in component through the bottom surface of the first-base body and not electrically connected to the grounded-metal layer a second antenna comprising a second-base body, a second-radiation-metal layer and a second-feed-in component, the second-base body arranged on a surface of the first-radiation-metal layer on the first-base body, the second-radiation-metal layer arranged on a surface of the second-base body, the second-feed-in component through the second-base body and the first-base body, and electrically connected to the second-radiation-metal layer, the second-feed-in component configured to break through the bottom surface of the first-base body to be outside the bottom surface of the first-base body and not electrically connected to the grounded-metal layer and a third antenna comprising a third-base body, a third-radiation-metal layer and a third-feed-in component, the third-base body arranged on a surface of the second-radiation-metal layer on the second-base body, the third-radiation-metal layer arranged on a surface of the third-base body, the third-feed-in component through the third-base body, the second-base body and the first-base body after the third-feed-in component is electrically connected to the third-radiation-metal layer, the third-feed-in component configured to break through the bottom surface of the first-base body to be outside the bottom surface of the first-base body and not electrically connected to the grounded-metal layer.

Item 51 relates to the stack antenna structure in item 50, wherein the first-base body is configured to define a first-through hole, a second-through hole and a third-through hole the first-through hole, the second-through hole and the third-through hole are through the first-base body, the first-radiation-metal layer and the grounded-metal layer the first-feed-in component is configured to break through the first-base body through the second-through hole.

Item 52 relates to the stack antenna structure in item 51, wherein the second-base body is configured to define a fourth-through hole and a fifth-through hole the fourth-through hole and the fifth-through hole are through the second-base body and the second-radiation-metal layer the fourth-through hole and the fifth-through hole are corresponding to the first-through hole and the third-through hole of the first-base body respectively.

Item 53 relates to the stack antenna structure in item 52. The stack antenna structure in claim 3, wherein the second-feed-in component is through the fifth-through hole, and is electrically connected to the second-radiation-metal layer, and then is through the third-through hole to be extended outside the bottom surface of the first-base body, and is not electrically connected to the grounded-metal layer.

Item 54 relates to the stack antenna structure in item 53. The stack antenna structure in claim 4, wherein the third-base body is configured to define a sixth-through hole the sixth-through hole is through the third-base body and the third-radiation-metal layer the sixth-through hole is corresponding to the fourth-through hole of the second-base body and the first-through hole of the first-base body.

Item 55 relates to the stack antenna structure in item 54. The stack antenna structure in claim 5, wherein the third-feed-in component is through the sixth-through hole of the third-base body, the fourth-through hole of the second-base body and the first-through hole of the first-base body to be outside the bottom surface of the first-base body the third-feed-in component is electrically connected to the third-radiation-metal layer when the third-feed-in component is through the sixth-through hole the third-feed-in component is not electrically connected to the grounded-metal layer when the third-feed-in component is through the bottom surface of the first-base body to be outside the bottom surface of the first-base body.

Item 56 relates to the stack antenna structure in item 50, wherein the third-feed-in component is in a T shape; the third-feed-in component comprises a head and a shaft the head is extended to the shaft.

Item 57 relates to the stack antenna structure in item 50, wherein an area of the second-base body is smaller than an area of the first-radiation-metal layer the first-radiation-metal layer is exposed when the second-base body is arranged on the surface of the first-radiation-metal layer.

Item 58 relates to the stack antenna structure in item 50 1, wherein an area of the third-base body is smaller than an area of the second-radiation-metal layer the second-radiation-metal layer is exposed when the third-base body is arranged on the surface of the second-radiation-metal layer.

Item 59 relates to the stack antenna structure in item 50, wherein the first-base body, the second-base body and the third-base body are flat plate-type bodies or block-shaped bodies made of ceramic dielectric materials.

Item 60 relates to an electronic apparatus, comprising: a circuit board, and a stack antenna structure electrically connected to a circuit board, the stack antenna structure comprising: a first antenna comprising a first base body, a first radiation metal layer arranged on a surface of the first base body, and a first-feed-in component a second antenna comprising a second base body arranged on a surface of the first radiation metal layer on the first base body, a second radiation metal layer arranged on a surface of the second base body, and a second-feed-in component, wherein an area of the second base body is smaller than an area of the first radiation metal layer and a third antenna comprising a third base body arranged on a surface of the second radiation metal layer on the second base body, a third radiation metal layer arranged on a surface of the third base body, and a third-feed-in component, wherein an area of the third base body is smaller than an area of the second radiation metal layer.

Item 61 relates to a stack antenna structure electrically connected to a circuit board of an electronic equipment, the stack antenna structure comprising: a first antenna comprising a first-base body, a first-radiation-metal layer and a grounded-metal layer, the first-radiation-metal layer arranged on a surface of the first-base body, the grounded-metal layer arranged on a bottom surface of the first-base body, the first-base body configured to define a first-through hole, a second-through hole, a third-through hole and a fourth-through hole, the first-through hole, the second-through hole, the third-through hole and the fourth-through hole through the first-base body, the first-radiation-metal layer and the grounded-metal layer a second antenna comprising a second-base body and a second-radiation-metal layer, the second-base body arranged on a surface of the first-radiation-metal layer on the first-base body, the second-radiation-metal layer arranged on a surface of the second-base body, the second-base body configured to define a fifth-through hole, a sixth-through hole and a seventh-through hole, the fifth-through hole, the sixth-through hole and the seventh-through hole through the second-base body and the second-radiation-metal layer, the fifth-through hole, the sixth-through hole and the seventh-through hole corresponding to the second-through hole, the third-through hole and the fourth-through hole of the first-base body respectively; and a third antenna comprising a third-base body, a third-radiation-metal layer and a first-feed-in component, the third-base body arranged on a surface of the second-radiation-metal layer on the second-base body, the third-radiation-metal layer arranged on a surface of the third-base body, the third-base body configured to define an eighth-through hole, the eighth-through hole through the third-base body and the third-radiation-metal layer, the eighth-through hole corresponding to the sixth-through hole of the second-base body and the third-through hole of the first-base body, the first-feed-in component in a T shape and comprising a head and a shaft, the head extended to the shaft, the first-feed-in component through the eighth-through hole of the third-base body, the sixth-through hole of the second-base body and the third-through hole of the first-base body to be outside the bottom surface of the first-base body.

Item 62 relates to the stack antenna structure in item 61, wherein the first-feed-in component is electrically connected to the third-radiation-metal layer when the first-feed-in component is through the eighth-through hole the first-feed-in component is coupled to and connected to the second-radiation-metal layer when the first-feed-in component is through the second-base body the first-feed-in component is coupled to and connected to the first-radiation-metal layer on the first-base body when the first-feed-in component is through the third-through hole the first-feed-in component is not electrically connected to the grounded-metal layer when the first-feed-in component is through the bottom surface of the first-base body to be outside the bottom surface of the first-base body the four-hole-and-three-stack antenna structure with a single feed-in is formed.

Item 63 relates to the stack antenna structure in item 62, wherein an area of the second-base body is smaller than an area of the first-radiation-metal layer the first-radiation-metal layer is exposed when the second-base body is arranged on the surface of the first-radiation-metal layer.

Item 64 relates to the stack antenna structure in item 62, wherein an area of the third-base body is smaller than an area of the second-radiation-metal layer the second-radiation-metal layer is exposed when the third-base body is arranged on the surface of the second-radiation-metal layer.

Item 65 relates to the stack antenna structure in item 61, wherein the second antenna further comprises a second-feed-in component passing through the fifth-through hole and electrically connected to the second-radiation-metal layer, and then passing through the second-through hole of the first-base body and wherein the second-feed-in component is through the fifth-through hole of the second-base body and electrically connected to the second-radiation-metal layer, and then is through the second-through hole of the first-base body and coupled to and connected to the first-radiation-metal layer the first-feed-in component is electrically connected to the third-radiation-metal layer when the first-feed-in component is through the eighth-through hole the first-feed-in component is coupled to and connected to the second-radiation-metal layer when the first-feed-in component is through the second-base body the first-feed-in component is coupled to and connected to the first-radiation-metal layer on the first-base body when the first-feed-in component is through the third-through hole neither the second-feed-in component nor the first-feed-in component is electrically connected to the grounded-metal layer when the second-feed-in component and the first-feed-in component are through the bottom surface of the first-base body to be outside the bottom surface of the first-base body the four-hole-and-three-stack antenna structure with two feed-ins is formed.

Item 66 relates to the stack antenna structure in item 65, wherein an area of the second-base body is smaller than an area of the first-radiation-metal layer the first-radiation-metal layer is exposed when the second-base body is arranged on the surface of the first-radiation-metal layer.

Item 67 relates to the stack antenna structure in item 65, wherein an area of the third-base body is smaller than an area of the second-radiation-metal layer the second-radiation-metal layer is exposed when the third-base body is arranged on the surface of the second-radiation-metal layer.

Item 68 relates to the stack antenna structure in item 61, wherein the second antenna further comprises a second-feed-in component passing through the fifth-through hole and electrically connected to the second-radiation-metal layer, and then passing through the second-through hole of the first-base body and wherein the third-feed-in component is through the fourth-through hole of the first-base body and electrically connected to the first-radiation-metal layer the second-feed-in component is through the fifth-through hole of the second-base body and electrically connected to the second-radiation-metal layer, and then is through the second-through hole of the first-base body and coupled to and connected to the first-radiation-metal layer the first-feed-in component is electrically connected to the third-radiation-metal layer when the first-feed-in component is through the eighth-through hole the first-feed-in component is coupled to and connected to the second-radiation-metal layer when the first-feed-in component is through the second-base body the first-feed-in component is coupled to and connected to the first-radiation-metal layer on the first-base body when the first-feed-in component is through the third-through hole none of the third-feed-in component, the second-feed-in component or the first-feed-in component is electrically connected to the grounded-metal layer when the third-feed-in component, the second-feed-in component and the first-feed-in component are through the bottom surface of the first-base body to be outside the bottom surface of the first-base body the four-hole-and-three-stack antenna structure with three feed-ins is formed.

Item 69 relates to the stack antenna structure in item 68, wherein an area of the second-base body is smaller than an area of the first-radiation-metal layer the first-radiation-metal layer is exposed when the second-base body is arranged on the surface of the first-radiation-metal layer.

Item 70 relates to the stack antenna structure in item 68, wherein an area of the third-base body is smaller than an area of the second-radiation-metal layer the second-radiation-metal layer is exposed when the third-base body is arranged on the surface of the second-radiation-metal layer.

Item 71 relates to the stack antenna structure in item 61, wherein the second antenna further comprises a second-feed-in component passing through the fifth-through hole and electrically connected to the second-radiation-metal layer, and then passing through the second-through hole of the first-base body and wherein the two third-feed-in components are through the fourth-through hole and the first-through hole of the first-base body respectively, and are electrically connected to the first-radiation-metal layer the second-feed-in component is through the fifth-through hole of the second-base body and electrically connected to the second-radiation-metal layer, and then is through the second-through hole of the first-base body and coupled to and connected to the first-radiation-metal layer the first-feed-in component is electrically connected to the third-radiation-metal layer when the first-feed-in component is through the eighth-through hole the first-feed-in component is coupled to and connected to the second-radiation-metal layer when the first-feed-in component is through the second-base body the first-feed-in component is coupled to and connected to the first-radiation-metal layer on the first-base body when the first-feed-in component is through the third-through hole none of the two third-feed-in components (, a), the second-feed-in component or the first-feed-in component is electrically connected to the grounded-metal layer when the two third-feed-in components (, a), the second-feed-in component and the first-feed-in component are through the bottom surface of the first-base body to be outside the bottom surface of the first-base body the four-hole-and-three-stack antenna structure with four feed-ins is formed.

Item 72 relates to the stack antenna structure in item 71, wherein an area of the second-base body is smaller than an area of the first-radiation-metal layer the first-radiation-metal layer is exposed when the second-base body is arranged on the surface of the first-radiation-metal layer.

Item 73 relates to the stack antenna structure in item 71, wherein an area of the third-base body is smaller than an area of the second-radiation-metal layer the second-radiation-metal layer is exposed when the third-base body is arranged on the surface of the second-radiation-metal layer.

Item 74 relates to an electronic apparatus, comprising: a circuit board, and a stack antenna structure electrically connected to a circuit board, the stack antenna structure comprising: a first antenna comprising a first base body and a first radiation metal layer arranged on a surface of the first base body, the first-base body configured to define a first-through hole, a second-through hole, a third-through hole and a fourth-through hole a second antenna comprising a second base body arranged on a surface of the first radiation metal layer on the first base body and a second radiation metal layer arranged on a surface of the second base body, the second-base body configured to define a fifth-through hole, a sixth-through hole and a seventh-through hole, wherein an area of the second base body is smaller than an area of the first radiation metal layer and a third antenna comprising a third base body arranged on a surface of the second radiation metal layer on the second base body and a third radiation metal layer arranged on a surface of the third base body, the third-base body configured to define an eighth-through hole, wherein an area of the third base body is smaller than an area of the second radiation metal layer, wherein the second-through hole is aligned with the fifth-through hole, the third-through hole is aligned with the sixth-through hole, and the fourth-through hole is aligned with the seventh-through hole and wherein the sixth-through hole is further aligned with the eighth-through hole.

Item 75 relates to a stack antenna structure electrically connected to a circuit board of an electronic equipment, the five-hole-and-three-stack antenna structure comprising: a first antenna comprising a first-base body, a first-radiation-metal layer and a grounded-metal layer, the first-radiation-metal layer arranged on a surface of the first-base body, the grounded-metal layer arranged on a bottom surface of the first-base body, the first-base body configured to define a first-through hole, a second-through hole, a third-through hole, a fourth-through hole and a fifth-through hole, the first-through hole, the second-through hole, the third-through hole, the fourth-through hole and the fifth-through hole through the first-base body, the first-radiation-metal layer and the grounded-metal layer a second antenna comprising a second-base body and a second-radiation-metal layer, the second-base body arranged on a surface of the first-radiation-metal layer on the first-base body, the second-radiation-metal layer arranged on a surface of the second-base body, the second-base body configured to define a sixth-through hole, a seventh-through hole and an eighth-through hole, the sixth-through hole, the seventh-through hole and the eighth-through hole through the second-base body and the second-radiation-metal layer, the sixth-through hole, the seventh-through hole and the eighth-through hole corresponding to the first-through hole, the second-through hole and the third-through hole of the first-base body respectively; and a third antenna comprising a third-base body, a third-radiation-metal layer and a first-feed-in component, the third-base body arranged on a surface of the second-radiation-metal layer on the second-base body, the third-radiation-metal layer arranged on a surface of the third-base body, the third-base body configured to define a ninth-through hole, the ninth-through hole through the third-base body and the third-radiation-metal layer, the ninth-through hole is corresponding to the eighth-through hole of the second-base body and the third-through hole of the first-base body, the first-feed-in component in a T shape and comprising a head and a shaft, the head extended to the shaft, the first-feed-in component through the ninth-through hole of the third-base body, the eighth-through hole of the second-base body and the third-through hole of the first-base body to be outside the bottom surface of the first-base body.

Item 76 relates to an antenna structure in item 75, wherein the first-feed-in component is electrically connected to the third-radiation-metal layer when the first-feed-in component is through the ninth-through hole the first-feed-in component is coupled to and connected to the second-radiation-metal layer when the first-feed-in component is through the eighth-through hole of the second-base body the first-feed-in component is coupled to and connected to the first-radiation-metal layer on the first-base body when the first-feed-in component is through the third-through hole the first-feed-in component is not electrically connected to the grounded-metal layer when the first-feed-in component is through the bottom surface of the first-base body to be outside the bottom surface of the first-base body the five-hole-and-three-stack antenna structure with a single feed-in is formed.

Item 77 relates to an antenna structure in item 76 wherein an area of the second-base body is smaller than an area of the first-radiation-metal layer the first-radiation-metal layer is exposed when the second-base body is arranged on the surface of the first-radiation-metal layer.

Item 78 relates to an antenna structure in item 76, wherein an area of the third-base body is smaller than an area of the second-radiation-metal layer the second-radiation-metal layer is exposed when the third-base body is arranged on the surface of the second-radiation-metal layer.

Item 79 relates to an antenna structure in item 75, wherein the second antenna further comprises a second-feed-in component passing through the seventh-through hole and electrically connected to the second-radiation-metal layer, and then passing through the second-through hole of the first-base body and wherein the second-feed-in component is through the seventh-through hole of the second-base body and is electrically connected to the second-radiation-metal layer, and then is through the second-through hole of the first-base body and is coupled to and connected to the first-radiation-metal layer the first-feed-in component is electrically connected to the third-radiation-metal layer when the first-feed-in component is through the ninth-through hole the first-feed-in component is coupled to and connected to the second-radiation-metal layer when the first-feed-in component is through the second-base body the first-feed-in component is coupled to and connected to the first-radiation-metal layer on the first-base body when the first-feed-in component is through the third-through hole neither the second-feed-in component nor the first-feed-in component is electrically connected to the grounded-metal layer when the second-feed-in component and the first-feed-in component are through the bottom surface of the first-base body to be outside the bottom surface of the first-base body the five-hole-and-three-stack antenna structure with two feed-ins is formed.

Item 80 relates to an antenna structure in item 79 wherein an area of the second-base body is smaller than an area of the first-radiation-metal layer the first-radiation-metal layer is exposed when the second-base body is arranged on the surface of the first-radiation-metal layer.

Item 81 relates to an antenna structure in item 79, wherein an area of the third-base body is smaller than an area of the second-radiation-metal layer the second-radiation-metal layer is exposed when the third-base body is arranged on the surface of the second-radiation-metal layer.

Item 82 relates to an antenna structure in item 75, wherein the second antenna further comprises two second-feed-in components passing through the seventh-through hole and the sixth-through hole respectively and electrically connected to the second-radiation-metal layer and wherein the two second-feed-in components are through the seventh-through hole and the sixth-through hole of the second-base body respectively, and are electrically connected to the second-radiation-metal layer, and then are through the second-through hole and the first-through hole of the first-base body and are coupled to and connected to the first-radiation-metal layer the first-feed-in component is electrically connected to the third-radiation-metal layer when the first-feed-in component is through the ninth-through hole the first-feed-in component is coupled to and connected to the second-radiation-metal layer when the first-feed-in component is through the second-base body the first-feed-in component is coupled to and connected to the first-radiation-metal layer on the first-base body when the first-feed-in component is through the third-through hole none of the two second-feed-in components or the first-feed-in component is electrically connected to the grounded-metal layer when the two second-feed-in components and the first-feed-in component are through the bottom surface of the first-base body to be outside the bottom surface of the first-base body the five-hole-and-three-stack antenna structure with three feed-ins is formed.

Item 83 relates to an antenna structure in item 82, wherein an area of the second-base body is smaller than an area of the first-radiation-metal layer the first-radiation-metal layer is exposed when the second-base body is arranged on the surface of the first-radiation-metal layer.

Item 84 relates to an antenna structure in item 82, wherein an area of the third-base body is smaller than an area of the second-radiation-metal layer the second-radiation-metal layer is exposed when the third-base body is arranged on the surface of the second-radiation-metal layer.

Item 85 relates to an antenna structure in item 75 wherein the first antenna comprises a third-feed-in component passing through the fifth-through hole and electrically connected to the first-radiation-metal layer wherein the second antenna comprises a two second-feed-in components passing through the seventh-through hole and the sixth-through hole respectively and electrically connected to the second-radiation-metal layer and wherein the third-feed-in component is through the fifth-through hole of the first-base body and is electrically connected to the first-radiation-metal layer the two second-feed-in components are through the seventh-through hole and the sixth-through hole of the second-base body respectively, and are electrically connected to the second-radiation-metal layer, and then are through the second-through hole and the first-through hole of the first-base body and are coupled to and connected to the first-radiation-metal layer the first-feed-in component is electrically connected to the third-radiation-metal layer when the first-feed-in component is through the ninth-through hole the first-feed-in component is coupled to and connected to the second-radiation-metal layer when the first-feed-in component is through the second-base body the first-feed-in component is coupled to and connected to the first-radiation-metal layer on the first-base body when the first-feed-in component is through the third-through hole none of the third-feed-in component, the two second-feed-in components or the first-feed-in component is electrically connected to the grounded-metal layer when the third-feed-in component, the two second-feed-in components and the first-feed-in component are through the bottom surface of the first-base body to be outside the bottom surface of the first-base body the five-hole-and-three-stack antenna structure with four feed-ins is formed.

Item 86 relates to an antenna structure in item 85, wherein an area of the second-base body is smaller than an area of the first-radiation-metal layer the first-radiation-metal layer is exposed when the second-base body is arranged on the surface of the first-radiation-metal layer.

Item 87 relates to an antenna structure in item 85, wherein an area of the third-base body is smaller than an area of the second-radiation-metal layer the second-radiation-metal layer is exposed when the third-base body is arranged on the surface of the second-radiation-metal layer.

Item 88 relates to an antenna structure in item 75, wherein the first antenna comprises two third-feed-in components passing through the fifth-through hole and the fourth-through hole respectively, and electrically connected to the first-radiation-metal layer wherein the second antenna comprises two second-feed-in components passing through the seventh-through hole and the sixth-through hole respectively and electrically connected to the second-radiation-metal layer and wherein the two third-feed-in components are through the fifth-through hole and the fourth-through hole of the first-base body respectively, and are electrically connected to the first-radiation-metal layer the two second-feed-in components are through the seventh-through hole and the sixth-through hole of the second-base body, and are electrically connected to the second-radiation-metal layer, and then are through the second-through hole and the first-through hole of the first-base body and are coupled to and connected to the first-radiation-metal layer the first-feed-in component is electrically connected to the third-radiation-metal layer when the first-feed-in component is through the ninth-through hole the first-feed-in component is coupled to and connected to the second-radiation-metal layer when the first-feed-in component is through the second-base body the first-feed-in component is coupled to and connected to the first-radiation-metal layer on the first-base body when the first-feed-in component is through the third-through hole none of the two third-feed-in components, the two second-feed-in components or the first-feed-in component is electrically connected to the grounded-metal layer when the two third-feed-in components, the two second-feed-in components and the first-feed-in component are through the bottom surface of the first-base body to be outside the bottom surface of the first-base body the five-hole-and-three-stack antenna structure with five feed-ins is formed.

Item 89 relates to an antenna structure in item 88, wherein an area of the second-base body is smaller than an area of the first-radiation-metal layer the first-radiation-metal layer is exposed when the second-base body is arranged on the surface of the first-radiation-metal layer.

Item 90 relates to an antenna structure in item 88, wherein an area of the third-base body is smaller than an area of the second-radiation-metal layer the second-radiation-metal layer is exposed when the third-base body is arranged on the surface of the second-radiation-metal layer.

Item 91 relates to an electronic apparatus, comprising: a circuit board, and a stack antenna structure electrically connected to a circuit board, the stack antenna structure comprising: a first antenna comprising a first base body and a first radiation metal layer arranged on a surface of the first base body, the first-base body configured to define a first-through hole, a second-through hole, a third-through hole, a fourth-through hole, and a fifth-through hole a second antenna comprising a second base body arranged on a surface of the first radiation metal layer on the first base body and a second radiation metal layer arranged on a surface of the second base body, the second-base body configured to define a sixth-through hole, a seventh-through hole and an eighth-through hole, wherein an area of the second base body is smaller than an area of the first radiation metal layer and a third antenna comprising a third base body arranged on a surface of the second radiation metal layer on the second base body and a third radiation metal layer arranged on a surface of the third base body, the third-base body configured to define a ninth-through hole, wherein an area of the third base body is smaller than an area of the second radiation metal layer, wherein the first-through hole is aligned with the sixth-through hole, the second-through hole is aligned with the seventh-through hole, and the third-through hole is aligned with the eighth-through hole and wherein the eighth-through hole is further aligned with the ninth-through hole.

Item 92 relates to an antenna structure antenna structure comprising: a first antenna comprising a first-base body, a first-radiation-metal layer, a grounded-metal layer and a first-feed-in component, the first-radiation-metal layer arranged on a surface of the first-base body, the grounded-metal layer arranged on a bottom surface of the first-base body, the first-base body configured to define a first-through hole, a second-through hole and a third-through hole, the first-through hole, the second-through hole and the third-through hole through the first-base body, the first-radiation-metal layer and the grounded-metal layer, after the first-feed-in component is electrically connected to the first-radiation-metal layer, the first-feed-in component through the third-through hole of the first-base body, and the first-feed-in component not electrically connected to the grounded-metal layer when the first-feed-in component is through the bottom surface of the first-base body a second antenna comprising a second-base body, a second-radiation-metal layer and a second-feed-in component, the second-base body arranged on a surface of the first-radiation-metal layer on the first-base body, the second-radiation-metal layer arranged on a surface of the second-base body, the second-base body configured to define a fourth-through hole and a fifth-through hole, the fourth-through hole and the fifth-through hole through the second-base body and the second-radiation-metal layer, the fourth-through hole and the fifth-through hole corresponding to the first-through hole and the second-through hole of the first-base body, after the second-feed-in component is electrically connected to the second-radiation-metal layer, the second-feed-in component through the fifth-through hole of the second-base body and the second-through hole of the first-base body, the second-feed-in component not electrically connected to the grounded-metal layer when the second-feed-in component is through the bottom surface of the first-base body to be outside the bottom surface of the first-base body a third antenna comprising a third-base body, a third-radiation-metal layer and a third-feed-in component, the third-base body arranged on a surface of the second-radiation-metal layer on the second-base body, the third-radiation-metal layer arranged on a surface of the third-base body, the third-base body configured to define a sixth-through hole, the sixth-through hole through the third-base body and the third-radiation-metal layer, the sixth-through hole corresponding to the fourth-through hole of the second-base body and the first-through hole of the first-base body, after the third-feed-in component is electrically connected to the third-radiation-metal layer, the third-feed-in component through the sixth-through hole of the third-base body, the fourth-through hole of the second-base body and the first-through hole of the first-base body, the third-feed-in component not electrically connected to the grounded-metal layer when the third-feed-in component is through the bottom surface of the first-base body to be outside the bottom surface of the first-base body a conductive-layer group comprising a first-conductive layer, a second-conductive layer and a third-conductive layer, the first-conductive layer arranged on a hole wall of the first-through hole of the first-base body and on a hole wall of the fourth-through hole of the second-base body, the first-conductive layer electrically connected to the grounded-metal layer, the second-conductive layer arranged on a hole wall of the second-through hole of the first-base body and electrically connected to the grounded-metal layer, the third-conductive layer arranged on a hole wall of the third-through hole of the first-base body and electrically connected to the grounded-metal layer and a dielectric-layer group comprising a first-dielectric layer, a second-dielectric layer and a third-dielectric layer, the first-dielectric layer arranged in the first-conductive layer, the first-dielectric layer configured to define a first-punched hole, the third-feed-in component through the first-punched hole, the second-dielectric layer arranged in the second-conductive layer, the second-dielectric layer configured to define a second-punched hole, the second-feed-in component through the second-punched hole, the third-dielectric layer arranged in the third-conductive layer, the third-dielectric layer configured to define a third-punched hole, the first-feed-in component through the third-punched hole, wherein the dielectric-layer group is arranged between the conductive-layer group and the first-feed-in component, the second-feed-in component and the third-feed-in component, to form to comprise characteristics of a coaxial cable.

Item 93 relates to an antenna structure in item 92, wherein the third-feed-in component is in a T shape; the third-feed-in component comprises a head and a shaft the head is extended to the shaft.

Item 94 relates to an antenna structure in item 92, wherein an area of the second-base body is smaller than an area of the first-radiation-metal layer the first-radiation-metal layer is exposed when the second-base body is arranged on the surface of the first-radiation-metal layer.

Item 95 relates to an antenna structure in item 92, wherein an area of the third-base body is smaller than an area of the second-radiation-metal layer the second-radiation-metal layer is exposed when the third-base body is arranged on the surface of the second-radiation-metal layer.

Item 96 relates to an antenna structure in item 92, wherein the first-base body, the second-base body and the third-base body are flat plate-type bodies or block-shaped bodies made of ceramic dielectric materials.

Item 97 relates to an antenna structure in item 92, wherein the first-conductive layer, the second-conductive layer and the third-conductive layer are copper rings.

Item 98 relates to an antenna structure in item 92, wherein the first-dielectric layer, the second-dielectric layer and the third-dielectric layer are teflons.

Item 99 relates to an electronic apparatus, comprising: a circuit board, and a stack antenna structure electrically connected to a circuit board, the stack antenna structure comprising: a first antenna comprising a first base body and a first radiation metal layer arranged on a surface of the first base body a second antenna comprising a second base body arranged on a surface of the first radiation metal layer on the first base body and a second radiation metal layer arranged on a surface of the second base body, wherein an area of the second base body is smaller than an area of the first radiation metal layer and a third antenna comprising a third base body arranged on a surface of the second radiation metal layer on the second base body and a third radiation metal layer arranged on a surface of the third base body, wherein an area of the third base body is smaller than an area of the second radiation metal layer, wherein at least one of the first base body, the second base body, and the third-base body is configured to define at least one through hole to allow passage of a feed-in component; and wherein the through hole comprises a conductive layer disposed on a hole wall of the through hole and a dielectric layer disposed on top of the conductive layer.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A stack antenna structure comprising:

a first antenna comprising a first base body, and a first radiation metal layer, the first radiation metal layer arranged on a surface of the first base body, the first antenna additionally comprising a grounded metal layer and two first-feed-in components, the grounded metal layer arranged on a bottom surface of the first base body, the two first-feed-in components being fed through the first base body, the two first-feed-in components being electrically connected to the first radiation metal layer through the first base body, the two first-feed-in components being fed through the bottom surface of the first-base body, and neither of the two first-feed-in components being electrically connected to the grounded metal layer;

a second antenna comprising a second base body, and a second radiation metal layer, the second base body arranged on a surface of the first radiation metal layer on the first base body, the second radiation metal layer arranged on a surface of the second base body, the second antenna additionally comprising two second-feed-in components, the two second-feed-in components being fed through the second base body and the first base body and being electrically connected to the second radiation metal layer, the two second-feed-in components configured to project through the bottom surface of the first base body to be outside the bottom surface of the first base body, and neither of the two second-feed-in components being electrically connected to the grounded metal layer; and a third antenna comprising a third base body, and a third radiation metal layer, the third base body arranged on a surface of the second radiation metal layer on the second base body, the third radiation metal layer arranged on a surface of the third base body, the third antenna additionally comprising a third-feed-in component, the third-feed-in component being fed through the third base body, the second base body and the first base body, the third-feed-in component being electrically connected to the third radiation metal layer, the third-feed-in component configured to project through the bottom surface of the first base body to be outside the bottom surface of the first base body and third-feed-in component not being electrically connected to the grounded metal layer.

2. The stack antenna structure of claim 1, wherein an area of the second base body is smaller than an area of the first radiation metal layer, and wherein an area of the third base body is smaller than an area of the second radiation metal layer.

3. The stack antenna structure of claim 2, wherein:

the first base body comprises a first-through hole, a second-through hole, a third-through hole and a fourth-through hole, the first-through hole, the second-through hole, the third-through hole and the fourth-through hole being projected through the first base body, the first radiation metal layer and the grounded metal layer;

the second base body of the second antenna comprises a fifth-through hole, a sixth-through hole and a seventh-through hole, the fifth-through hole, the sixth-through hole and the seventh-through hole projecting through the second base body and the second radiation metal layer, the fifth-through hole, the sixth-through hole and the seventh-through hole corresponding to the second-through hole, the third-through hole and the fourth-through hole of the first base body respectively; and the third base body comprising an eighth-through hole, the eighth-through hole projecting through the third base body and the third radiation metal layer, the eighth-through hole corresponding to the sixth-through hole of the second base body and the third through hole of the first base body.

4. The stack antenna structure of claim 1, wherein:

the first base body comprises a first-through hole, a second-through hole, a third-through hole and a fourth-through hole, the first-through hole, the second-through hole, the third-through hole and the fourth-through hole being projected through the first base body, the first radiation metal layer and the grounded metal layer;

the second base body of the second antenna comprises a fifth-through hole, a sixth-through hole and a seventh-through hole, the fifth-through hole, the sixth-through hole and the seventh-through hole projecting through the second base body and the second radiation metal layer, the fifth-through hole, the sixth-through hole and the seventh-through hole corresponding to the second-through hole, the third-through hole and the fourth-through hole of the first base body respectively; and the third base body comprising an eighth-through hole, the eighth-through hole projecting through the third base body and the third radiation metal layer, the eighth-through hole corresponding to the sixth-through hole of the second base body and the third through hole of the first base body.

5. A stack antenna structure comprising:

a first antenna comprising a first base body, and a first radiation metal layer, the first radiation metal layer arranged on a surface of the first base body, the first antenna further comprising a grounded metal layer and a first-feed-in component, the grounded metal layer arranged on a bottom surface of the first base body, the first-feed-in component being fed through the first base body, the first-feed-in component being electrically connected to the first radiation metal layer through the first base body, the first-feed-in component projecting through the bottom surface of the first base body and not being electrically connected to the grounded metal layer;

a second antenna comprising a second base body, and a second radiation metal layer, the second base body arranged on a surface of the first radiation metal layer on the first base body, the second radiation metal layer arranged on a surface of the second base body, the second antenna further comprising a second-feed-in component, the second-feed-in component being fed through the second base body and the first base body, the second-feed-in component being electrically connected to the second radiation metal layer, the second-feed-in component projecting through the bottom surface of the first base body to be outside the bottom surface of the first base body, the second-fee-in component not being electrically connected to the grounded metal layer; and a third antenna comprising a third base body, and a third radiation metal layer, the third base body arranged on a surface of the second radiation metal layer on the second base body, the third radiation metal layer arranged on a surface of the third base body, the third antenna further comprising a third-feed-in component, the third-feed-in component being fed through the third base body, the second base body and the first base body, the third-feed-in component being electrically connected to the third radiation metal layer, the third-feed-in component being configured to break through the bottom surface of the first base body so as to be outside the bottom surface of the first base body, the third-feed-in component not being electrically connected to the grounded metal layer.

6. The stack antenna structure of claim 5, wherein an area of the second base body is smaller than an area of the first radiation metal layer, and wherein an area of the third base body is smaller than an area of the second radiation metal layer.

7. The stack antenna structure of claim 6, wherein:

the first base body comprises a first-through hole, a second-through hole, a third-through hole and a fourth-through hole, the first-through hole, the second-through hole, the third-through hole and the fourth-through hole being projected through the first base body, the first radiation metal layer and the grounded metal layer;

the second base body of the second antenna comprises a fifth-through hole, a sixth-through hole and a seventh-through hole, the fifth-through hole, the sixth-through hole and the seventh-through hole projecting through the second base body and the second radiation metal layer, the fifth-through hole, the sixth-through hole and the seventh-through hole corresponding to the second-through hole, the third-through hole and the fourth-through hole of the first base body respectively; and the third base body comprising an eighth-through hole, the eighth-through hole projecting through the third base body and the third radiation metal layer, the eighth-through hole corresponding to the sixth-through hole of the second base body and the third through hole of the first base body.

8. The stack antenna structure of claim 7, wherein the first-feed-in component is fed through the eighth-through hole of the third base body, the sixth-through hole of the second base body and the second-through hole of the first base body.

9. The stack antenna structure of claim 5, wherein:

the first base body comprises a first-through hole, a second-through hole, a third-through hole and a fourth-through hole, the first-through hole, the second-through hole, the third-through hole and the fourth-through hole being projected through the first base body, the first radiation metal layer and the grounded metal layer;

the second base body of the second antenna comprises a fifth-through hole, a sixth-through hole and a seventh-through hole, the fifth-through hole, the sixth-through hole and the seventh-through hole projecting through the second base body and the second radiation metal layer, the fifth-through hole, the sixth-through hole and the seventh-through hole corresponding to the second-through hole, the third-through hole and the fourth-through hole of the first base body respectively;

the third base body comprising an eighth-through hole, the eighth-through hole projecting through the third base body and the third radiation metal layer, the eighth-through hole corresponding to the sixth-through hole of the second base body and the third through hole of the first base body; and, the first-feed-in component is fed through the eighth-through hole of the third base body, the sixth-through hole of the second base body and the second-through hole of the first base body.

10. A stack antenna structure comprising:

a first antenna comprising a first base body, and a first radiation metal layer, the first radiation metal layer arranged on a surface of the first base body, the first antenna further comprises a grounded metal layer and a first-feed-in component, the grounded metal layer arranged on a bottom surface of the first base body, the first-feed-in component being fed through the first base body, the first-feed-in component electrically connected to the first radiation metal layer through the first base body, the first-feed-in component being fed through the bottom surface of the first base body and is not electrically connected to the grounded metal layer;

a second antenna comprising a second base body, and a second radiation metal layer, the second base body arranged on a surface of the first radiation metal layer on the first base body, the second radiation metal layer arranged on a surface of the second base body, the second antenna further comprises a second-feed-in component, the second-feed-in component being fed through the second base body and the first base body and further being electrically connected to the second radiation metal layer, the second-feed-in component is configured to break through the bottom surface of the first base body to be outside the bottom surface of the first base body and is not electrically connected to the grounded metal layer;

a third antenna comprising a third base body, and a third radiation metal layer, the third base body arranged on a surface of the second radiation metal layer on the second base body, the third radiation metal layer arranged on a surface of the third base body, the third antenna further comprises a third-feed-in component, the third-feed-in component being fed through the third base body, the second base body and the first base body after the third-feed-in component is electrically connected to the third radiation metal layer, the third-feed-in component configured to break through the bottom surface of the first base body to be outside the bottom surface of the first base body and is not electrically connected to the grounded metal layer; and a circuit board, wherein the circuit board comprises a mainboard;

wherein an area of the second base body is smaller than an area of the first radiation metal layer;

wherein an area of the third base body is smaller than an area of the second radiation metal layer;

wherein the circuit board is electrically connected respectively to the first antenna, the second antenna, and the third antenna; and wherein the stack antenna is surface-mounted on the mainboard.

11. The stack antenna structure of claim 10, wherein:

the first antenna additionally comprises two first-feed-in components, the two first-feed-in components are fed through the first-base body, the two first-feed-in components electrically connected to the first radiation metal layer through the first base body, the two first-feed-in components protrude through the bottom surface of the first base body, and neither of the two first-feed-in components are electrically connected to the grounded metal layer; and the second antenna additionally comprises two second-feed-in components, the two second-feed-in components are fed through the second base body and the first base body, and are electrically connected to the second radiation metal layer, the two second-feed-in components configured to break through the bottom surface of the first base body to be outside the bottom surface of the first base body, and neither of the two second-feed-in components are electrically connected to the grounded metal layer.

12. The stack antenna structure of claim 10, wherein:

the second antenna further comprises comprising two second-feed-in components, the two second-feed-in components being fed through the second base body and the first-base body, and electrically connected to the second radiation metal layer, the two second-feed-in components configured to break through the bottom surface of the first base body to be outside the bottom surface of the first base body, and neither of the two second-feed-in components are electrically connected to the grounded metal layer.

13. The stack antenna structure of claim 10, wherein:

the first base body comprising a first-through hole, a second-through hole, a third-through hole and a fourth-through hole, the first-through hole, the second-through hole, the third-through hole and the fourth-through hole being positioned through the first base body, the first radiation metal layer and the grounded metal layer;

the second base body of the second antenna comprises a fifth-through hole, a sixth-through hole and a seventh-through hole, the fifth-through hole, the sixth-through hole and the seventh-through hole being positioned through the second base body and the second radiation metal layer, the fifth-through hole, the sixth-through hole and the seventh-through hole corresponding to the second-through hole, the third-through hole and the fourth-through hole of the first base body, respectively; and the third base body comprising an eighth-through hole, the eighth-through hole being positioned through the third base body and the third radiation metal layer, the eighth-through hole corresponding to the sixth-through hole of the second base body and the third-through hole of the first base body, the first-feed-in component comprising a T shape with a head and a shaft, the first-feed-in component being fed through the eighth-through hole of the third base body, the sixth-through hole of the second base body and the third through hole of the first-base body to be outside the bottom surface of the first-base body.

14. The stack antenna structure of claim 10, wherein:

the first base body of the first antenna comprises a first-through hole, a second-through hole, a third-through hole and a fourth-through hole;

the second base body of the second antenna comprises a fifth-through hole, a sixth-through hole and a seventh-through hole; and the third base body of the third antenna comprises an eighth-through hole;

wherein the second-through hole is aligned with the fifth-through hole, the third-through hole is aligned with the sixth-through hole, and the fourth-through hole is aligned with the seventh-through hole; and wherein the sixth-through hole is further aligned with the eighth-through hole.

15. The stack antenna structure of claim 10, wherein the stack antenna structure comprises a five-hole-and-three-stack antenna structure electrically connected to the circuit board of an electronic equipment, and wherein:

the first base body comprises a first-through hole, a second-through hole, a third-through hole, a fourth-through hole and a fifth-through hole, the first-through hole, the second-through hole, the third-through hole, the fourth-through hole and the fifth-through hole being fed through the first base body, the first radiation metal layer and the grounded metal layer;

the second base body of the second antenna comprises a sixth-through hole, a seventh-through hole and an eighth-through hole, the sixth-through hole, the seventh-through hole and the eighth-through hole extending through the second base body and the second radiation metal layer, the sixth-through hole, the seventh-through hole and the eighth-through hole corresponding to the first-through hole, the second-through hole and the third-through hole of the first base body, respectively; and the third-base body configured to define a ninth-through hole, the ninth-through hole being fed through the third base body and the third radiation metal layer, the ninth-through hole corresponding to the eighth-through hole of the second base body and the third-through hole of the first base body, the first-feed-in component comprising a T shape having a head and a shaft, the first-feed-in component being fed through the ninth-through hole of the third base body, the eighth-through hole of the second base body and the third-through hole of the first base body to be outside the bottom surface of the first base body.

16. The stack antenna structure of claim 10, wherein:

the first base body of the first antenna comprises a first-through hole, a second-through hole, a third-through hole, a fourth-through hole, and a fifth-through hole;

the second base body of the second antenna comprises a sixth-through hole, a seventh-through hole and an eighth-through hole; and the third base body of the third antenna comprises a ninth-through hole;

wherein the first-through hole is aligned with the sixth-through hole, the second-through hole is aligned with the seventh-through hole, and the third-through hole is aligned with the eighth-through hole; and wherein the eighth-through hole is further aligned with the ninth-through hole.

17. The stack antenna structure of claim 10, wherein:

the first base body configured comprising a first-through hole, a second-through hole and a third-through hole, the first-through hole, the second-through hole and the third-through hole being positioned through the first base body, the first radiation metal layer and the grounded metal layer, the first-feed-in component being electrically connected to the first radiation metal layer, the first-feed-in component being fed through the third through hole of the first base body, and the first-feed-in component not being electrically connected to the grounded metal layer;

the second base body comprising a fourth-through hole and a fifth-through hole, the fourth-through hole and the fifth-through hole being positioned through the second base body and the second radiation metal layer, the fourth-through hole and the fifth-through hole corresponding to the first-through hole and the second-through hole of the first base body, and the second-feed-in component is electrically connected to the second radiation metal layer, the second-feed-in component being fed through the fifth-through hole of the second base body and the second-through hole of the first base body, the second-feed-in component not being electrically connected to the grounded metal layer when the second-feed-in component is fed through the bottom surface of the first base body to be outside the bottom surface of the first base body;

the third base body comprising a sixth-through hole, the sixth-through hole being fed through the third base body and the third radiation metal layer, the sixth-through hole corresponding to the fourth-through hole of the second base body and the first through hole of the first base body, the third-feed-in component being electrically connected to the third radiation metal layer, the third-feed-in component being fed through the sixth-through hole of the third base body, the fourth-through hole of the second base body and the first-through hole of the first base body, the third-feed-in component not being electrically connected to the grounded metal layer and the third-feed-in component is fed through the bottom surface of the first base body to be outside the bottom surface of the first base body;

a conductive-layer group comprising a first-conductive layer, a second-conductive layer and a third-conductive layer, the first-conductive layer arranged on a hole wall of the first-through hole of the first base body and on a hole wall of the fourth-through hole of the second base body, the first-conductive layer electrically connected to the grounded metal layer, the second-conductive layer arranged on a hole wall of the second-through hole of the first base body and electrically connected to the grounded metal layer, the third-conductive layer arranged on a hole wall of the third-through hole of the first base body and electrically connected to the grounded-metal layer; and a dielectric-layer group comprising a first-dielectric layer, a second-dielectric layer and a third-dielectric layer, the first-dielectric layer arranged in the first-conductive layer, the first-dielectric layer configured to define a first-punched hole, the third-feed-in component being through the first-punched hole, the second-dielectric layer arranged in the second-conductive layer, the second-dielectric layer configured to define a second-punched hole, the second-feed-in component being fed through the second-punched hole, the third-dielectric layer being arranged in the third-conductive layer, the third-dielectric layer configured to define a third-punched hole, the first-feed-in component being fed through the third-punched hole;

wherein the dielectric-layer group is arranged between the conductive-layer group and the first-feed-in component, the second-feed-in component and the third-feed-in component collectively form characteristics of a coaxial cable.

18. The stack antenna structure of claim 10, wherein:

at least one of the first base body, the second base body, and the third base body is configured to define at least one through hole to allow passage of a feed-in component; and wherein the through hole comprises a conductive layer disposed on a hole wall of the through hole and a dielectric layer disposed on top of the conductive layer.

19. The stack antenna structure of claim 10, wherein:

the first antenna additionally comprises two first feed-in components, the grounded metal layer arranged on the bottom surface of the first base body, the two first feed-in components being fed through the first base body, the two first feed-in components being electrically connected to the first radiation metal layer through the first base body, the two first feed-in components being fed through the bottom surface of the first base body, and neither of the two first feed-in components is electrically connected to the grounded metal layer;

the second antenna additionally comprises two second feed-in components, the two second feed-in components being fed through the second base body and the first base body, and being electrically connected to the second radiation metal layer, the two second feed-in components configured to break through the bottom surface of the first base body to be positioned outside the bottom surface of the first base body, and neither of the two second feed-in components is electrically connected to the grounded metal layer; and the circuit board is electrically connected to the third feed-in component, the two second feed-in components and the two first feed-in components through the third base body, the second base body and the first base body.

* * * * *